US006016790A

United States Patent [19]

Makino et al.

[11] Patent Number: 6,016,790

[45] Date of Patent: Jan. 25, 2000

[54] HIGH-PRESSURE PUMP FOR USE IN FUEL INJECTION SYSTEM FOR DIESEL ENGINE

[75] Inventors: Tadaaki Makino; Shigeiku Enomoto, both of Aichi-ken, Japan

[73] Assignee: Nippon Soken, Inc., Nishio, Japan

[21] Appl. No.: 08/888,238

[22] Filed: Jul. 3, 1997

[30] Foreign Application Priority Data

| | | | |
|---|---|---|---|
| Jul. 5, 1996 | [JP] | Japan | 8-195653 |
| Nov. 14, 1996 | [JP] | Japan | 8-321051 |
| Apr. 3, 1997 | [JP] | Japan | 9-100939 |
| Apr. 30, 1997 | [JP] | Japan | 9-127937 |
| May 22, 1997 | [JP] | Japan | 9-150232 |

[51] Int. Cl.[7] ..... F02M 37/04

[52] U.S. Cl. ..... 123/496; 123/458

[58] Field of Search ..... 123/449, 506, 123/450, 458, 496, 504, 456

[56] References Cited

U.S. PATENT DOCUMENTS

| | | | |
|---|---|---|---|
| 4,073,275 | 2/1978 | Hofer | 123/449 |
| 4,412,519 | 11/1983 | Hoch | 123/449 |
| 4,470,760 | 9/1984 | Jarrett | 123/449 |
| 4,491,111 | 1/1985 | Eheim | 123/449 |
| 4,563,133 | 1/1986 | Yasuhara | 123/449 |
| 4,655,184 | 4/1987 | Eckert | 123/496 |
| 4,884,545 | 12/1989 | Mathis . | |
| 5,150,688 | 9/1992 | Northdurft | 123/449 |
| 5,273,017 | 12/1993 | Braun | 123/449 |

FOREIGN PATENT DOCUMENTS

| | | |
|---|---|---|
| 63-50649 | 3/1988 | Japan . |
| 64-73166 | 3/1989 | Japan . |

*Primary Examiner*—Carl S. Miller
*Attorney, Agent, or Firm*—Pillsbury Madison & Sutro LLP

[57] ABSTRACT

A high-pressure pump for use in a fuel injection system for diesel engines is provided which includes a plunger slidably disposed within a chamber formed in a pump housing to define a pressure chamber whose volume is changed according to sliding movement of the plunger, a check valve disposed within a fluid inlet line extending from an inlet port to the pressure chamber, and a solenoid valve disposed within the fluid inlet line upstream of the check valve. The check valve establishes fluid communication between the inlet port and the pressure chamber during a fluid suction operation wherein the fluid is sucked into the pressure chamber, while blocking the fluid communication between the inlet port and the pressure chamber during a fluid feeding operation wherein the fluid sucked into the pressure chamber is pressurized and discharged from an outlet port. The solenoid valve controls a flow rate of the fluid sucked into the pressure chamber through the check valve. This pump structure is compact in size, consumes less electric power, and is capable of feeding a desired quantity of fuel into the engine accurately.

28 Claims, 36 Drawing Sheets

FIG. 22(a) NE PULSE SIGNAL

FIG. 22(b) LIFT CURVE OF CAM 13

FIG. 22(c) NEEDLE VALVE 73

FIG. 22(d) LIFT CURVE OF PLUNGER 21

FIG. 22(e) CHECK VALVE 4

FIG. 23(a) LIFT CURVE OF CAM 13

FIG. 23(b) SPEED OF PLUNGER 21

FIG. 25(a) NE PULSE SIGNAL
FIG. 25(b) LIFT CURVE OF CAM 13
FIG. 25(c) NEEDLE VALVE 73
FIG. 25(d) LIFT CURVE OF PLUNGER 21
FIG. 25(e) CHECK VALVE 4
PRESSURE/ DISCHARGE
SUCTION
OPEND
CLOSED
OPENED
CLOSED
t1
t2

FIG. 26(a) NE PULSE SIGNAL

FIG. 26(b) LIFT CURVE OF CAM 13

FIG. 26(c) NEEDLE VALVE 73

FIG. 26(d) LIFT CURVE OF PLUNGER 21

FIG. 26(e) CHECK VALVE 4

64
73a
73
62a
61
66
6
64
61a
LIFT
76
5
52
74a
73
75
74b
54
74c
44
43
4

HIGH-PRESSURE PUMP FOR USE IN FUEL INJECTION SYSTEM FOR DIESEL ENGINE

BACKGROUND OF THE INVENTION

1. Technical Field

The present invention relates generally to an improvement on a high-pressure pump for use in a common-rail injection system for diesel engines for supplying high-pressure fuel to the engine.

2. Background of Related Art

A common-rail injection system is known as one of fuel injection systems for diesel engines. Japanese Patent First Publication No. 64-73166 teaches a conventional common-rail injection system. This common-rail injection system has an accumulator pipe referred to as a common rail connected to all cylinders of the engine and supplies through a high-pressure pump a desired quantity of fuel to the common rail to maintain the fuel pressure therewith in constant. The fuel stored within the accumulator pipe is sprayed into each cylinder through an injector with given timing.

FIG. 1 shows, as one example, a conventional high-pressure pump for use in the common-rail injection system. The high-pressure pump includes a plunger 92 which is moved vertically by a cam (not shown) within a cylinder 91 and defines a pressure chamber 93 between an upper wall thereof and an inner wall of the cylinder 91. Disposed above the pressure chamber 93 is a solenoid valve 94 having a valve head 96 for establishing and blocking fluid communication between the pressure chamber 93 and a low-pressure path 95.

When a coil 97 of the solenoid valve 94 is deenergized, the valve head 96 is brought into an open position so that the fuel is allowed to be fed by a low-pressure pump (not shown) into the pressure chamber 93 through the low-pressure path 95 and the clearance around the valve head 96 during downward movement of the plunger 92. Alternatively, when the coil 97 is energized, the valve head 96 is attracted upward into engagement with a conical valve seat 98 to block the fluid communication between the pressure chamber 93 and the low-pressure path 95. The upward movement of the plunger 93 causes the pressure of fluid in the pressure chamber 93 to rise so that the fluid is discharged to the accumulator pipe from an outlet path 99 opening into an inner wall of the pressure chamber 93.

During the upward movement of the plunger 92, the increased fuel pressure within the pressure chamber 93 acts on the valve head 96 to urge it into a closed position. This causes the valve head 96 to be held closed once it is seated on the valve seat 98 even when the coil 97 is energized. In order to avoid this problem, the conventional high-pressure pump controls the valve-closing timing under the so-called prestroke control to adjust the flow rate of the fuel supplied to the accumulator pipe. Specifically, the supply of a desired amount of fuel to the accumulator pipe is accomplished by holding the valve head 96 opened to discharge part of the fuel sucked into the pressure chamber 93 to the low-pressure path 95 until the amount of fuel within the pressure chamber 93 reaches a desired value, without closing the valve head 96 immediately after the plunger 92 starts to move upward, after which the valve head 96 is closed.

However, an increase in discharge rate of the high-pressure pump due to a rise in speed of the engine gives rise to the problem that the valve head 96 is closed by itself even if the solenoid valve 94 is not energized. This is because the fuel pressure within the pressure chamber 93 acts directly on the bottom of the valve head 96, and the fuel pressure produced by part of the fuel flowing through an orifice defined by the valve head 96 and the valve seat 98 to the low-pressure path 95 urges the valve head 96 into the closed position during the upward movement of the plunger 92. This may result in a failure in flow rate adjustment.

The above problem may be alleviated by lengthening the stroke of the valve head 96 or increasing a spring pressure of a return spring for the valve head 96. However, in either case, the valve-closing response is lowered. The lowering of the valve-closing response may be avoided by increasing the electric power applied to the coil 97 or the size of the solenoid valve 94 to increase the magnetic attraction produced by the coil 97, but results in increases in cost of electric power and production of the solenoid valve 94.

The above high-pressure pump also has the following drawback. A time lag always occurs between input of a valve-closing signal to the solenoid valve 94 and a time when the valve head 96 is seated on the valve seat 98 to block the fluid communication between the pressure chamber 93 and the low-pressure path 95. The valve-closing timing, thus, needs to be controlled taking this time lag into account. However, when the engine speed rises to require an increase in discharge rate of the high-pressure pump, it will cause the timing with which the valve head 96 is opened and closed to be late.

SUMMARY OF THE INVENTION

It is therefore a principal object of the present invention to avoid the disadvantages of the prior art.

It is another object of the present invention to provide a high-pressure pump for a fuel injection system for automotive vehicles which is capable of controlling the flow rate of fuel to be supplied to an accumulator pipe easily and accurately without being increased in size and requiring more electric power.

According to one aspect of the present invention, there is provided a high-pressure pump which comprises: (a) a pump body; (b) an inlet port provided in the pump body into which fluid is sucked; (c) an outlet port provided in the pump body from which the fuel is discharged; (d) a chamber formed within the pump body; (e) a plunger slidably disposed within the chamber to define a pressure chamber whose volume is changed according to sliding movement of the plunger, the pressure chamber communicating with the inlet and outlet ports, pressurizing the fluid sucked from the inlet port, and discharging the pressurized fluid out of the outlet port; (f) a fluid inlet line extending from the inlet port to the pressure chamber; (g) a first valve disposed within the fluid inlet line, establishing fluid communication between the inlet port and the pressure chamber during a fluid suction operation wherein the fluid is sucked into the pressure chamber, while blocking the fluid communication between the inlet port and the pressure chamber during a fluid feeding operation wherein the fluid sucked into the pressure chamber is pressurized and discharged from the outlet port; and (h) a second valve disposed within the fluid inlet line upstream of the first valve, controlling a flow rate of the fluid sucked into the pressure chamber through the first valve.

In the preferred mode of the invention, the first valve is a check valve designed to allow the fluid to flow from the inlet port to the pressure chamber, while preventing the fluid from flowing from the pressure chamber to the inlet port.

The second valve is a solenoid valve designed to electrically establish and block fluid communication between the inlet port and the pressure chamber.

The solenoid valve has a valve head portion which is exposed inside the fluid inlet and which is seated on a valve seat formed in the fluid inlet line to block the fluid communication between the inlet port and the pressure chamber. The valve head portion is so geometrically shaped that pressure of the fluid urging the valve head portion into engagement with the valve seat is balanced with pressure of the fluid urging the valve head portion out of engagement with the valve seat.

The direction in which the valve head portion is moved out of the engagement with the valve seat is different from the direction to which the fluid flows from the inlet port to the pressure chamber.

The second valve may alternatively be a throttle valve having a valve member which opens and closes the fluid inlet line, The degree to which the valve member is opened is adjusted to control the flow rate of the fluid sucked into the pressure chamber.

A control unit is provided which controls a time when the solenoid valve is energized so that the solenoid valve starts to open a part of the fluid inlet line upstream of the first valve for establishing the fluid communication the inlet port and the pressure chamber when the plunger reaches a position where the volume of the pressure chamber is minimized.

A fluid path is provided which communicates between a portion of the fluid inlet line downstream of the second valve and the inside of the second valve. A partition is disposed within the second valve to isolate from fluid pressure component parts of the second valve which would be deformed when subjected to the fluid pressure.

The second valve may also be a solenoid valve including a valve member, a coil, and a resinous bobbin around which the coil is wound. The valve member opens and closes a portion of the fluid inlet line to establish and block fluid communication between the inlet port and the first valve. The coil, when energized, moves the valve member. The partition is made of a non-magnetic material withstanding the fluid pressure without being deformed and divides the inside of the solenoid valve into a first chamber within which the coil and the bobbin are disposed and a second chamber leading to the fluid path.

The fluid path may be formed within the solenoid valve.

A fluid path is provided which communicates between a portion of the fluid inlet line downstream of the second valve and the inside of the second valve when the second valve allows fluid flow into the pressure chamber. A blocking means is provided for blocking fluid communication between the portion of the fluid inlet line downstream of the second valve and the inside of the second valve when the second valve blocks the fluid blow into the pressure chamber. The second valve may be a solenoid valve having a valve member which has formed therein the fluid path which also communicates between the pressure chamber and the inlet port. The blocking means blocks the fluid communication between the portion of the fluid inlet line downstream of the solenoid and the inside of the solenoid, while blocking the fluid communication between the pressure chamber and the inlet port.

According to another aspect of the present invention, there is provided a high-pressure pump which comprises: (a) a pump body; (b) an inlet port provided in the pump body into which fluid is sucked; (c) an outlet port provided in the pump body from which the fuel is discharged; (d) a chamber formed within the pump body; (e) a plunger disposed within the chamber slidably to define a pressure chamber whose volume is changed according to sliding movement of the plunger, the pressure chamber communicating with the inlet and outlet ports and pressurizing the fluid sucked from the inlet port; (f) a valve means for discharging the fluid pressurized within the pressure chamber up to a given level from the outlet port; and (g) a cam having a lift curve which moves the plunger in a first direction to decrease the volume of the pressure chamber for pressurizing the fluid within the pressure chamber and in a second direction to increase the volume of the pressure chamber for sucking the fluid from the inlet port during complete rotation of the cam, the lift curve including a portion where the plunger is held from moving for a given period of time until the plunger starts to move in the second direction following the movement in the first direction.

In the preferred mode of the invention, a check valve and a solenoid valve are provided. The check valve is disposed within a fluid inlet line extending from the inlet port to the pressure chamber to allow the fluid to flow from the inlet port to the pressure chamber, while restricting the fluid from flowing out of the pressure chamber to the inlet port. The solenoid valve opens and closes a portion of the fluid inlet line upstream of the first valve to control a flow rate of the fluid sucked into the pressure chamber through the check valve. The given period of time during which the plunger is held from moving is so determined that the solenoid valve opens the portion of the fluid inlet line fully before the plunger starts to move in the second direction.

The given period of time during which the plunger is held from moving corresponds to 5° to 20° as expressed as a rotational angle of the cam.

The cam has a curved inner wall the plunger follows to move in the first and second directions. The curved inner wall having a portion curved along part of a circle whose center lies at the rotational center of the cam for holding the plunger from moving from the first direction to the second direction for the given period of time.

According to a further aspect of the present invention, there is provided a fuel injection system for an engine which comprises: (a) injectors for injecting fuel into cylinders of the engine; (b) a high-pressure fuel accumulator pipe connected to the injectors; (c) solenoid valves controlling fuel injection of the injectors; and (d) a high-pressure pump supplying the fuel to the high-pressure accumulator pipe. The high-pressure pump includes (1) a pump body; (2) an inlet port provided in the pump body into which fluid is sucked; (3) an outlet port provided in the pump body from which the fuel is discharged; (4) a chamber formed within the pump body; (5) a plunger disposed within the chamber slidably to define a pressure chamber whose volume is changed according to sliding movement of the plunger, the pressure chamber communicating with the inlet and outlet ports and pressurizing the fluid sucked from the inlet port; (6) a valve means for discharging the fluid pressurized within the pressure chamber up to a given level from the outlet port; and (7) a cam having a lift curve which moves the plunger in a first direction to decrease the volume of the pressure chamber for pressurizing the fluid within the pressure chamber and in a second direction to increase the volume of the pressure chamber for sucking the fluid from the inlet port during complete rotation of the cam, the lift curve including a portion where the plunger is held from moving for a given period of time until the plunger starts to move in the second direction following the movement in the first direction.

According to a still further aspect of the invention, there is provided a high-pressure pump which comprises: (a) a pump body; (b) an inlet port provided in the pump body into which fluid is sucked; (c) an outlet port provided in the pump body from which the fuel is discharged; (e) a chamber formed within the pump body; (f) a plunger slidably disposed within the chamber to define a pressure chamber communicating with the inlet and outlet ports, the volume of the pressure chamber being increased by sliding movement of the plunger in a fluid suction operation to suck the fluid from the inlet port and decreased by sliding movement of the plunger in a fluid pressure/discharge operation to pressurize the fluid sucked into the pressure chamber and to discharge the pressurized fluid out of the outlet port; (g) a fluid inlet line extending from the inlet port to the pressure chamber; (h) a solenoid valve establishing fluid communication between the pressure chamber and the fluid inlet line in the fluid discharging operation to release part of the fluid within the pressure chamber to the fluid inlet line for discharging a desired amount of the fluid; and (i) a cam having a lift curve which moves the plunger in a first direction to decrease the volume of the pressure chamber for pressurizing the fluid within the pressure chamber and in a second direction to increase the volume of the pressure chamber for sucking the fluid from the inlet port during complete rotation of the cam, the lift curve including a portion where the plunger is held from moving for a given period of time until the plunger starts to move in the second direction following the movement in the first direction.

In the preferred mode of the invention, the given period of time during which the plunger is held from moving corresponds to 5° to 20° as expressed as a rotational angle of the cam.

The cam has a curved inner wall the plunger follows to move in the first and second directions. The curved inner wall has a portion curved along part of a circle whose center lies at the rotational center of the cam for holding the plunger from moving from the first direction to the second direction for the given period of time.

BRIEF DESCRIPTION OF THE DRAWINGS

The present invention will be understood more fully from the detailed description given hereinbelow and from the accompanying drawings of the preferred embodiment of the invention, which, however, should not be taken to limit the invention to the specific embodiment but are for explanation and understanding only.

In the drawings:

FIG. 4(*b*) is a vertical cross sectional view which shows a solenoid valve when turned on;

FIG. 4(*c*) is a horizontal cross sectional view taken along the line A—A in FIG. 4(*b*);

FIG. 5(*b*) is an enlarged view, as circled in FIG. 5(*a*);

FIG. 6(*b*) is a vertical cross sectional view which shows a high-pressure pump at the end of a fuel suction operation;

FIG. 7(*b*) is a vertical cross sectional view which shows a high-pressure pump at the end of a fuel pressure/discharge operation;

FIG. 11(*b*) is a cross sectional view taken along the line D—D in FIG. 11(*a*);

FIG. 12(*b*) is a time chart which shows a lift curve of a cam;

FIG. 12(*c*) is a time chart which shows energization of a solenoid valve 6;

FIG. 12(*d*) is a time chart which shows an operation of a needle valve;

FIG. 12(*e*) is a time chart which shows a lift curve of a plunger;

FIG. 12(*f*) is a time chart which shows an operation of a check valve;

FIG. 12(*g*) is a time chart which shows the pressure in a common rail;

FIG. 14(*b*) is a time chart which shows delayed energization of a solenoid valve;

FIG. 14(*c*) is a time chart which shows an operation of a needle valve when energization of a solenoid valve is delayed;

FIG. 14(*d*) is a time chart which shows a lift curve of a plunger when energization of a solenoid valve is delayed;

FIG. 14(*e*) is a time chart which shows an operation of a check valve when energization of a solenoid valve is delayed;

FIG. 14(*f*) is a time chart which shows the pressure in a common rail when energization of a solenoid valve is delayed;

FIG. 15(*b*) is a time chart which shows advanced energization of a solenoid valve;

FIG. 15(*c*) is a time chart which shows an operation of a needle valve when energization of a solenoid valve is advanced;

FIG. 15(*d*) is a time chart which shows a lift curve of plungers when energization of a solenoid valve is advanced;

FIG. 15(*e*) is a time chart which shows an operation of a check valve when energization of a solenoid valve is advanced;

FIG. 15(*f*) is a time chart which shows the pressure in a common rail when energization of a solenoid valve is advanced;

FIG. 20(*b*) is a cross sectional view which shows a cam when plungers lie at the outermost position;

FIG. 22(*b*) is a time chart which shows a lift curve of a cam;

FIG. 22(*c*) is a time chart which shows energization of a needle valve of a solenoid valve;

FIG. 22(*d*) is a time chart which shows a lift curve of plungers;

FIG. 22(*e*) is a time chart which shows an operation of a check valve;

FIG. 23(*b*) is a time chart which shows the speed of plungers;

FIG. 25(*b*) is a time chart which shows a lift curve of a cam in a conventional high-pressure pump;

FIG. 25(*c*) is a time chart which shows energization of a needle valve of a solenoid valve in a conventional high-pressure pump;

FIG. 25(*d*) is a time chart which shows a lift curve of plungers in a conventional high-pressure pump;

FIG. 25(*e*) is a time chart which shows an operation of a check valve in a conventional high-pressure pump;

FIG. 26(*b*) is a time chart which shows a lift curve of a cam in the fifth embodiment;

FIG. 26(*c*) is a time chart which shows energization of an operation of a needle valve of a solenoid valve in the fifth embodiment;

FIG. 26(*d*) is a time chart which shows a lift curve of plungers in the fifth embodiment;

FIG. 26(*e*) is a time chart which shows an operation of a check valve in the fifth embodiment;

FIG. 29(*b*) is a partially enlarge view which shows a needle valve of a solenoid valve;

FIG. 30 is a partial cross sectional view which shows the high-pressure pump in FIG. 29(*a*) when a solenoid valve is turned on;

FIG. 31(*b*) is a partially cross sectional view which shows the high-pressure pump in FIG. 31(*a*) when a solenoid valve is turned on;

FIG. 31(*c*) is a cross sectional view taken along the line B—B in FIG. 31(*b*);

FIG. 33(*b*) is a time chart which shows a lift curve of a cam in a conventional high-pressure pump under prestroke control;

FIG. 33(*c*) is a time chart which shows energization of a solenoid valve 6 in a conventional high-pressure pump under prestroke control;

FIG. 33(*d*) is a time chart which shows an operation of a needle valve;

FIG. 33(*e*) is a time chart which shows a lift curve of a plunger in a conventional high-pressure pump under prestroke control;

FIG. 34(*b*) is a time chart which shows a lift curve of a cam in a conventional high-pressure pump when it is required to discharge a small amount of fuel;

FIG. 34(*c*) is a time chart which shows energization of a solenoid valve 6 in a conventional high-pressure pump when it is required to discharge a small amount of fuel;

FIG. 34(*d*) is a time chart which shows an operation of a needle valve of a solenoid valve FIG. 34(*e*) is a time chart which shows a lift curve of plungers in a conventional high-pressure pump when it is required to discharge a small amount of fuel;

FIG. 34(*f*) is an enlarged view as circled in FIG. 34(*e*);

FIG. 36(*b*) is a time chart which shows a lift curve of a cam in the ninth embodiment;

FIG. 36(*c*) is a time chart which shows energization of a solenoid valve 6 in the ninth embodiment;

FIG. 36(*d*) is a time chart which shows an operation of a needle valve of a solenoid valve; and FIG. 36(*e*) is a time chart which shows a lift curve of plungers in the ninth embodiment.

DESCRIPTION OF THE PREFERRED EMBODIMENT

Figure 1:
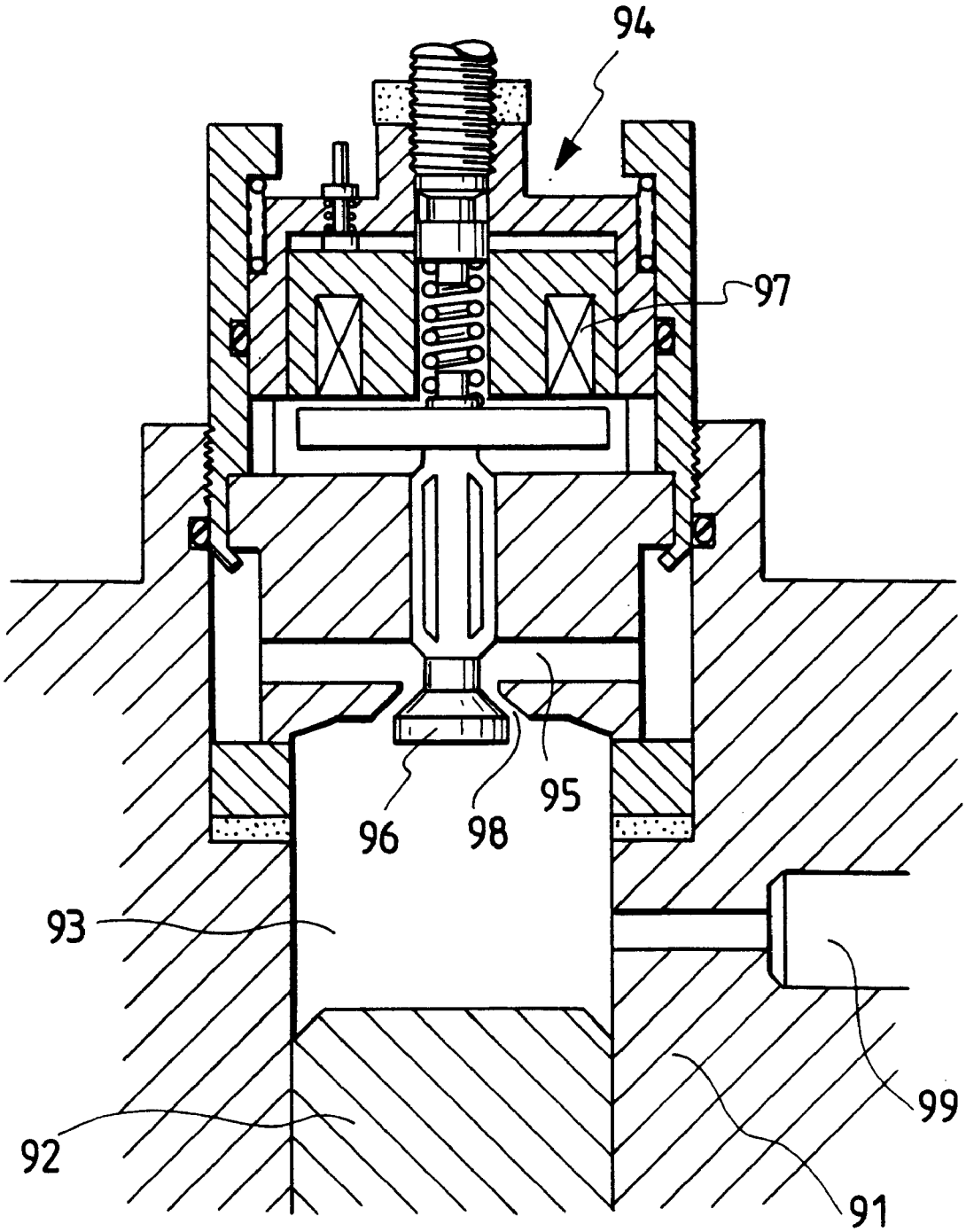
FIG. 1 PRIOR ART
FIG. 1 is a vertical sectional view which shows a conventional high-pressure pump for use in a fuel injection system for diesel engines.

Referring now to the drawings, wherein like reference numbers refer to like parts throughout several views, particularly to FIGS. 2 to 7(*b*), there is shown a high-pressure pump P used as a fuel injection pump in a common-rail fuel injection system for diesel engines according to the first embodiment of the present invention.

An engine E has disposed therein a plurality of injectors I, one for each cylinder. The injectors I all communicate with a high-pressure accumulator pipe (referred to as a common rail R, hereinafter). The fuel injection of each of the injectors I into one of combustion chambers of the cylinders is controlled by on-off operations of a solenoid valve B1. Specifically, each of the injectors I sprays fuel stored in the common rail R under pressure into one of the combustion chamber of the engine E while corresponding one of the solenoid valves B1 is in a valve open position. The high-pressure pump P pressurizes fuel supplied from a fuel tank T through a conventional low-pressure pump (a feed pump) P1 up to a level required to fuel injection and supplies it to the common rail R through a supply pile R1 and a check valve (delivery valve) 3 so as to maintain the fuel pressure within the common rail R constant.

The common rail R has disposed within a pressure sensor S1 which measures the pressure within the common rail R to provide a signal indicative thereof to an electronic control unit (ECU) 100. The ECU 100 also connects with a speed sensor S2 and a load sensor S3. The speed sensor S2 measures the speed of the engine E. The load sensor S3 measures the load of the engine E. The ECU 100 receives information on the fuel pressure, engine speed, and engine load from the sensors S1 to S3 to determine an optimum delivery or discharge rate of the high-pressure pump and provides a control signal to a delivery control unit P2. The ECU 100 also determines the optimum injection timing and fuel injection quantity according to an operating condition of the engine E based on the engine speed and the engine load measured by the speed sensor S2 and the load sensor S3 and valve control signals to the solenoid valves B1.

Figure 3:
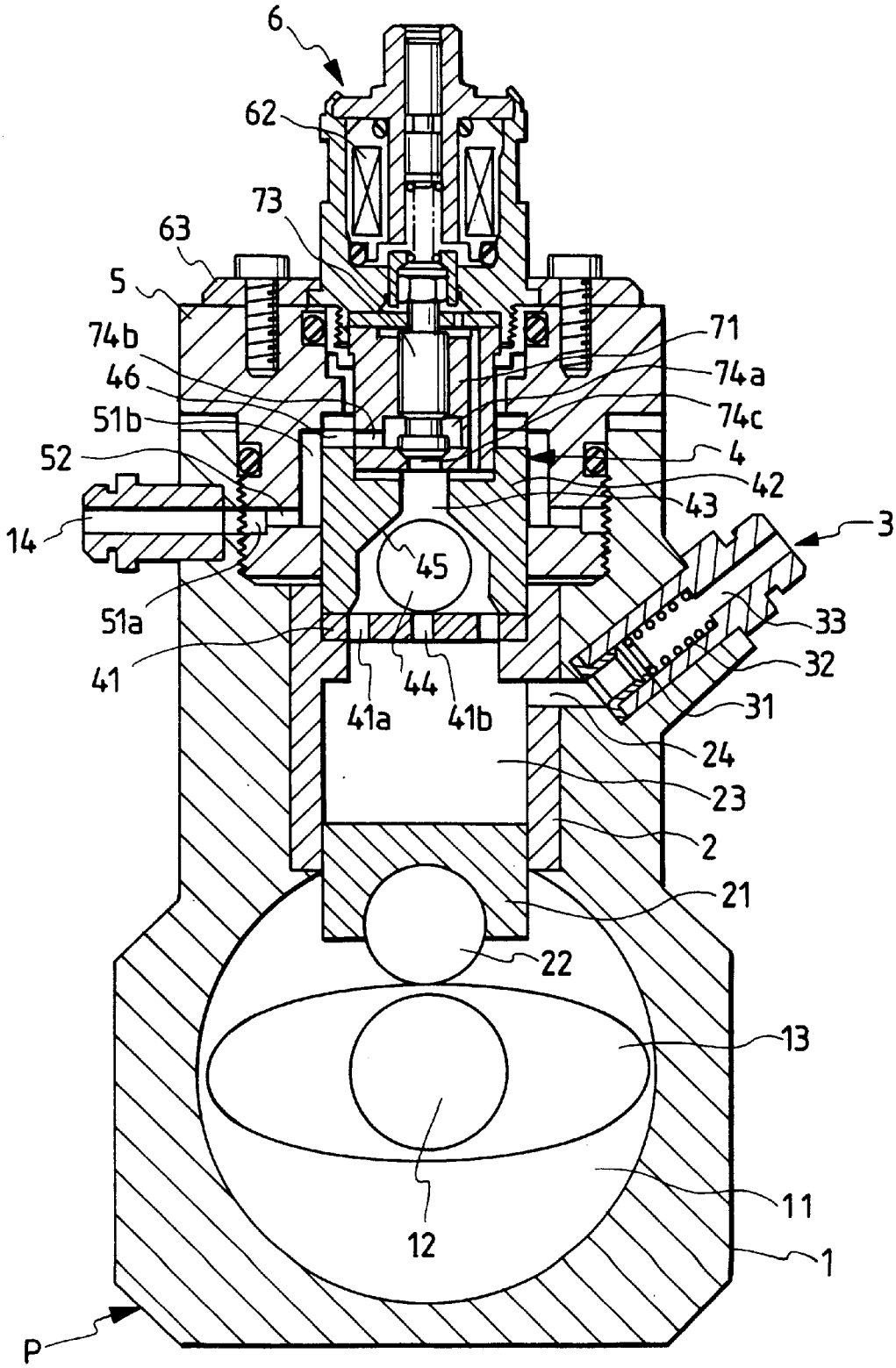
FIG. 3 is a vertical cross sectional view which shows the high-pressure pump in FIG. 2.

The high-pressure pump P, as shown in FIG. 3, includes a pump housing 1 defining therein a cam chamber 11. Within the cam chamber 11, a cam 13 is disposed which is installed on a cam shaft 12. The cam shaft 12 is connected to the engine E and rotates at the speed of ½ times that of the engine E. The cam 13, as clearly shown in the drawing, is of oval shape in cross section so that it lifts a cam roller 22 upward two times during a complete turn of the cam shaft 12.

The pump housing 1 has disposed above the cam chamber 11 a cylinder 2 within which a plunger 21 is retained slidably. The plunger 21 has disposed in its end the cam roller 22 which is in constant engagement with the cam 13 and is displaced vertically, as viewed in the drawing, according to vertical movement of the cam roller 22 according to rotation of the cam 13.

Most of conventional high-pressure pumps usually have a spring which urges a plunger into constant engagement with a cam, but the high-pressure pump P of this embodiment is of an intake fluid-controlled type which may cause the cavitation due to reduction in pressure within a pressure chamber 23, as will be described later, when the plunger 21 reaches a bottom dead center in case where an intake of fluid is small. For avoid this drawback, no spring is provided in the high-pressure pump P of this embodiment. Specifically, the reciprocal movement of the plunger 21 is accomplished with rotation of the cam shaft 12 during a delivery stroke, while it is accomplished with the pressure (i.e., feed pressure) of fuel supplied from the feed pump P1 during a suction stroke. Thus, when it is required to suck a small amount of fuel, the plunger 21 stops dropping when a sucked amount of fuel reaches a desired value without following the cam 13 up to the bottom head center.

The plunger 21 defines the pressure chamber 23 between an upper surface thereof and an inner wall of the cylinder 2. The fuel within the pressure chamber 23 is pressurized by upward movement of the plunger 21. The pressurized fuel is discharged from an outlet port 24 opening into the cylinder 2 to the common rail R through the delivery valve 3 installed in the side wall of the pump housing 1. The delivery valve 3 includes a valve head 31 and a return spring 32. The return spring 32 urges the valve head 31 into a closed position. When the pressurized fuel within the pressure chamber 23 exceeds a given level, it moves the valve head 31 against a spring pressure of the return spring 32 to establish fluid communication between the pressure chamber 23 and an outlet path 33.

A check valve 4 is disposed above the pressure chamber 23 within the pump housing 1 and includes a housing 42, and a valve head 44 made of a ball. The housing 42 defines therein a fluid path 43 which is opened and closed by the valve head 44. The fluid path 43 has a conical valve seat 45 expanding toward the pressure chamber 23 on which the valve head 44 is seated and communicates with the pressure chamber 23 through a stopper 41.

The stopper 41 is made of a disc member having formed therein holes 41*a* and 41*b*. The valve head 44 is placed on the central hole 41*b* of the stopper 41 so that it may be subject to the dynamic pressure of fuel within the pressure chamber 23. A lock adapter 5 is screwed into an end portion of the pump housing 1 to retain the stopper 41, the check valve 4, and the cylinder 2 within the pump housing 1.

The lock adapter 5 has formed therein a feed path 52 communicating between a fuel sump 51*a* and a fuel sump 51*b*. The fuel sump 51*a* is formed between the lock adapter 5 and the pump housing 1. The fuel sump 51*b* is formed between the lock adapter 5 and the housing 42 of the check valve 4. Into the feed path 52, the low-pressure fuel is introduced from an inlet pipe 14 installed in the side wall of the pump housing 1 through the fuel sump 51*a*. The fuel then flows into the fluid path 43 through a fluid path 46 formed in the check valve 4 communicating with the fuel sump 51*b* and a fluid path formed in a solenoid valve 6, as will be discussed later in detail. A line from the fluid path 43 to the inlet pipe 14 defines a low-pressure path.

Figure 4A:
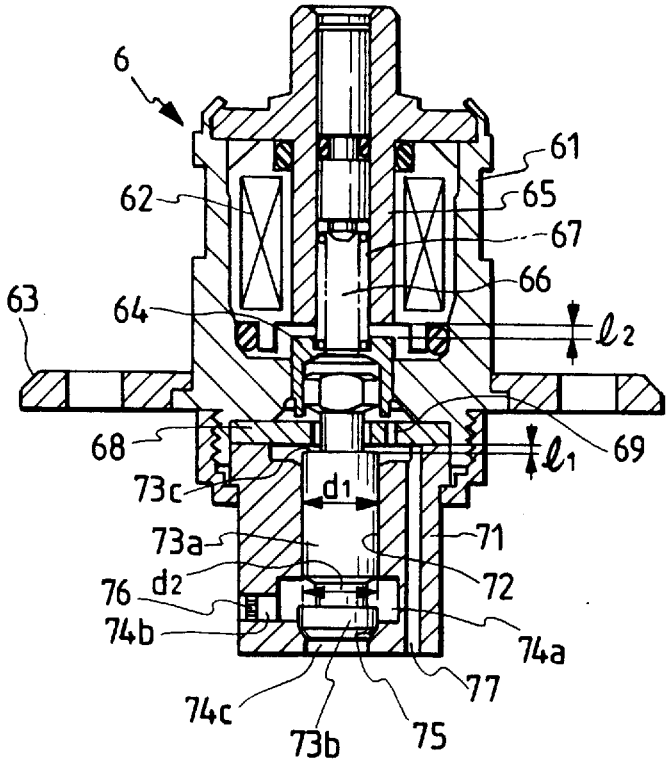
FIG. 4(*a*) is a vertical cross sectional view which shows a solenoid valve when turned off.
Figure 4B:
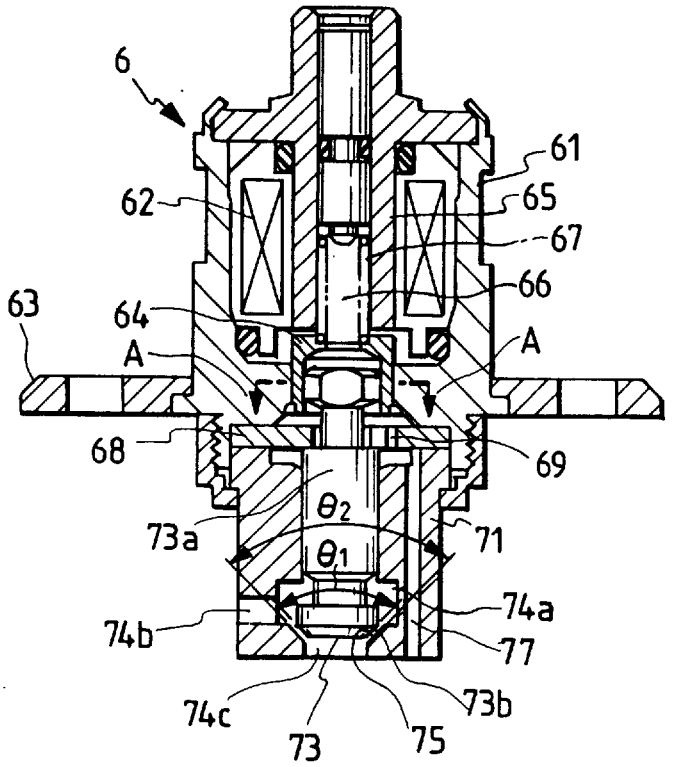
Figure 4C:
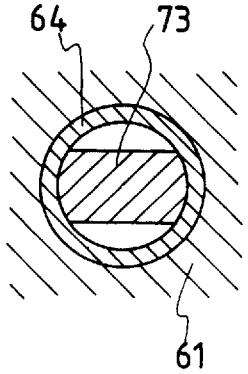

The solenoid valve 6 is disposed on the check valve 4 and includes, as shown in FIGS. 4(*a*) and 4(*b*), a housing 61 and a valve body 71 fitted into the bottom of the housing 61. The housing 61 has disposed therein a coil 62. The solenoid valve 6 is, as shown in FIG. 3, bolted to an upper surface of the lock adapter 5 through a flange 63 installed on the periphery of the housing 61. The valve body 71 is partially inserted into the check valve 4 within a central hole of the lock adapter 5.

The valve body 71, as shown in FIG. 4(*a*), has formed therein a cylindrical chamber 72 within which a needle valve 73 is slidably disposed. An annular path 74*a* is formed around the top of the needle valve 73. A fluid path 74*b*, as shown in FIG. 3, opens into a side wall of the annular path 74*a*. A fluid path 74*c* which communicates with the fluid path 43 of the check valve 4 opens into the bottom of the annular path 74*a*. The valve body 71 has formed therein a conical valve seat 75 on which the needle valve 73 is seated to block the fluid communication between the fluid path 74*c* and the annular path 74*a*.

The needle valve 73, as shown in FIG. 4(*b*), includes a cylindrical stem 73*a* and a valve head 73*b*. The cylindrical stem 73*a* has the diameter d1 substantially equal to the diameter d2 of the valve head 73*b* (i.e., the diameter of an end portion of the valve head 73*b* in contact with the valve seat 75 so that the hydraulic pressures produced by fuel within the annular path 74*a* urging the needle valve 73 upward and downward are balanced with each other. A filter 76 is installed in the fluid path 74*b* to prevent the needle valve 73 from being held in an open position due to inclusion of foreign materials between the needle valve 73 and the valve seat 75. The filter 76 may be made of a metallic mesh having a mesh size smaller than a cross sectional area of a path communicating between the annular path 74*a* and the fluid path 74*c*, formed when the needle valve 73 is lifted upward and reaches an upper limit. The filter 76 may alternatively be installed at any location of the low-pressure path extending from the fuel tank T and the solenoid valve 6.

The valve head 73*b* of the needle valve 73 is, as shown in FIG. 4(*b*), chamfered at an angle $\theta_1$ which is 1° greater than an angle $\theta_2$ of the valve seat 75 of the valve body 71 for improving the liquid-tight seal between the valve head 73*b* and the valve seat 75 when the valve head 73*b* is seated on the valve seat 75.

An armature 64 is press-fitted on the upper end of the needle valve 73 in alignment with a stator 65 at a given air gap ($l_2$) as shown in FIG. 4(*a*). The coil 62 is wound around the periphery of the stator 65. A spring 67 is disposed within a spring chamber formed in the stator 65 to urge the armature 64 downward, as viewed in the drawings.

When the coil 62 is deenergized as shown in FIG. 4(*a*), the armature 64 is urged downward along with the needle valve 73 by the spring 67 so that the valve head 73*b* is seated on the valve seat 75 to block the fluid communication between the pressure chamber 23 and the fluid path 74*c* as shown in FIG. 3. This prevents the fuel from being fed undesirably if the coil 62 is broken.

When the coil 62 is energized as shown in FIG. 4(*b*), the armature 64 is attracted upward against a spring pressure of the spring 67 so that the valve head 73*b* of the needle valve 73 is moved out of engagement with the valve seat 75 to establish the fluid communication between the pressure chamber 23 and the fluid path 74*c*. The upward movement ($l_1$) of the needle valve 73 is determined by the distance between a shoulder portion 73*c* and a shim 68. The distance ($l_2$) between the armature 64 and the stator 65 is the sum of $l_1$+0.05 when the solenoid valve 6 is closed, while it is 0.05 when the solenoid valve 6 is opened.

When the solenoid valve 6 is opened, it will cause the volume of the spring chamber 66 to be reduced by the upward movement of the armature 64. It is, thus, necessary to have the fuel within the spring chamber 66 escape to the outside. For this, fluid paths 77 and 69 are formed in the valve body 71 and the shim 68 which extend vertically therethrough to establish fluid communication between the spring chamber 66 and the fluid path 74*c* below the needle valve 73 through a clearance, as shown in FIG. 3, between the lower surface of the valve body 71 and the upper surface of the check vale 4. The upper end of the needle valve 73 has, as shown in FIG. 4(*c*), a rectangular cross section to form clearances between itself and the armature 64 which establish fluid communication between the spring chamber 66 and the fluid path 69 of the shim 68. Therefore, the spring chamber 66 becomes equal in pressure to the fluid path 74*c* even when the pressure within the fluid path 74*c* rises upon energization or opening of the solenoid valve 6 so that no hydraulic pressure acts on the needle valve 73, thereby avoiding a malfunction of the needle valve 73.

Figure 5A:
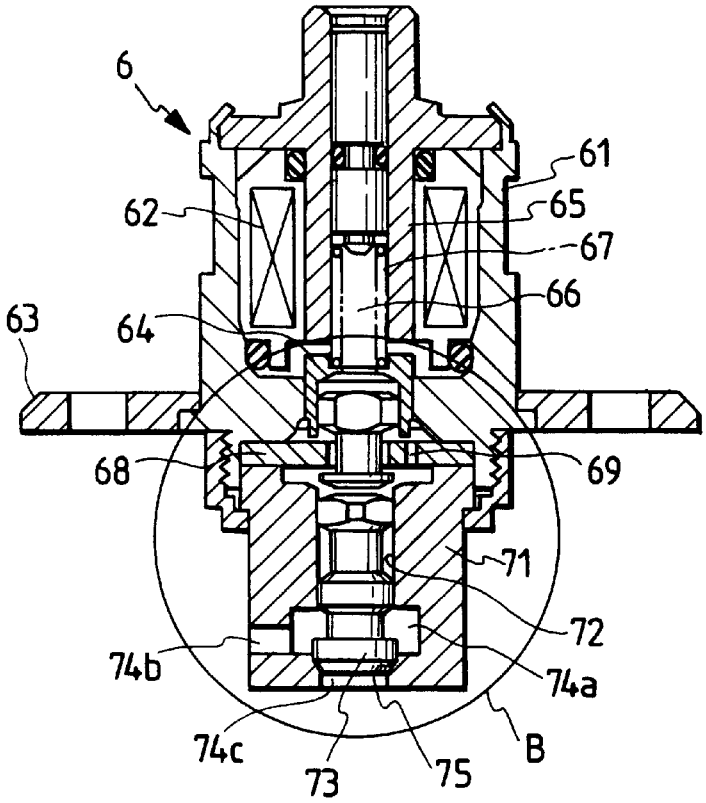
FIG. 5(*a*) is a vertical cross sectional view which shows a modification of a solenoid valve.
Figure 5B:
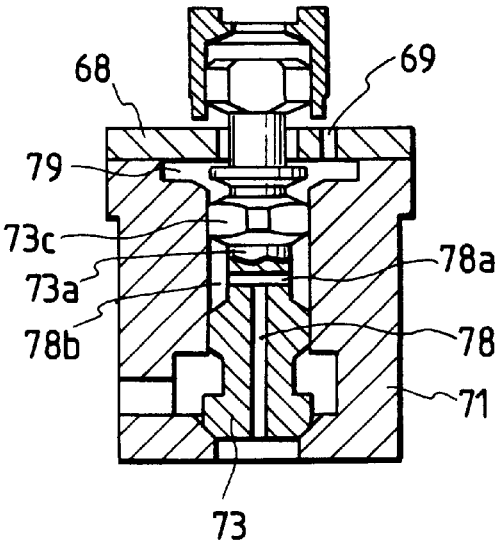

Instead of the fluid path 77, a fluid path 78, as shown in FIGS. 5(*a*) and 5(*b*) may be formed in the needle valve 73 longitudinally to establish the fluid communication between the spring chamber 66 and the fluid path 74*c*. Specifically, the cylindrical body 73*a* of the needle valve 73 has, a shown in FIG. 5(*b*), a small-diameter portion to define an annular chamber 78*b* between itself and the inner wall of the valve body 71. The fluid path 78 communicates with the annular chamber 78*b* through a horizontally extending path 78*a*. The annular chamber 78*b* communicates with a chamber 79 defined below the shim 68 through a polygonal portion 73*c* of the cylindrical body 73*a* of the needle valve 73.

Figure 2:
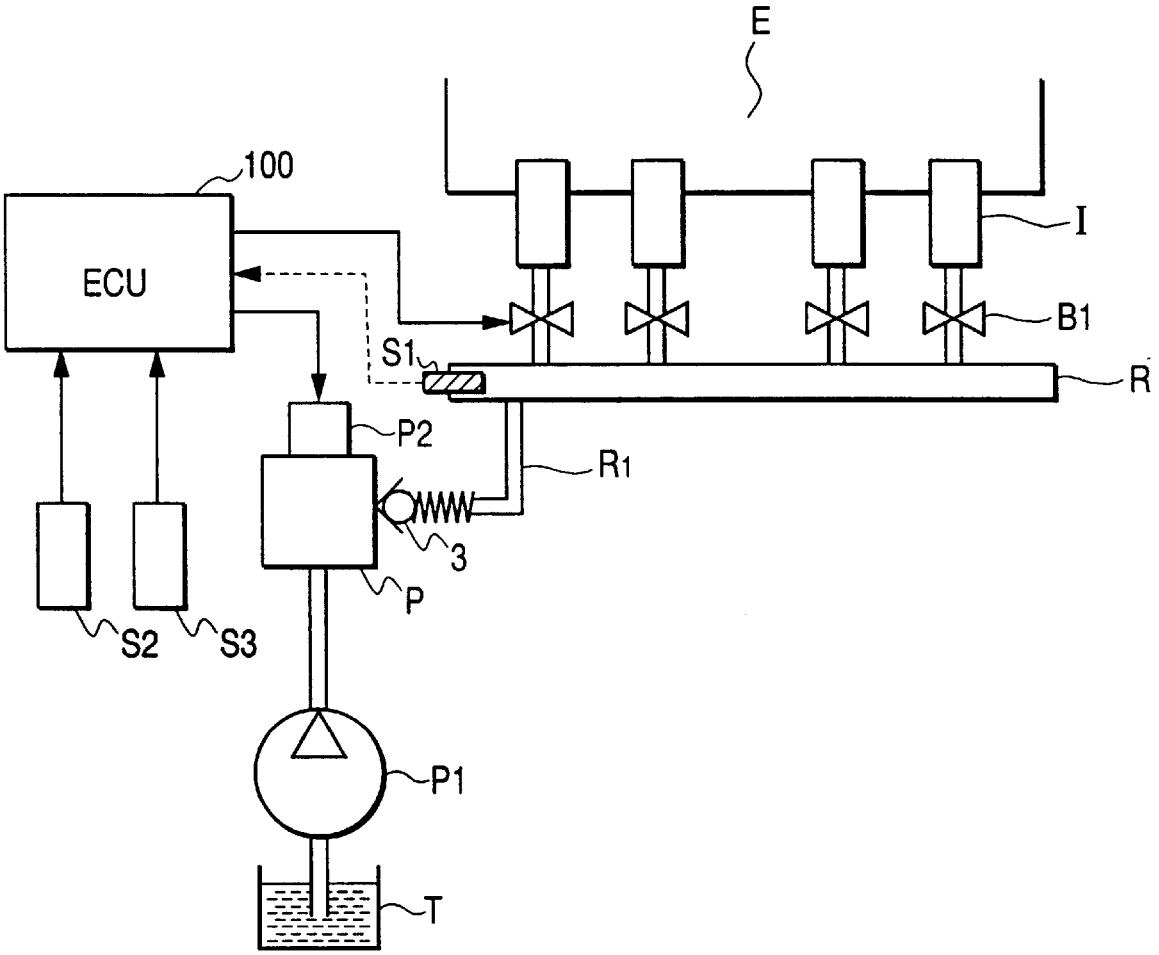
FIG. 2 is a block diagram which shows a fuel injection system for a diesel engine using a high-pressure pump according to the first embodiment of the invention.
Figure 6A:
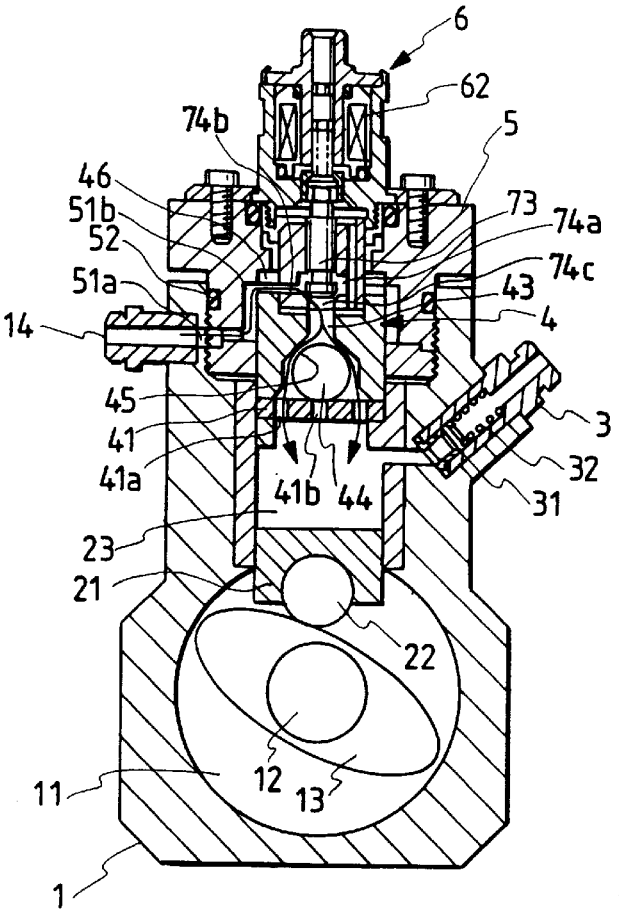
FIG. 6(*a*) is a vertical cross sectional view which shows a high-pressure pump during a fuel suction operation.
Figure 6B:
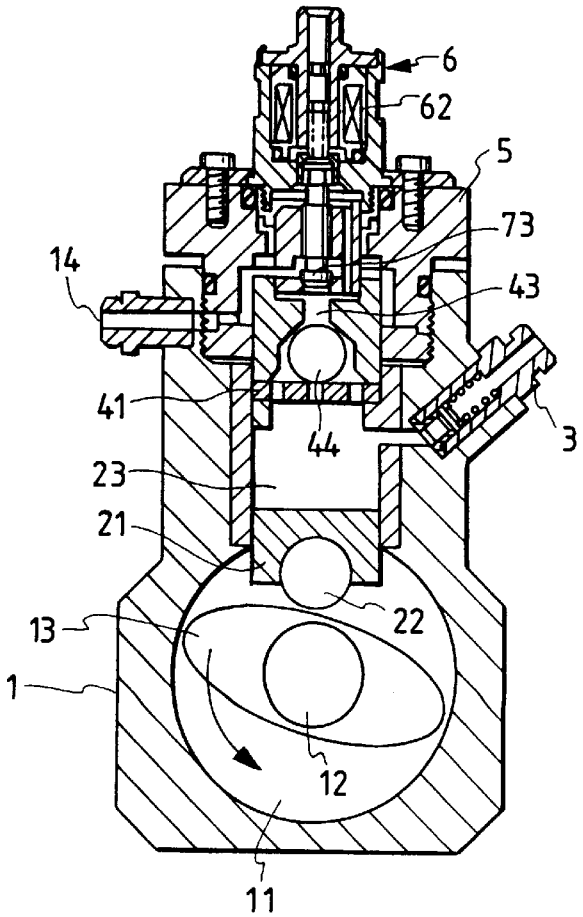

FIGS. 6(*a*) and 6(*b*) show a fuel suction operation of the high-pressure pump P. The fuel suction operation starts after completion of a fuel pressure/discharge operation, that is, upon energization of the flow rate control solenoid valve 6 after the plunger 21 is moved upward by the rotation of the cam shaft 12 and reaches the upper limit. When the needle valve 73 is opened by the energization of the flow rate control solenoid valve 6, it will cause low-pressure fuel from the feed pump P1, as shown in FIG. 2, to flow into the fluid path 43 in the check valve 4 through the inlet pipe 14, the fuel sump 51*a*, the feed path 52, the fuel sump 51*b*, and the fluid paths 46, 74*b*, 74*a*, and 74*c*. The check valve 4 is, as shown in the drawings, opened normally so that the fuel entering the fluid path 43 flows into the pressure chamber 23 through the clearance between the valve head 44 and the valve seat 45 and the holes 41*a* of the stopper 41 and urges the plunger 21 downward. During this fuel suction stroke, the cam roller 22 engages the cam 13.

When the flow rate control solenoid valve 6 is deenergized in response to a control signal from the ECU 100, the needle valve 73 is, as shown in FIG. 6(*b*), brought into the closed position to block the fluid communication between the pressure chamber 23 and the inlet pipe 14. Upon completion of the fuel suction operation, the plunger 21 is held from being moved downward, thereby causing the cam 13 to be moved out of engagement with the cam roller 22.

Figure 7A:
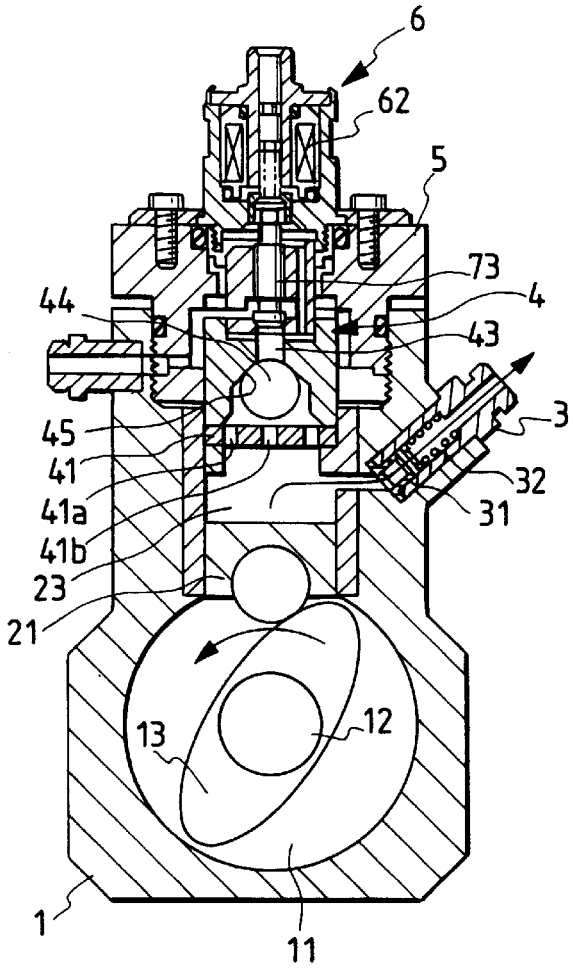
FIG. 7(*a*) is a vertical cross sectional view which shows a high-pressure pump during a fuel pressure/discharge operation.
Figure 7B:
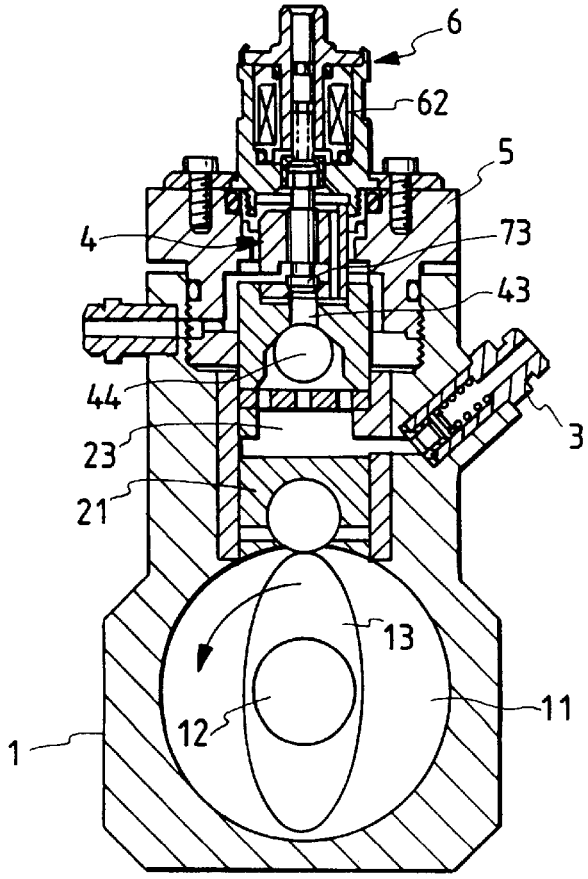

FIGS. 7(*a*) and 7(*b*) show a fuel pressure/discharge operation of the high-pressure pump P following the fuel suction operation as discussed above. In the fuel pressure/discharge operation, the plunger 21 is moved upward according to the rotation of the cam 13, and at the same time, the valve head 44 of the check valve 4 is lifted up by the pressure exerted by the back flow of fuel from the holes 41*a* and 41*b* of the stopper 41 so that it is seated on the valve seat 45 to close the fluid path 43. This causes the fuel within the pressure chamber 23 to be increased in pressure according to the upward movement of the plunger 21. When the fuel pressure within the pressure chamber 23 exceeds a given level, it lifts the valve head 31 of the delivery valve 3 upward against the spring pressure of the return spring 32, thereby feeding the pressurized fuel within the pressure chamber 23 to the common rail R from the outlet path 33.

When all the pressurized fuel within the pressure chamber 23 is discharged from the delivery valve 3, the fuel pressure/discharge operation terminates. The delivery valve 3 is closed by the return spring 32 as shown in FIG. 7(*b*). During the fuel pressure/discharge operation, the pressure within the pressure chamber 23 acts on the valve head 44 of the check valve 4 to close it at all the time.

In the above pump structure, the amount of fuel sucked into the pressure chamber 23 is controlled by the flow rate control solenoid valve 6. The check valve 4 is installed in a line leading to the pressure chamber 23 to pressurize all the fuel entering the pressure chamber 23 for feeding it to the common rail R. Specifically, the adjustment of the amount of fuel sucked into the pressure chamber 23 and the opening and closing of the line leading to the pressure chamber 23 are achieved by different valves. This eliminates the need for a fluid path to be opened after a plunger is lifted upward as in the conventional pre-stroke control and alleviates the problem encountered in the conventional pump structure that a valve is closed by itself even if a solenoid valve is not energized. The high-pressure does not act on the flow rate control solenoid valve 6, thereby allowing the spring pressure of the return spring 67 to be decreased, resulting in a decreased size of the coil 62.

The valve head 44 of the check valve 4 is made of a ball, but may alternatively be of any other shape such as cone or semicircle as long as it can close the fluid path 43. The valve head 44 of the check valve 4 is opened by its own weight, but may be designed to be closed by its own weight so that the valve head 44 can be opened only when the fuel is sucked into the pressure chamber 23. This structure has the advantages that the check valve 4 is kept opened without failure from the start of the fuel pressure/discharge operation to the end thereof.

FIGS. 8 to 11(*b*) show the high-pressure pump P according to the second embodiment of the invention.

The high-pressure pump P contains the feed pump P1, as shown in FIG. 2, and pressurizes fuel sucked by the feed pump P1 out of the fuel tank T to supply it to a common rail R. An ECU 100 is responsive to a sensor signal from a pressure sensor S1 indicating the fuel pressure within the common rail R to provide a control signal to a discharge control unit P2 so as to maintain the fuel pressure within the common rail R at a preselected level. The ECU 100 also receives sensor signals from an engine speed sensor S2, a TDC sensor S4, a throttle sensor S5, and a temperature sensor S6. The engine speed sensor S2 monitors NE pulses, as will be discussed later in FIG. 12(*a*), through a coupling K connected to a cam shaft. The TDC sensor S4 detects a top dead center (TDC) of pistons of the engine E. The throttle sensor S5 detects the opening degree of a throttle valve. The temperature sensor S6 monitors the temperature of coolant for the engine E. The ECU 100 determines an engine operating conditions using such information to provide control signals to fuel injection control solenoid valves B1 each connected to one of injectors I.

Figure 9:
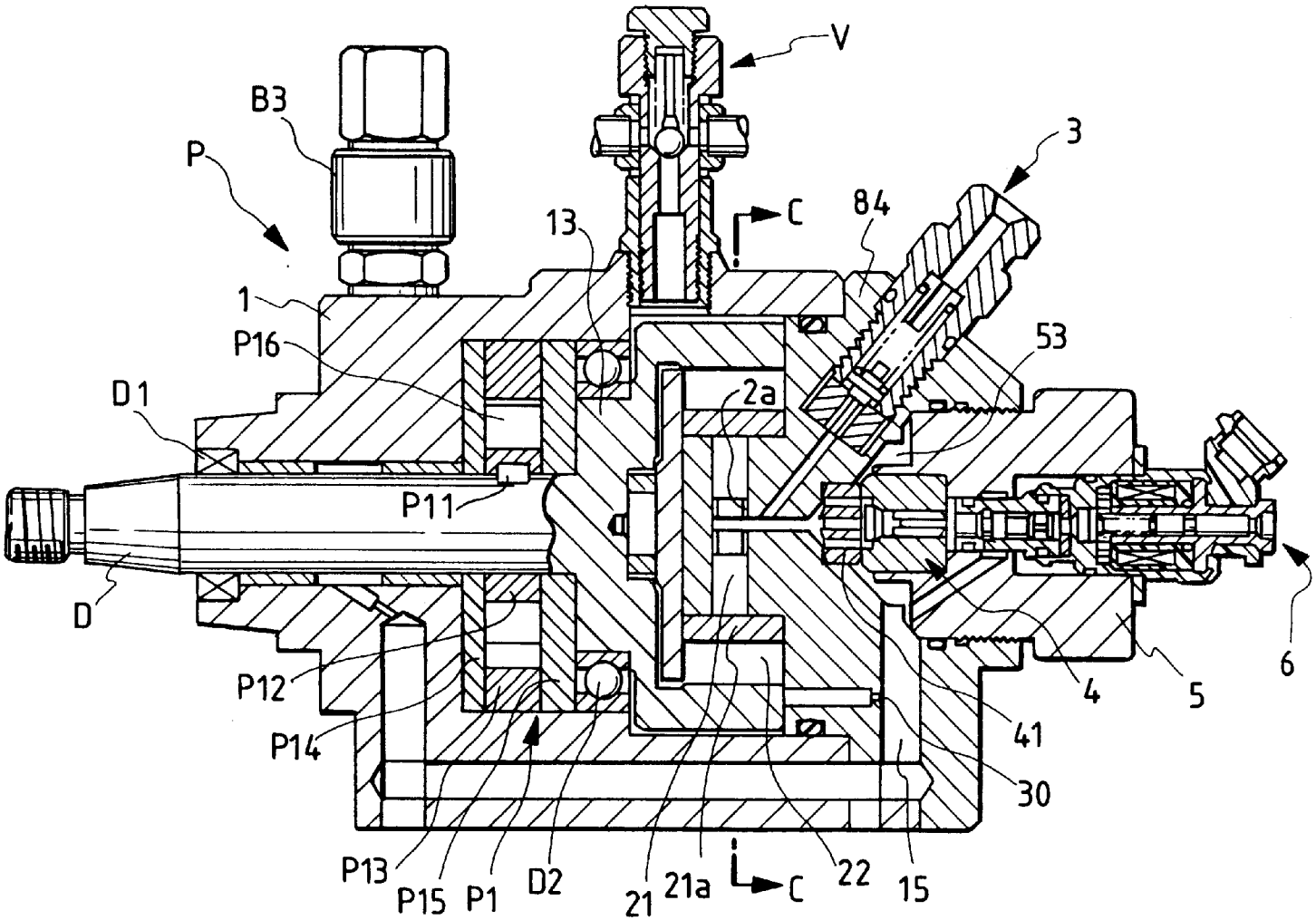
FIG. 9 is a vertical cross sectional view which shows the high-pressure pump in FIG. 8.
Figure 10:
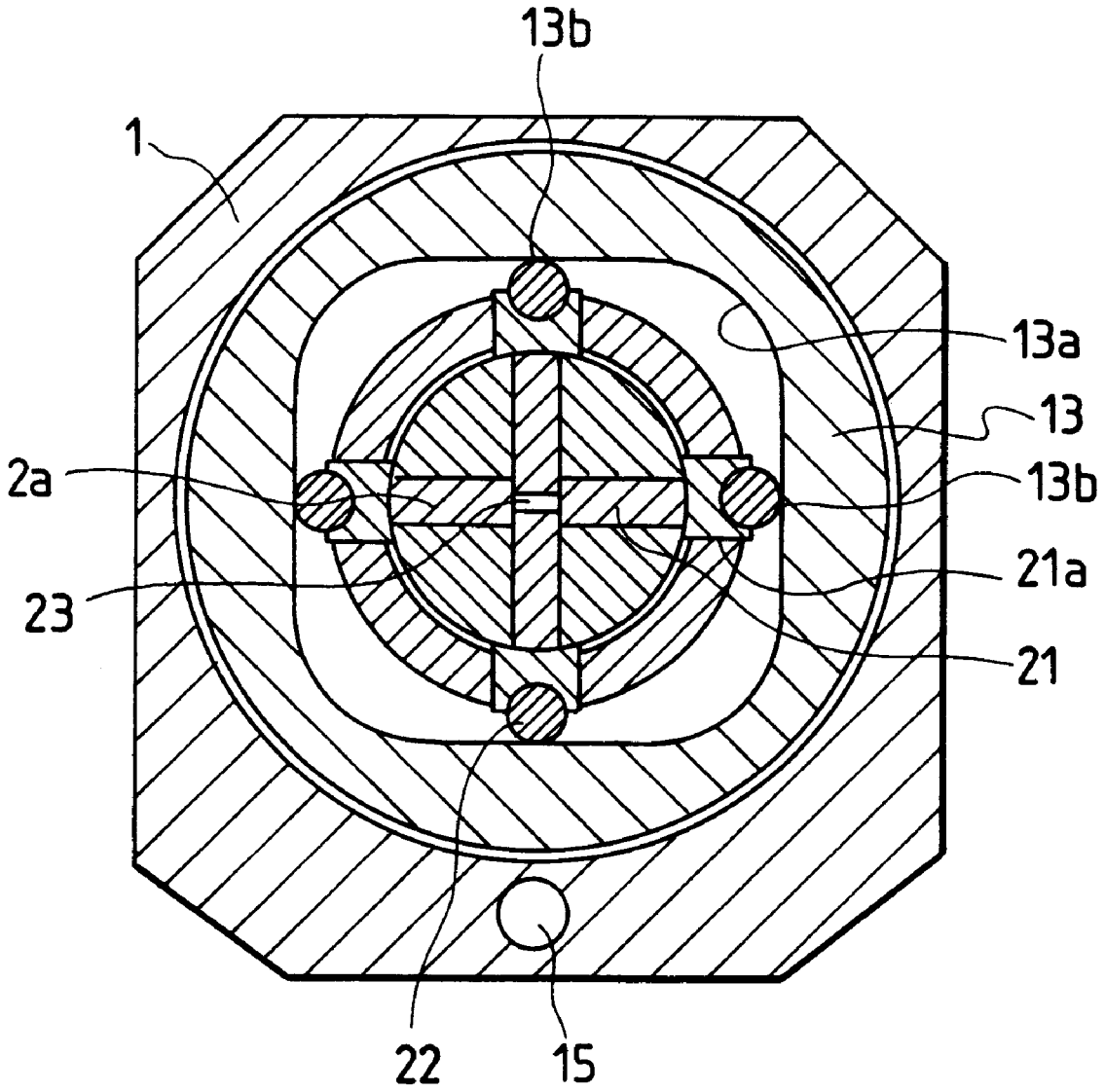
FIG. 10 is a cross sectional view which shows a cam structure taken along the line C—C in FIG. 9.

The high-pressure pump P, as shown in FIGS. 9 and 10, includes a pump housing 1 in which a drive shaft D is supported rotatably through bearings D1 and D2. To the drive shaft D, a vane type feed pump P1 (i.e., low-pressure pump) is connected which pumps the fuel out of the fuel tank T to supply it to a feed path 15. A cam 13 is formed integrally on an end of the drive shaft D and rotates at the speed of ½ times the engine speed. The rotation of the cam 13 causes a rotor P12 of the feed pump P1 to rotate through a woodruff plate P11 to suck through an inlet valve B3 the fuel from the fuel tank T into a chamber within the feed pump P1 defined by the rotor P12, a casing 13, and covers P14 and P15. The fuel sucked into the feed pump P1 is fed to the feed path 15 through a line not shown by a vane P16 installed on the rotor P12 according to the rotation of the rotor P12.

The fuel within the feed path 15 is, as will be discussed later in detail, not only fed to the common rail R, but also flows into the pump P through an orifice 30 for lubricating interior parts of the pump P. After lubrication, the fuel is discharged from a valve V and returned to the fuel tank T. The valve V also serves to keep the internal pressure of the pump P substantially at the atmospheric pressure.

A pump head 84 is installed in an end portion of the pump housing 1. The pump head 84 has formed on the center of a side surface a protrusion inserted into the cam 13 in which a plurality of sliding grooves 2*a*, as shown in FIG. 10, are formed. Within the sliding grooves 2*a*, plungers 21 are disposed slidably. Each of the plungers 21 has disposed on its end a shoe 21 a retaining a cam roller 22 rotatably.

The cam 13, as clearly shown in FIG. 10, has formed therein an inner cam surface 13*a* having a substantially rectangular shape. The rotation of the cam 13 causes the cam rollers 22 to be moved or lifted in a radial direction of the cam 13 along the undulation of the cam surface 13*a* (generally referred to as a lift curve) to change the volume of a pressure chamber 23 defined by inner ends of the plungers 21 within the sliding grooves 2*a*, thereby sucking the fuel into the pressure chamber 23 and pressurizing the fuel sucked into the pressure chamber 23 cyclically. The centers 13*b* between adjacent two of comers of the cam surface 13*a* correspond to tops of a developed profile (i.e., the lift curve) of the cam surface 13*a*. When the cam rollers 22 engage the tops 13*b* of the cam surface 13*a*, as shown in FIG. 10, the plungers 23 reach an inner limit to minimize the volume of the pressure chamber 23.

Figure 8:
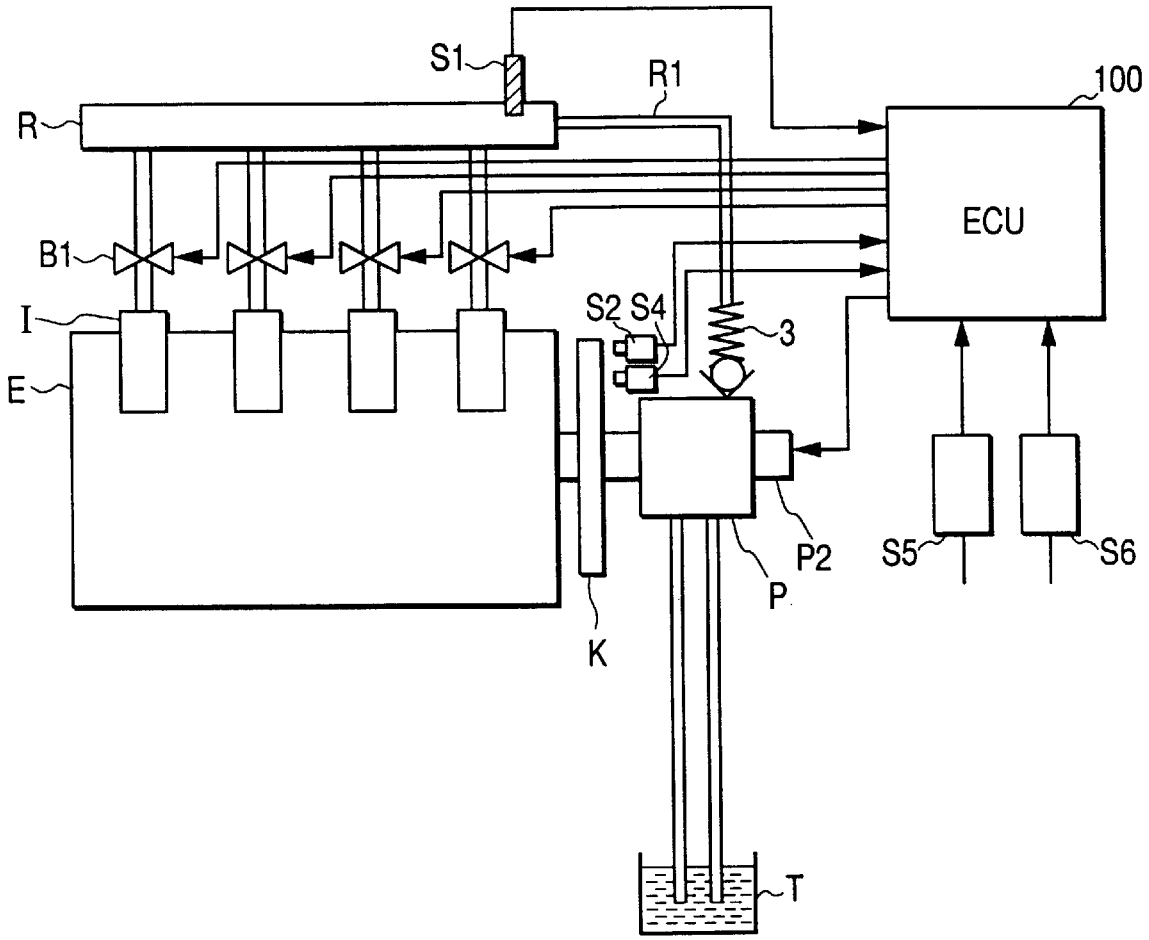
FIG. 8 is a block diagram which shows a fuel injection system for a diesel engine using a high-pressure pump according to the second embodiment of the invention.

A lock adapter 5 is, as shown in FIG. 9, screwed into an end of the pump head 84. A fuel sump 53 is formed between the lock adapter 5 and the pump housing 1. A flow rate control solenoid valve 6 is installed in the lock adapter 5 to control the flow rate of fuel sucked into the pressure chamber 23. Specifically, when the solenoid valve 6 is opened, the fuel flows, as clearly shown in FIG. 11(*a*), from the feed path 15 into the pressure chamber 23 through the fuel sump 53, a fluid path 54 formed in the lock adapter 5, a valve seat 75 of the solenoid valve 6, a valve seat 45 of a check valve 4, a fluid path 41*c* of a stopper 41, and a fluid path 23*a* formed in the pump head 84. The solenoid valve 6 and the check valve 4 constitute the discharge control unit P2 as shown in FIG. 8.

Figure 11A:
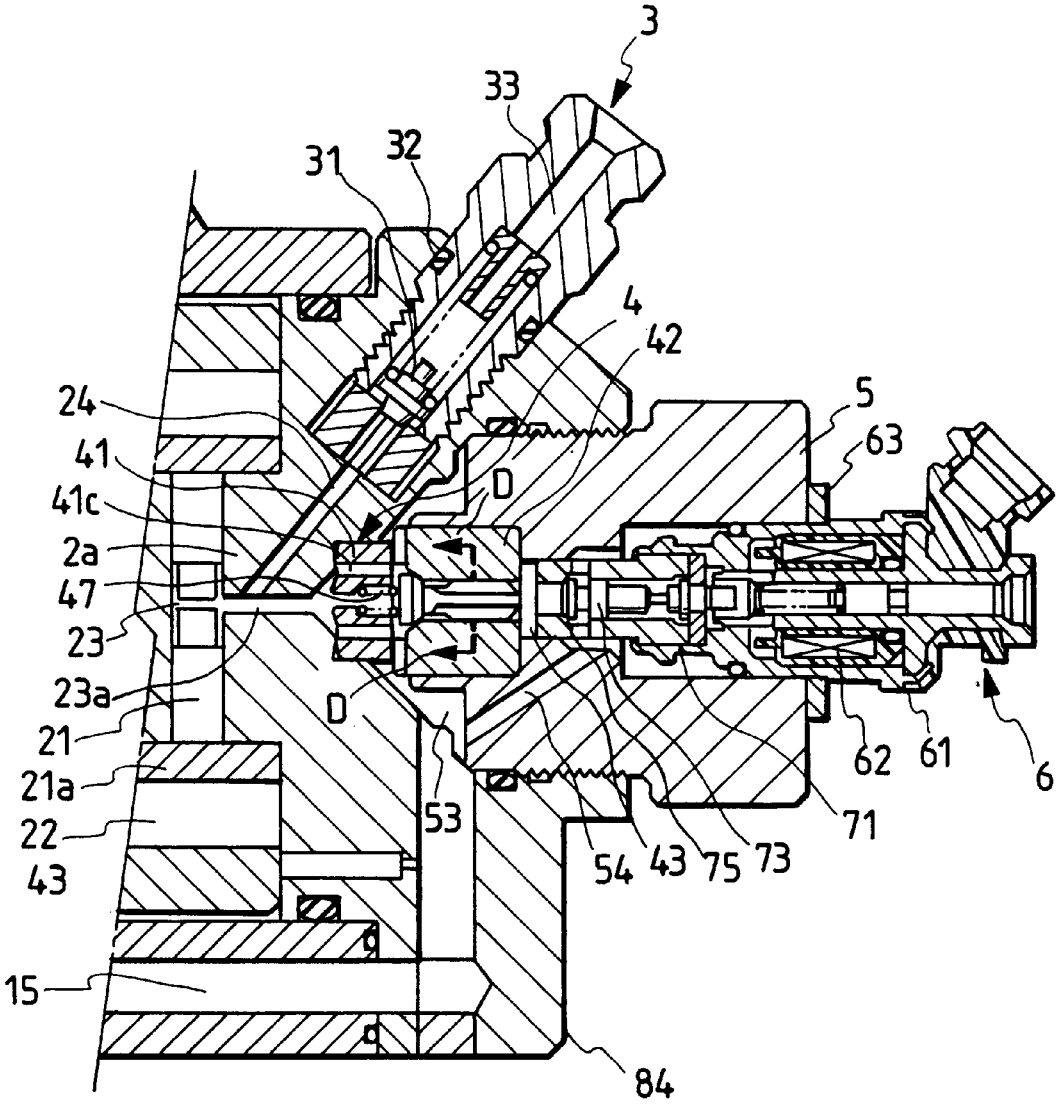
FIG. 11(*a*) is a partially cross sectional view which shows the high-pressure pump in FIG. 9.
Figure 11B:
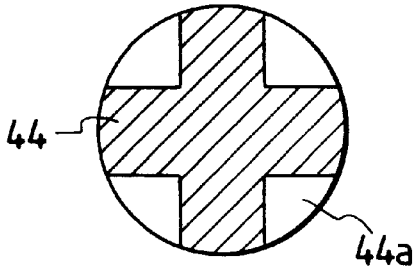

The check valve 4 includes a housing 42 and a needle valve 44. The housing 42 has formed therein a fluid path 43 which is opened and closed by the needle valve 44. The fluid path 43 extends horizontally, as viewed in FIG. 11(*a*), and leads to a conical valve seat 45. The needle valve 44 is urged by a spring 47 retained in the stopper 41 into constant engagement with the valve seat 45. Specifically, the check valve 4 is normally closed and is responsive to the fuel flow when the solenoid valve 6 is opened. The needle valve 44 has, as shown in FIG. 11(*b*), formed in its periphery grooves 44*a* through which the fuel passes.

The structures and operations of the solenoid valve 6 and the delivery valve 3 are the same as those in the above first embodiment. The same reference numbers as employed in the first embodiment refer to the same parts, and explanation thereof in detail will be omitted here.

The high-pressure pump P performs four fuel suction and feed operations every rotation of the cam 13. The amount of fuel discharged from the high-pressure pump P is controlled by adjusting the amount of fuel entering the pressure chamber 23, that is, the degree to which the solenoid valve 6 is opened or the length of time the solenoid valve 6 is opened. During a time when the solenoid valve 6 is opened, the check valve 4 is opened by the feed pressure of fuel, and the plungers 21 are moved outward in a radial direction to suck the fuel into the pressure chamber 23. The fuel sucked into the pressure chamber 23 is pressurized by inward movement of the plungers 21 and then fed to the common rail R through the delivery valve 3.

The control of the high-pressure pump P will be discussed below with reference to FIGS. 12(*a*) to 12(*g*).

Figures 12A, 12B, 12C, 12D, 12E, 12F, 12G:
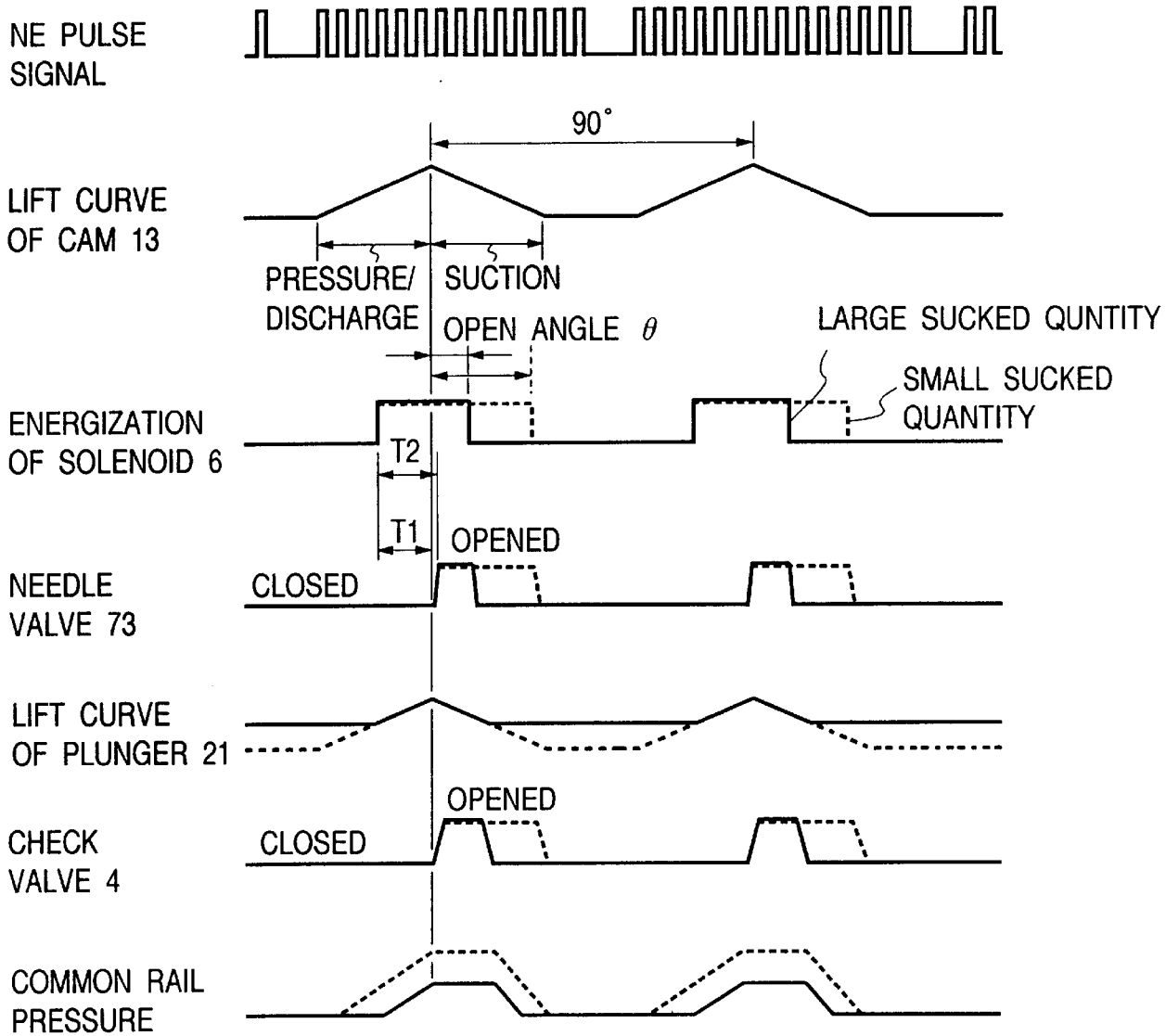
FIG. 12(*a*) is a time chart which shows NE pulse signals indicating the engine speed.

The engine speed sensor S2 detects NE pulse signals, as shown in FIG. 12(*a*), through the coupling K connected to the cam shaft 13 of the pump P. The location of lack of the pulse signal has a given angular relation to the tops 13*b* of the cam surface 13*a*. The ECU 100 monitors the angle (or time) from the lack of the pulse signal to determine the time when the solenoid valve 6 is to be turned on.

Usually, given period of times T1 and T2 are consumed between energization of the solenoid valve 6 and times when the needle valve 73 of the solenoid valve 6 starts to move to an open position and when the needle valve 73 reaches the open position. The time lags T1 and T2 are determined in advance or monitored at all times using, for example, a lift sensor, and the time when the solenoid valve 6 is turned on is adjusted according to the speed of the cam 13 so that the time when the solenoid valve 6 is opened actually may agree with the time when the cam rollers 22 reach the tops 13*b* of the cam surface 13*a*.

With the above arrangements, the fuel is sucked immediately when the fuel suction operation of the high-pressure pump P starts. Specifically, the plungers 21 are moved outward through an angle θ corresponding to the difference between the energization duration of the solenoid valve 6 and the time lag T1 until the solenoid valve 6 starts to be opened to suck the fuel into the pressure chamber 23. The fuel within the pressure chamber 23 is pressurized by the inward movement of the plungers 21 in a following fuel pressure/discharge operation and then discharged to the common rail R. During the fuel pressure/discharge operation, the fuel pressure acts on the check valve 4 to close the needle valve 44 so that the amount of fuel sucked into the high-pressure pump P (i.e., the pressure chamber 23) is all discharged to the common rail R.

The amount of fuel sucked into the high-pressure pump P is controlled by the length of time (i.e., the energization duration) the solenoid valve 6 is energized. An increase in the energization duration will cause the sucked amount of fuel to be increased. Broken lines in FIGS. 12(*c*) to 12(*g*) show parameters when the plungers 21 are moved outward up to the outer limit to suck a maximum amount of fuel into the pressure chamber 23 and delivery it to the common rail R. Solid lines show parameters when the plungers 21 are moved to positions determined by a desired amount of fuel to be sucked. When it is required to suck a small amount of fuel into the pump P, the cam rollers 22 slide along the cam surface 13*a* when the plungers 21 start to be moved outward, but they leave the cam surface 13*a* after the solenoid valve 6 is turned off because the plungers 21 are held from moving further.

Figure 13:
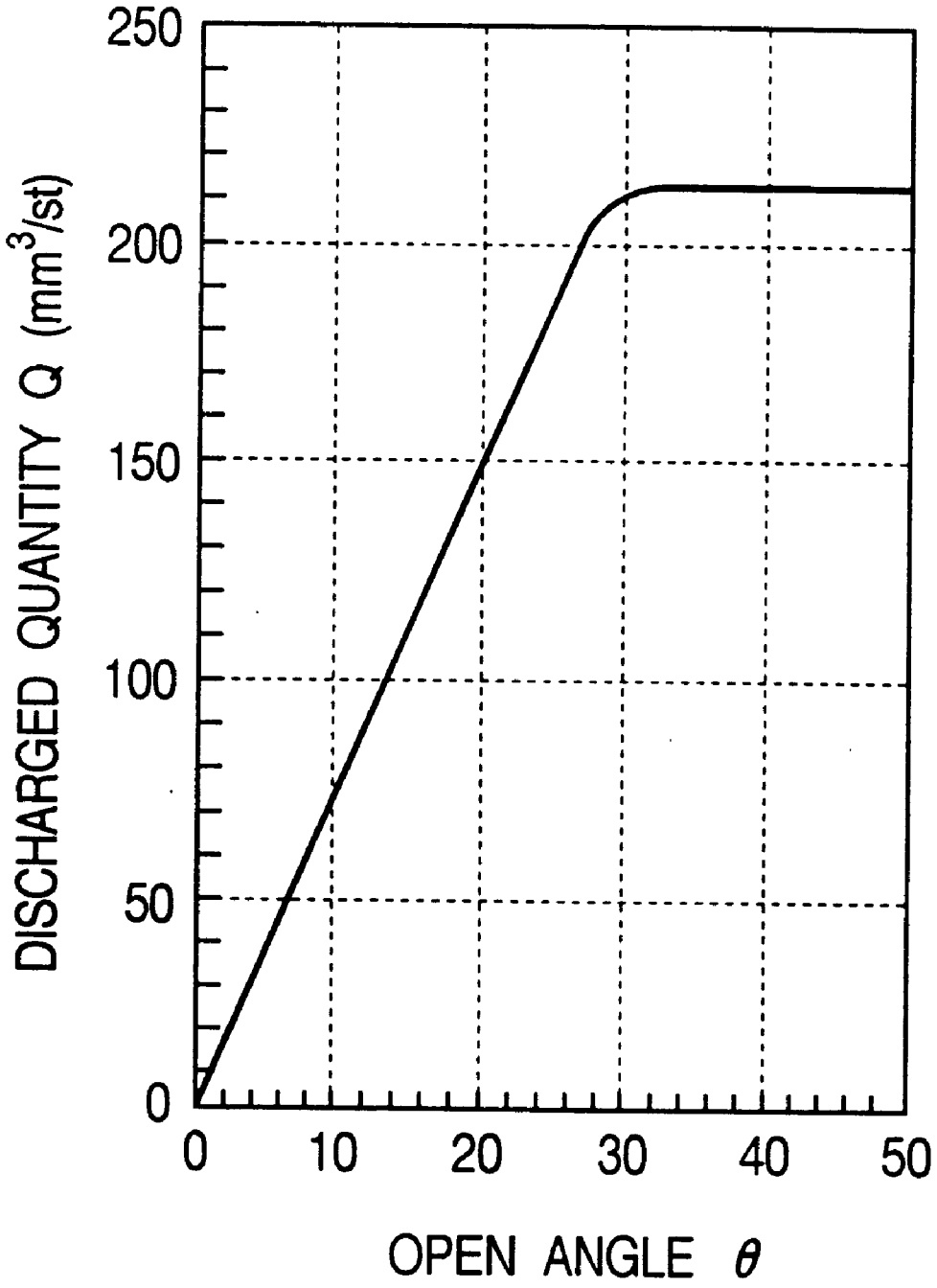
FIG. 13 is a graph which shows the relation between the quantity of fuel to be fed to a common rail and the open of a solenoid valve.

FIG. 13 shows the relation between the quantity of fuel discharged from the high-pressure pump P and the angle θ at which the solenoid valve 6 is opened and which corresponds to the difference between the energization duration of the solenoid valve 6 and the time lag T1. The graph shows that the quantity of fuel discharged from the high-pressure pump P is increased in proportion to an increase in angle θ.

Figures 14A, 14B, 14C, 14D, 14E, 14F:
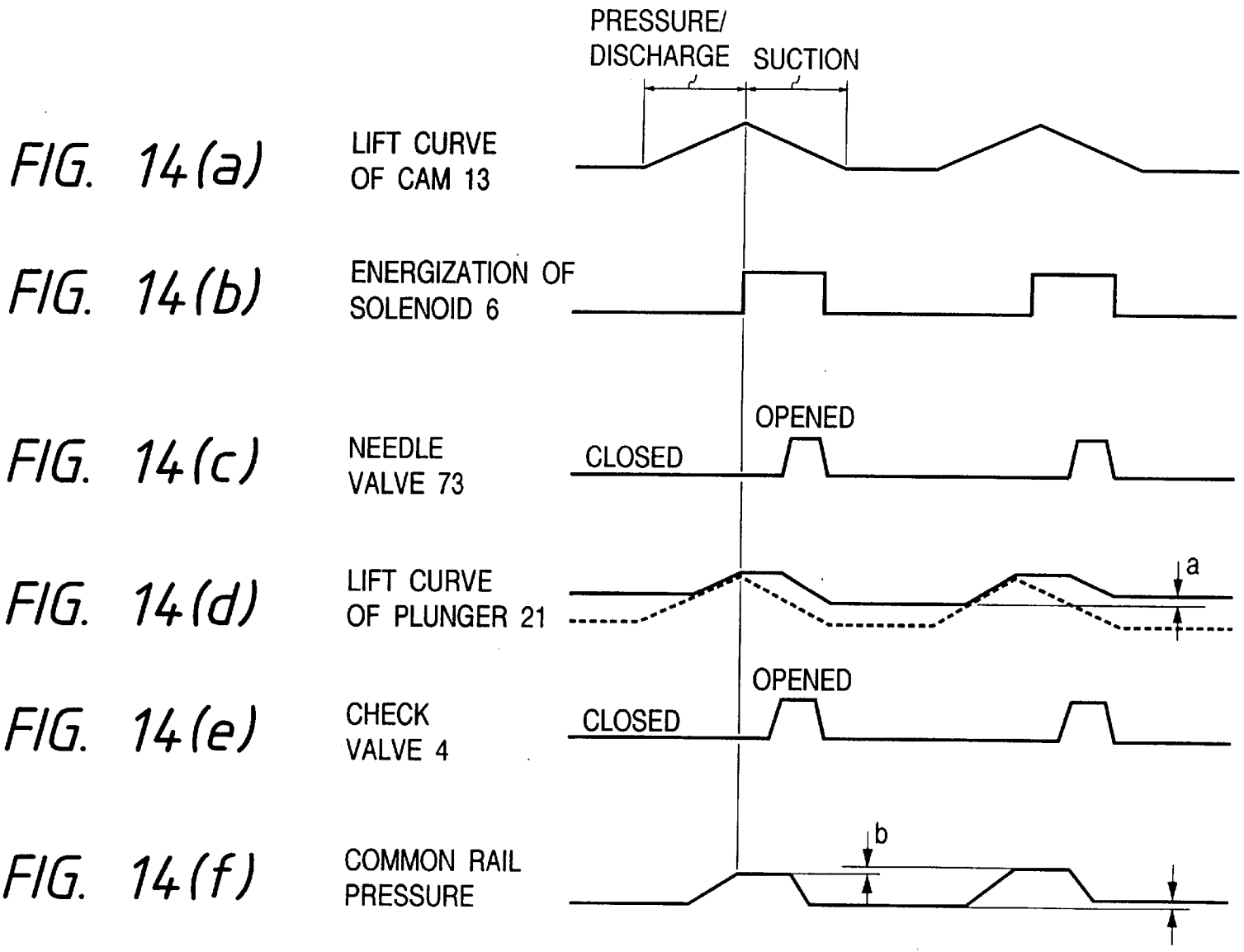
FIG. 14(*a*) is a time chart which shows a lift curve of a cam.

FIGS. 14(*a*) to 14(*f*) show pump operations and common rail pressure when the energization of the solenoid valve 6 is delayed. The curve shown in FIG. 14(*a*) is the lift curve of the cam surface 13*a* which corresponds to the distance between the cam surface 13*a* and the center of the cam as expressed as a curve.

For instance, the start time when the solenoid valve 6 is energized is adjusted to the tops 13*b* of the cam surface 13*a*, the needle valve 73 of the solenoid valve 6 is opened after the cam rollers 22 leave the tops 13*b* of the cam surface 13*a*. Thus, at the start of the fuel suction operation, that is, when the plungers 21 start to move outward, the cam rollers 22 are out of engagement with the cam surface 13*a*, and the feed pressure usually varies so that the outward movement of the plungers 21 varies each cycle, thereby causing the amount of fuel discharged from the pump P to be unstable, as shown by a in FIG. 14(*d*). The instability of the discharged amount of fuel will cause a variation in pressure within the common rail R to be increased, as shown by b in FIG. 14(*f*).

Figures 15A, 15B, 15C, 15D, 15E, 15F:
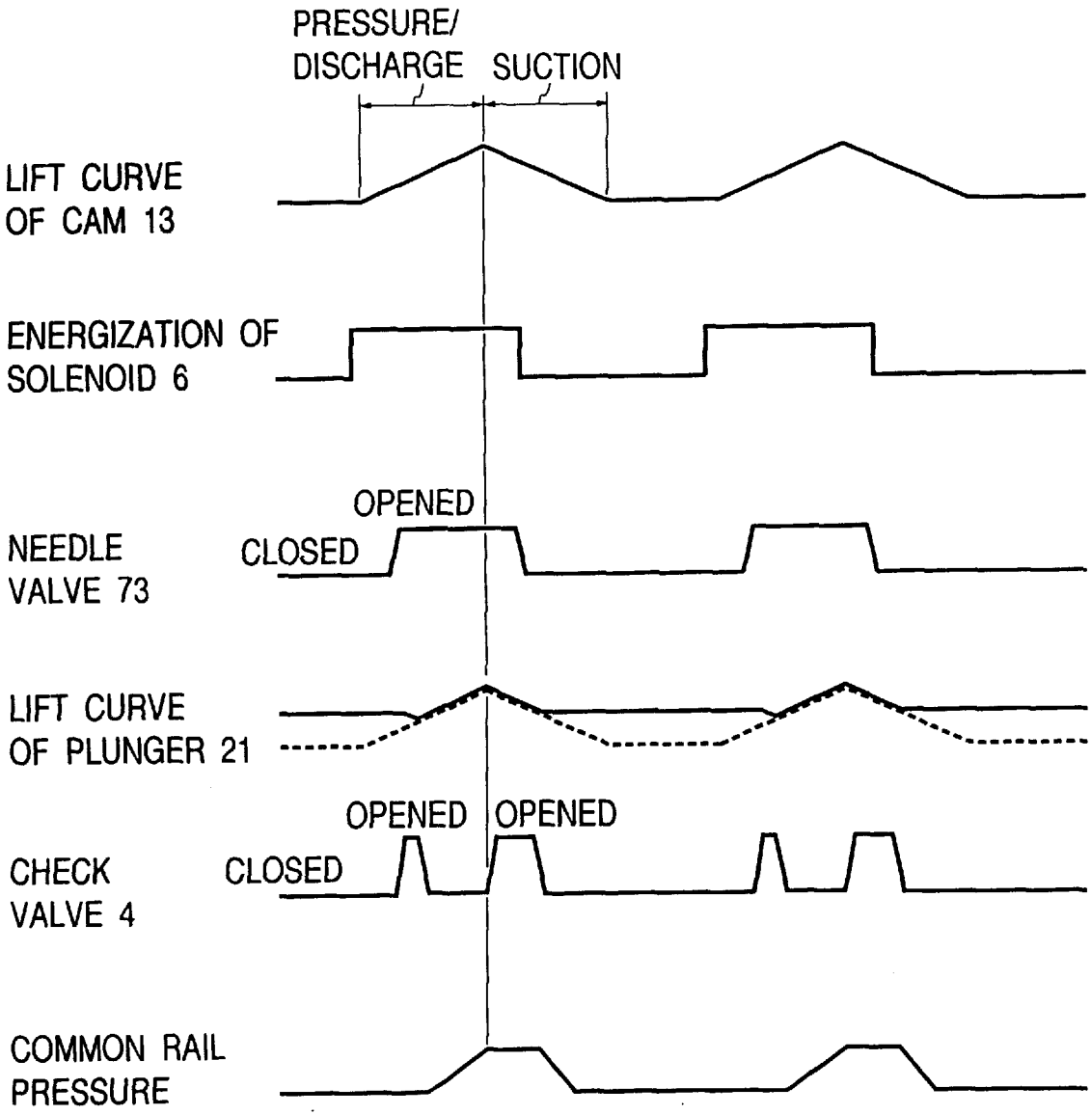
FIG. 15(*a*) is a time chart which shows a lift curve of a cam.

FIGS. 15(*a*) to 15(*f*) shows pump operations and common rail pressure when the energization of the solenoid valve 6 is advanced. Since when it is required for the high-pressure pump P to suck a small amount of fuel, the outward movement of the plungers 21 is small, the cam rollers 22 are kept away from the cam surface 13*a* until a following fuel suction operation is performed. If the energization of the solenoid valve 6 is too early, the needle valve 73 is opened during the first half of the fuel pressure/discharge operation so that the fuel opens the needle valve 44 of the check valve 4 and enters the pressure chamber 23 undesirably. This makes it difficult to control the amount of fuel to be discharged from the high-pressure pump P.

Accordingly, the improvement of controllability of the amount of fuel to be sucked or discharged is achieved by controlling the timing with which the solenoid valve 6 is energized so that the needle valve 73 may be opened, as shown in FIGS. 12(*b*) and 12(*d*), immediately after the cam rollers 22 pass the tops 13*b* of the cam surface 13*a* and so that the cam rollers 22 may move in constant engagement with the cam surface 13*a* during the fuel suction operation.

Figure 16:
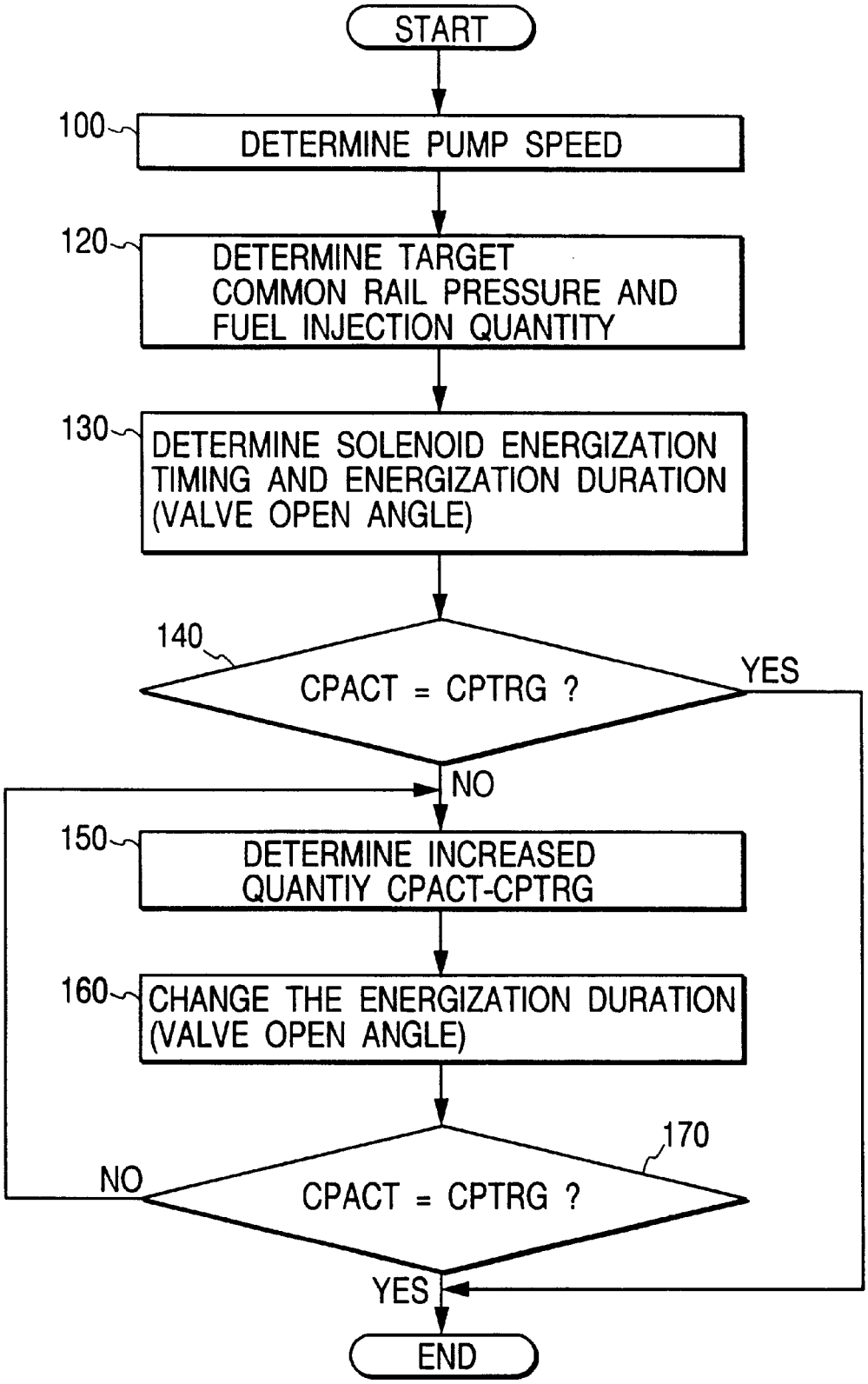
FIG. 16 is a flowchart of a program performed by an ECU 100 in FIG. 8.

FIG. 16 is a flowchart of a program or sequence of logical steps performed by the ECU 100 to control the high-pressure pump P.

After entering the program, the routine proceeds to step 100 wherein the pump speed is determined based on the NE pulse signals detected by the engine speed sensor S2. The routine then proceeds to step 120 wherein a target common rail pressure CPTRG and the amount of fuel to be injected to the engine E are determined based on the opening degree of the throttle valve detected by the throttle sensor S5 by look-up using a control map. The routine proceeds to step 130 wherein the start time when the solenoid valve 6 is energized and the energization duration of the solenoid valve 6 are determined based on the pump speed and a desired amount of fuel to be fed to the common rail R, and the solenoid valve 6 is turned on.

The routine proceeds to step 140 wherein it is determined whether a common rail pressure CPTRT monitored by the pressure sensor S1 is equal to the target common rail pressure CPTRG or not. If a YES answer is obtained, then the routine terminates. Alternatively, if a NO answer is obtained, then the routine proceeds to step 150 wherein a desired increase in amount of fuel to be fed to the common rail R is determined based on the difference between the common rail pressure CPTRT and the target common rail pressure CPTRG. The routine proceeds to step 160 wherein the energization duration of the solenoid valve 6 is determined which corresponds to the desired amount of fuel determined in step 150, and the solenoid valve 6 is turned on for the determined energization duration. The routine proceeds to step 170 wherein it is determined whether the common rail pressure CPTRT monitored by the pressure sensor S1 is equal to the target common rail pressure CPTRG or not. If a NO answer is obtained, then the routine returns back to step 150. Alternatively, if a YES answer is obtained, then the routine terminates.

The pump control program, as discussed above, may be used in the first embodiment.

Figure 17:
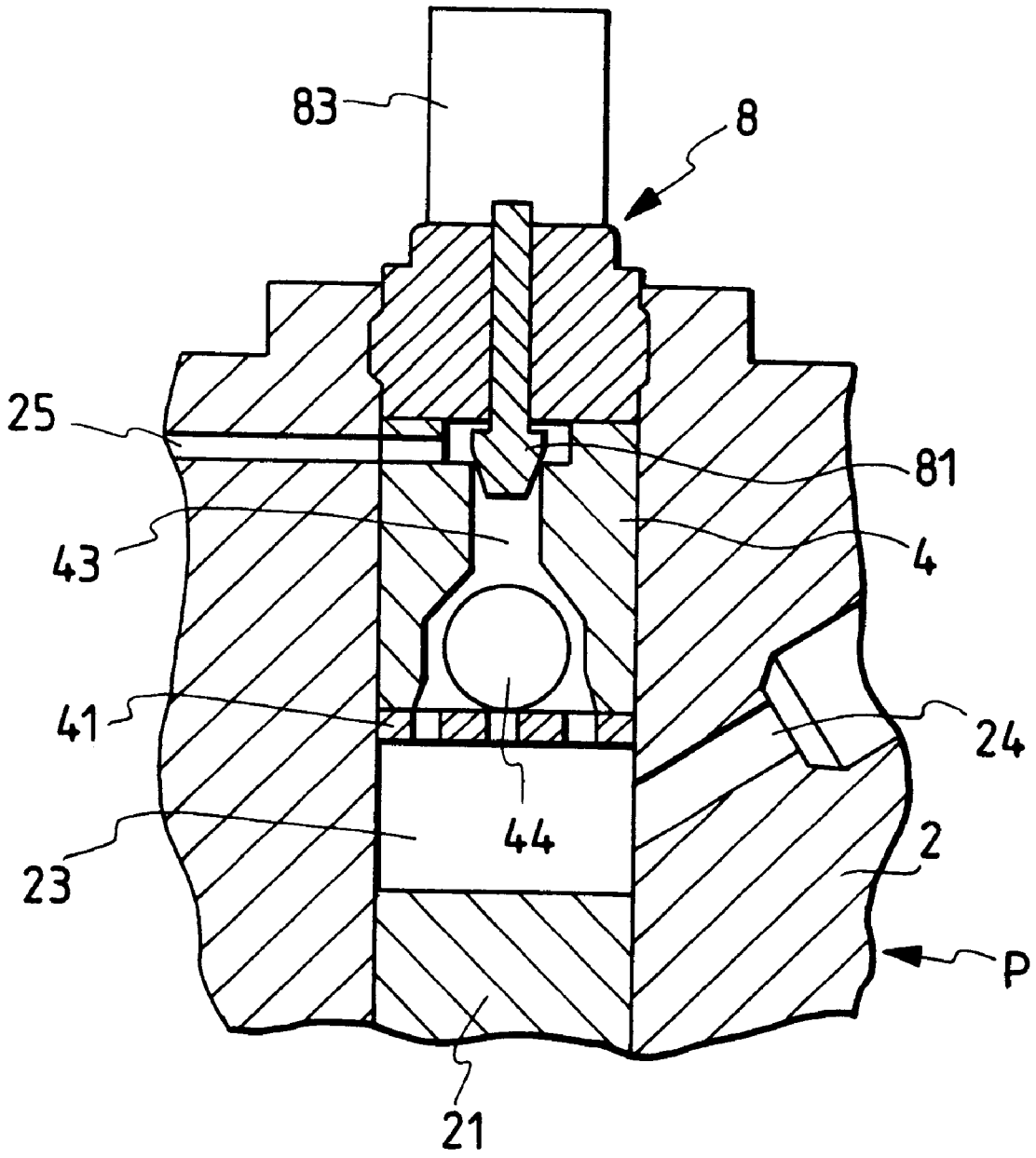
FIG. 17 is a partially cross sectional view which shows a pump structure according to the third embodiment of the invention.

FIG. 17 shows the high-pressure pump P according to the third embodiment of the invention which is a modification of the first embodiment and which uses a throttle valve 8 instead of the flow rate control solenoid valve 6. The same reference numbers as employed in the first embodiment refer to the same parts.

The throttle valve 8 includes a needle valve 81 having a conical valve head exposed to the fluid path 43 of the check valve 4. An opening area of the fluid path 43 exposed to the low-pressure fluid inlet path 25 is adjustable by displacing the needle valve 81 up and down through a lifting mechanism 83 to control the flow rate of fuel entering the pressure chamber 23 from the low-pressure fluid inlet path 25.

Figure 18:
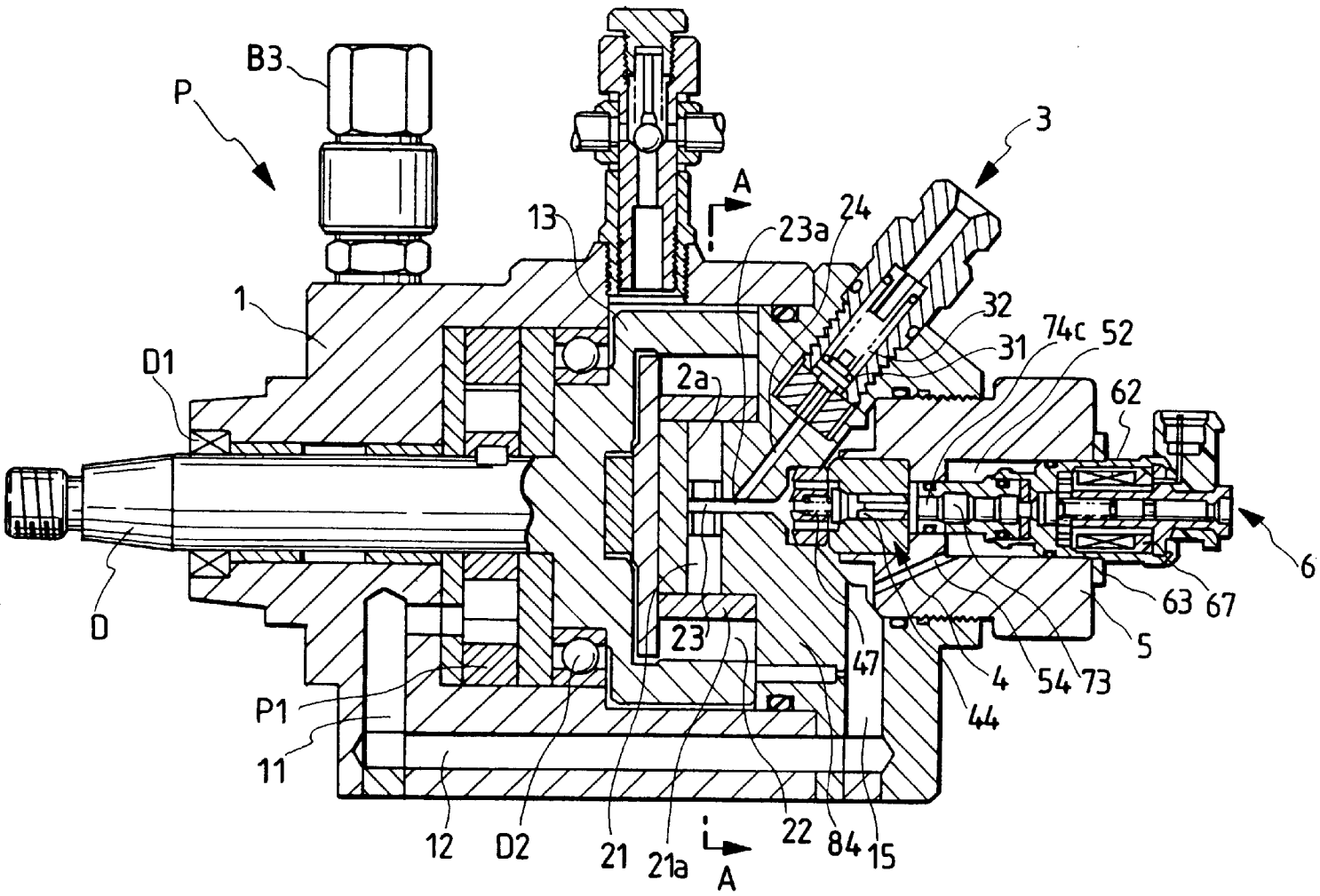
FIG. 18 is a vertical cross sectional view which shows a high-pressure pump according to the fourth embodiment of the invention.

FIG. 18 shows the high-pressure pump P according to the fourth embodiment of the invention which is a modification of the second embodiment, as shown in FIGS. 9, used with the fuel injection system, as shown in FIG. 2. The same reference numbers as employed in the above embodiments refer to the same parts, and explanation thereof in detail will be omitted here.

The high-pressure pump P contains the feed pump P1 shown in FIG. 2. The feed pump P1 rotates along with the drive shaft D to suck the fuel out of the fuel tank T through the inlet valve B3 to supply it to the fuel sump 52 under approximately 15 atm through the fluid paths 11, 12, 15, and 54. An inlet port and an outlet port of the feed pump P1 are connected to each other through a pressure control valve (not shown) for controlling the discharge pressure thereof.

Figure 19:
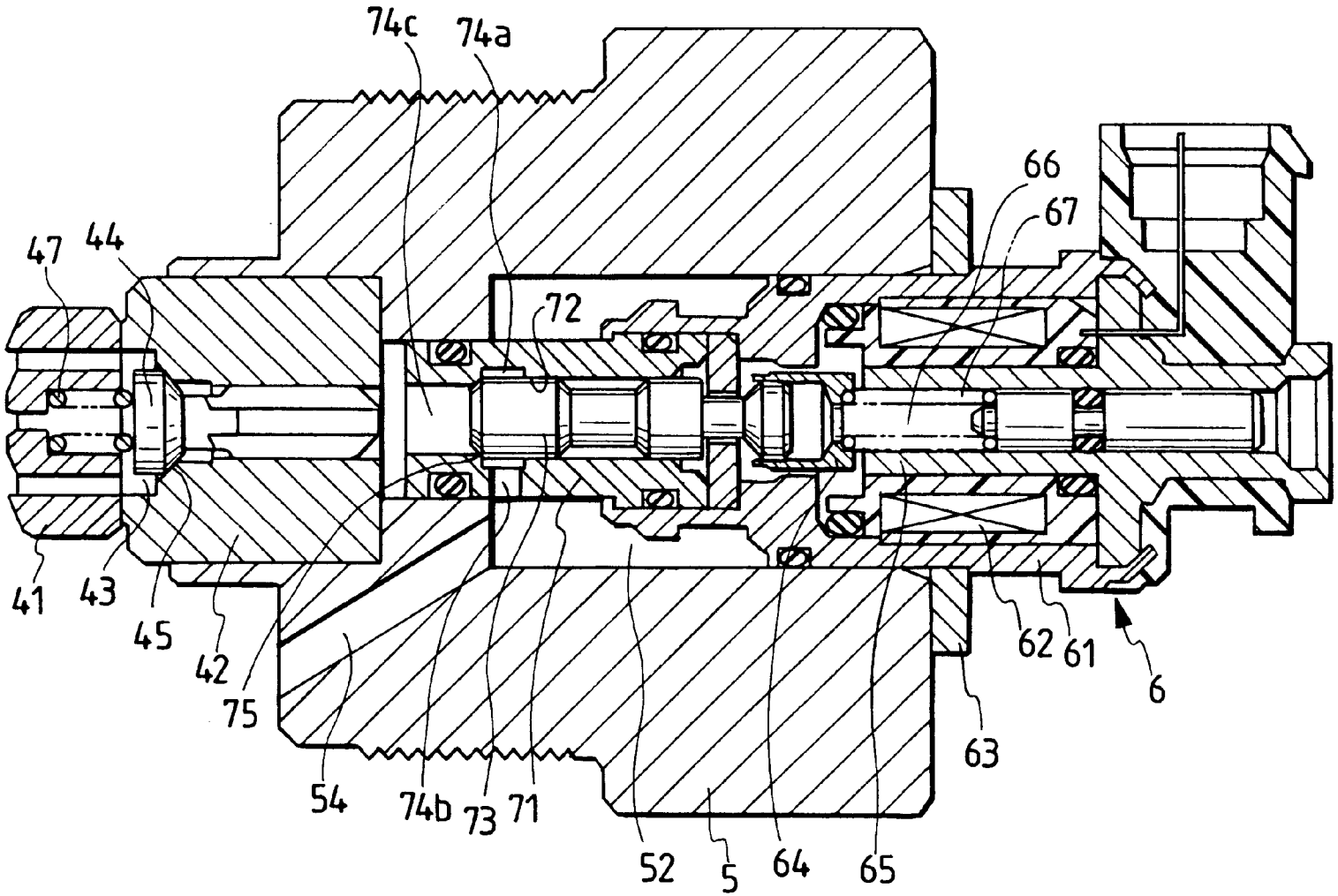
FIG. 19 is a partially enlarged view of FIG. 18.

The solenoid valve 6, as shown in FIG. 19, includes a housing 61, and a valve body 71 fitted into the bottom of the housing 61. The housing 61 has disposed therein a coil 62. The solenoid valve 6 is bolted to an upper surface of the lock adapter 5 through a flange 63 installed on the periphery of the housing 61. The valve body 71 has formed therein a cylindrical chamber 72 within which a needle valve 73 is slidably disposed. An annular path 74*a* is formed around the top of the needle valve 73 and communicates with a fuel sump 52 through a fluid path 74*b* and with a fluid path 43 of the check valve 4 through a fluid path 74*c*.

An armature 64 is press-fitted on the right end of the needle valve 73 in alignment with a stator 65 at a given air gap. The coil 62 is wound around the periphery of the stator 65. A spring 67 is disposed within a spring chamber 66 formed in the stator 65 to urge the armature 64 left, as viewed in the drawing.

A conical valve seat 75 is formed in an end of the fluid path 74*c* on which the needle valve 73 is seated when the coil 62 is deenergized to block fluid communication between the fluid paths 74*a* and 74*c*. When the coil is energized, it will produce the attraction force to attract the armature 64 so that the needle valve 73 leaves the valve seat 75 to establish the fluid communication between the fluid paths 74*a* and 74*c*.

Figure 20A:
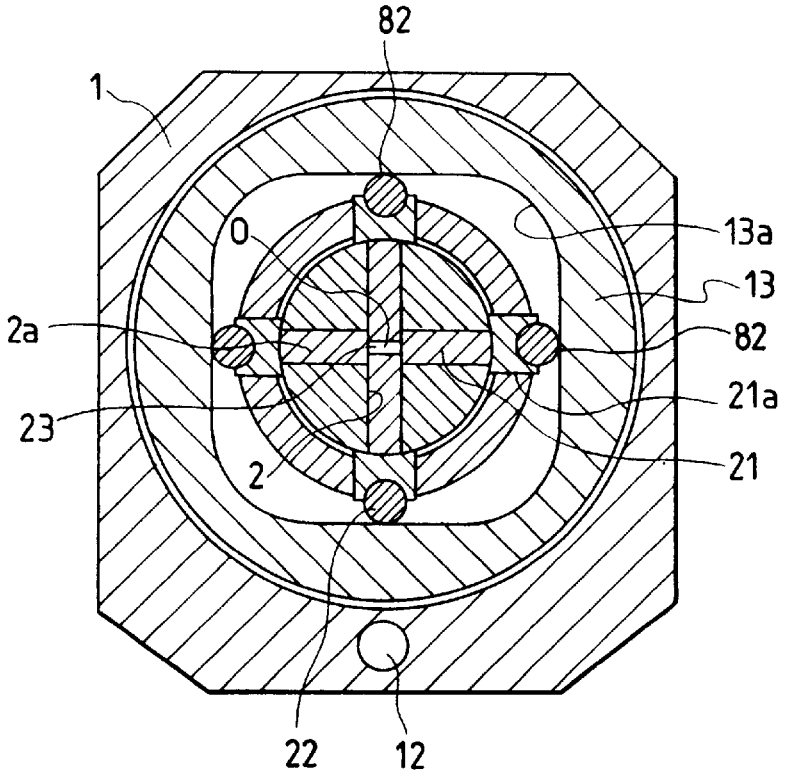
FIG. 20(*a*) is a cross sectional view taken along the line A—A in FIG. 18 which shows a cam when plungers lie at the innermost position.
Figure 20B:
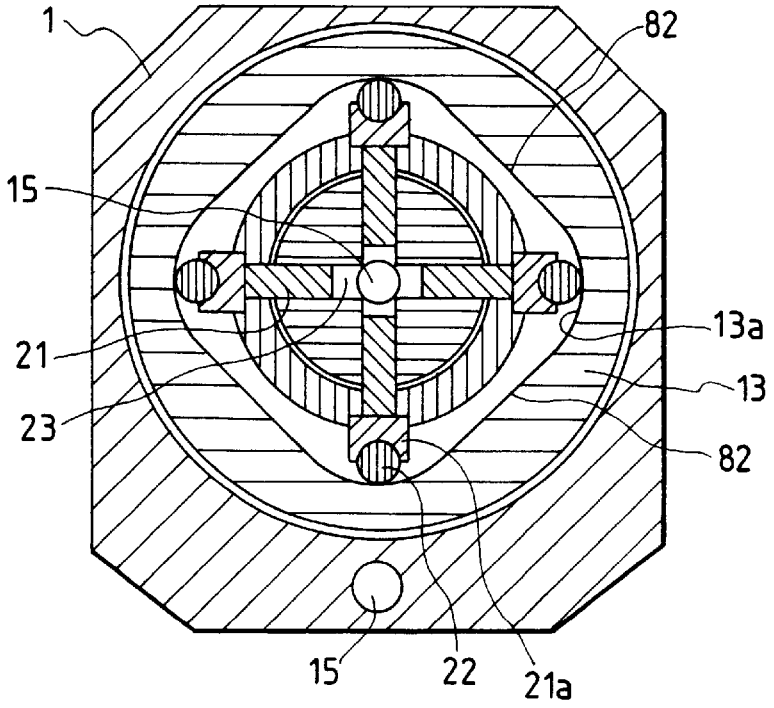

The cam 13, as can be seen from FIGS. 20(*a*) and 20(*b*), has substantially the same structure as the one shown in FIG. 10 except the profile (i.e., lift curve) of the cam surface 13*a*, as will be discussed later in detail. FIG. 20(*a*) shows the plungers 21 which reach an inner limit at the end of the fuel pressure/discharge operation. FIG. 20(*b*) shows the plungers 21 which reach an outer limit at the end of the fuel suction operation.

Figure 21:
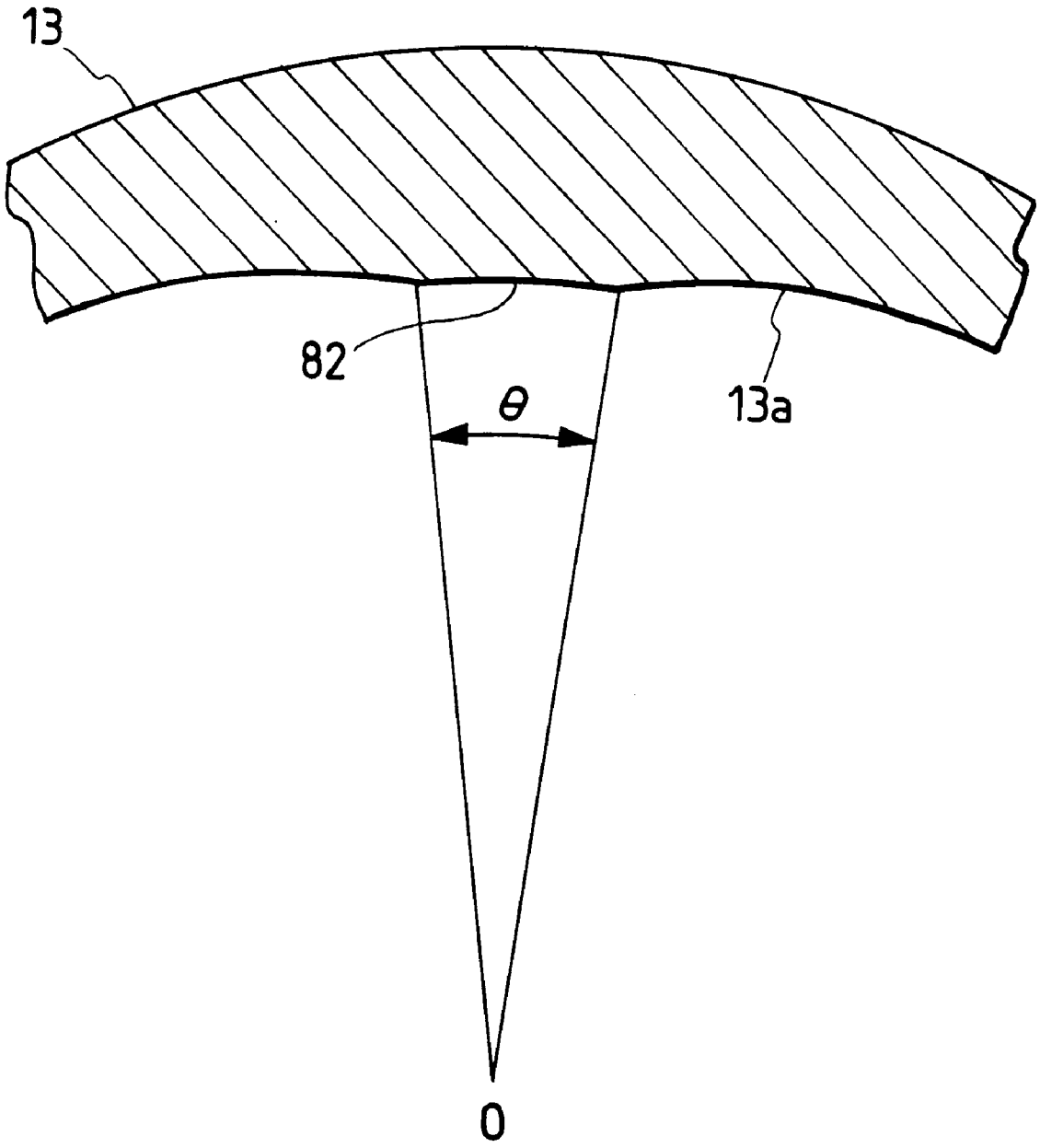
FIG. 21 is a partially enlarged view which shows a cam surface.

The cam surface 13*a* has recesses 82 formed on central portions between corners (corresponding to the tops 13*b* in FIG. 10). Each of the recesses 82 has, as shown in FIG. 21, a surface curved outward along a portion of a circle over an angle θ whose center lies at the center O of the cam 13 for holding the cam rollers 22 from moving in the radial direction of the cam 13 for a given period of time so that the plungers 21 stop at the inner limit, as shown in FIG. 20(*a*), for the time required for the cam 13 to rotate the angle θ. Usually, a time lag, as discussed above, occurs between energization of the solenoid valve 6 and a time when the needle valve 73 is moved to establish the fluid communication between the fluid paths 74*b* and 74*c* completely. In this embodiment, such a time lag may be compensated for by completing an valve-opening operation of the solenoid valve 6 during the time when the plungers 21 stop at the inner limit. This makes it possible to adjust the flow rate of fuel to be discharged from the high-pressure pump P with high accuracy. The angle θ is selected from 5° to 20° based on a maximum speed of the engine E.

The fuel pressurized within the pressure chamber 23 is supplied to the common rail R from the fluid path 24 through the delivery valve 3 and the supply pipe R1 at 200 to 1500 atm according to an operating condition of the engine E.

The operation of the fuel injection system using the high-pressure pump P of the fourth embodiment will be described with reference to FIGS. 22(*a*) to 23(*b*).

Figure 22:
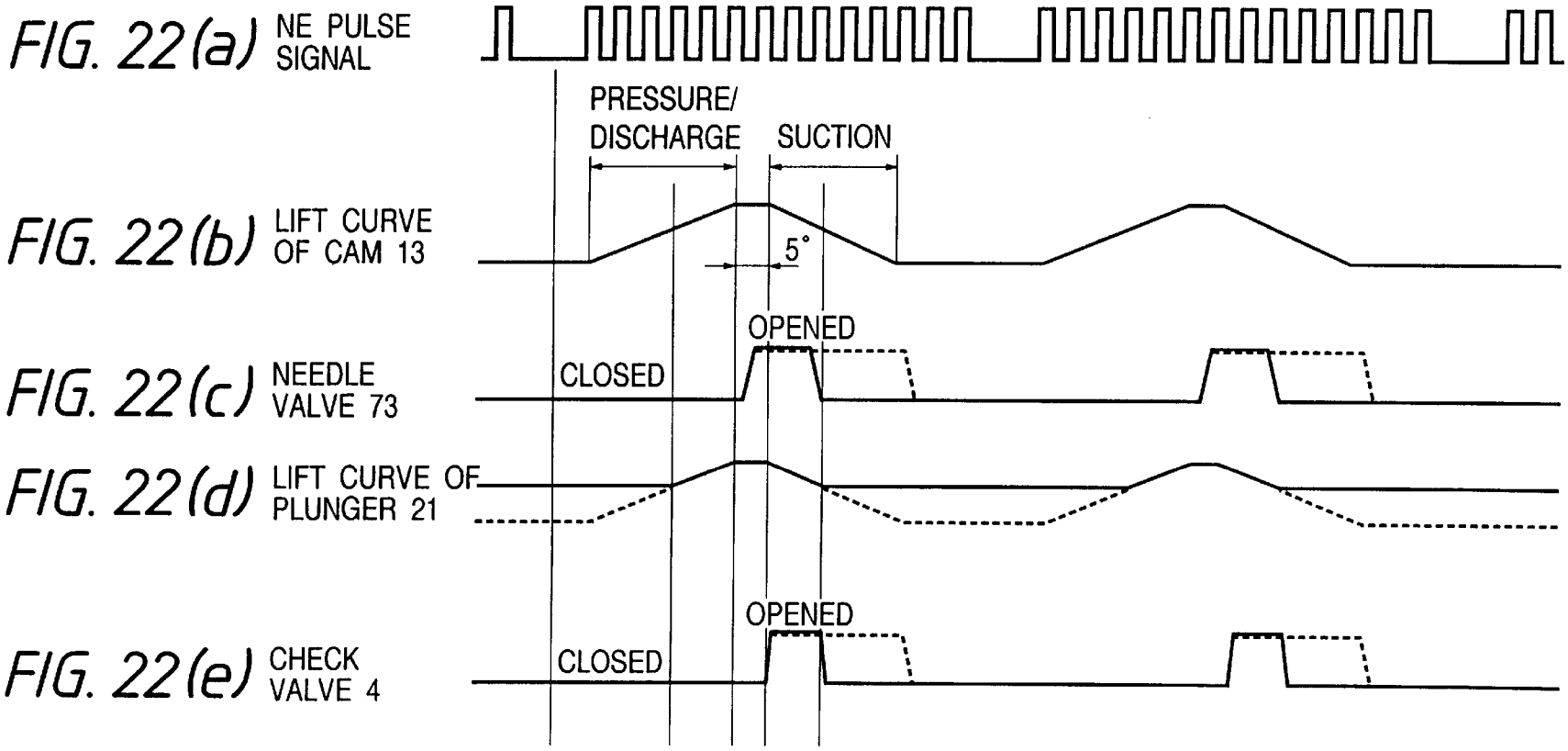
FIG. 22(*a*) is a time chart which shows NE pulse signals indicating the engine speed.

The ECU 100 controls the energization of the solenoid valve 6 based on NE pulse signals, as shown in FIG. 22(*a*), from the engine speed sensor S2 and sensor signals from the load sensor S3, the pressure sensor S1, a coolant temperature sensor, and an atmospheric pressure sensor (not shown).

At time t1, the solenoid valve 6 is turned off. The needle valve 73 is urged by the spring 67 to block the fluid communication between the fluid path 74*c* and the fuel sump 52. The check valve 4 is closed by the spring 46. The cam rollers 22 are in disengagement from the cam surface 13*a* of the cam 13.

When the fuel pressure/discharge operation is entered, and the rotating cam surface 13*a* engages the cam rollers 22 at time t2, it will cause the plungers 21 to be moved inward through the shoes 24. During the fuel pressure/discharge operation, the fuel pressure acts on the needle valve 44 of the check valve 4 to close it. When the pressure of fuel within the pressure chamber 23 is increased by the inward movement of the plungers 21 and exceeds a given level, it opens the delivery valve 3 to feed the pressurized fuel to the common rail R through the supply pipe R1. When the plungers 21 reach the inner limit at time t3, the fuel pressure/discharge operation terminates.

Upon completion of the fuel pressure/discharge operation, the plungers 21 are, as discussed above, held from being moved outward of the cam 13 until the cam 13 rotates an angle of 5° (i.e., until time t4).

The ECU 100 controls the energization of the solenoid valve 6 so that it may be opened fully between time t3 and time t4. Specifically, the needle valve 73 of the solenoid valve 6 is moved fully to establish the fluid communication between the fluid paths 74*b* and 74*c* before the plungers 21 are moved outward for sucking the fuel into the pressure chamber 23. This offers precise adjustment of the quantity of fuel to be sucked into the pressure chamber 23.

After time t4, the plungers 21 enter the fuel suction stroke. The low-pressure fuel flowing from the fuel sump 52 into the fluid path 74*c* acts on the needle valve 44 of the check valve 4 to open it against the spring pressure of the spring 47 and enters the pressure chamber 23. The fuel entering the pressure chamber 23 push the plungers 21 outward and continues to be sucked until the solenoid valve 6 is closed.

When the ECU 100 deenergizes the coil 62, the needle valve 73 of the solenoid valve 6 is seated on the valve seat 75 to block the fluid communication between the fuel sump 52 and the fluid path 74*c* (i.e., the pressure chamber 23) at time t5. When the fuel stops entering the pressure chamber 23, the needle valve 44 of the check valve 4 is closed by the spring 46. The cam 13 continues to rotate even after the fuel suction operation is completed, but the plungers 21 are held from being moved so that the cam rollers 22 are brought into disengagement from the cam surface 13*a*.

The amount of fuel flowing from the fuel sump 52 to the pressure chamber 23 is controlled by the length of time the solenoid valve 6 is energized. Broken lines in FIGS. 22(*c*) to 22(*e*) indicate pump operations when the plungers 21 are moved outward up to the outer limit to suck a maximum amount of fuel into the pressure chamber 23 and delivery it to the common rail R. Solid lines indicate pump operations when the plungers 21 are moved to positions determined by a desired amount of fuel to be sucked. Specifically, when the solenoid valve 6 is turned off early, it will cause the plungers 21 to stop, as shown by the solid line in FIG. 22(*c*), before reaching the outer limit so that the amount of fuel sucked into the pressure chamber 23 is decreased.

Figure 23:
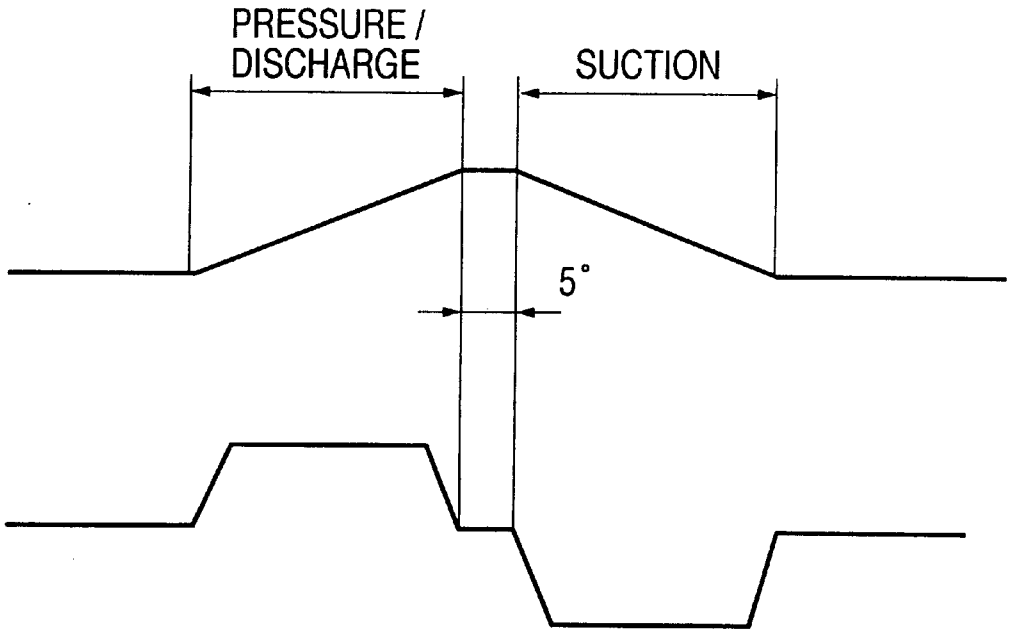
FIG. 23(*a*) is a time chart which shows a lift curve of a cam.

FIG. 23(*a*) illustrates the lift curve of the cam surface 13*a*. FIG. 23(*b*) illustrates the speed of the plungers 21 in one cycle from the end of the fuel pressure/discharge operation to the beginning of the fuel suction operation. As clearly shown in the drawings, the speed of the plungers 21 becomes zero during an angular interval of 5° between the end of the fuel pressure/discharge operation and the start of the fuel suction operation.

Figure 24:
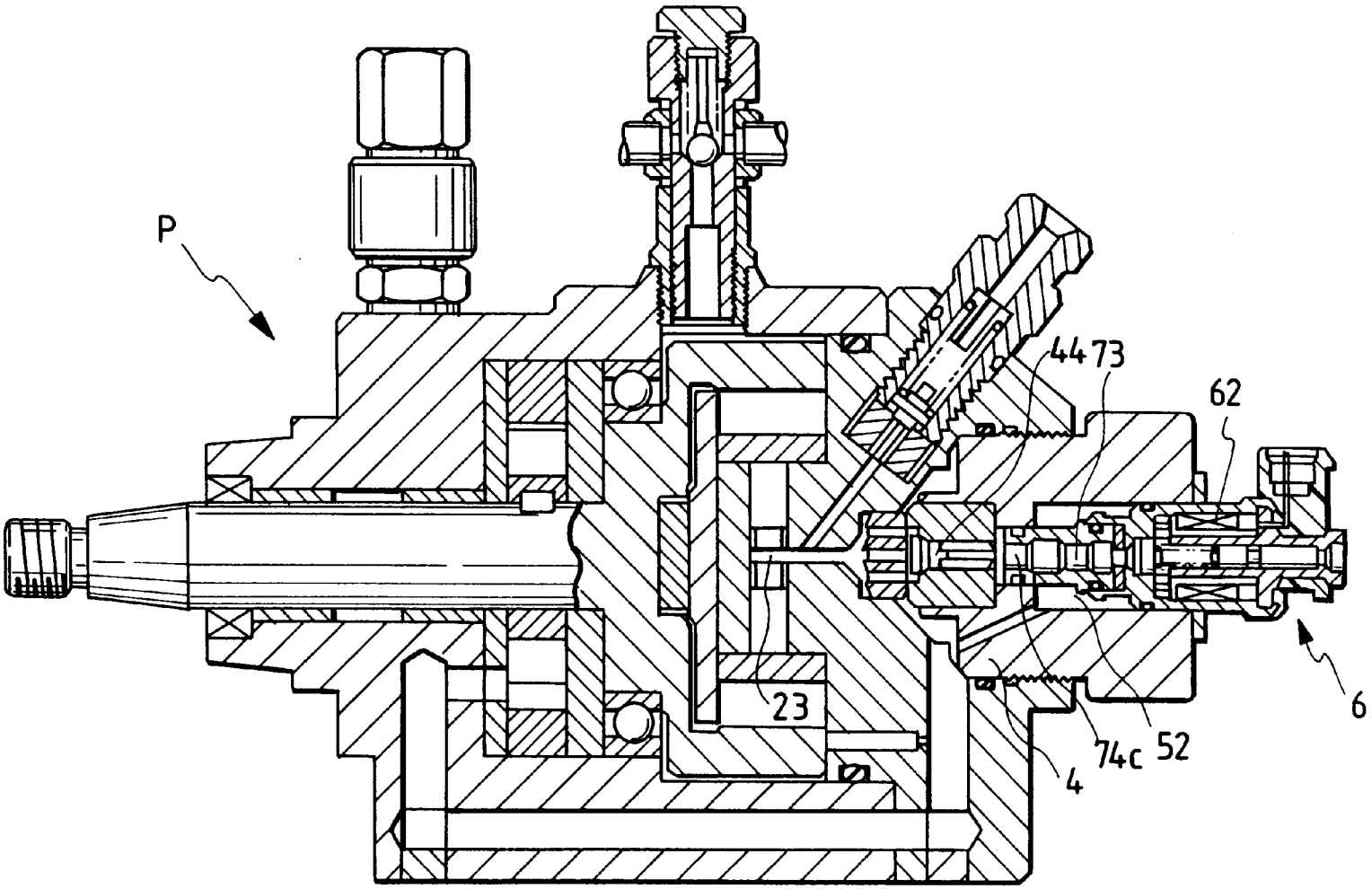
FIG. 24 is a vertical cross sectional view which shows a high-pressure pump according to the fifth embodiment of the invention.

FIG. 24 shows the high-pressure pump P according to the fifth embodiment of the invention which is different from the fourth embodiment in that the check valve 4 does not have the spring 46 urging the needle valve 44 to the closed position. Other arrangements are identical with those of the fourth embodiment.

The conventional pump structure designed to start the fuel suction operation immediately after completion of the fuel pressure/discharge operation has the problem of a small amount of fuel leaking out of the pump even after the pump is stopped if the spring 46 is not provided in the check valve 4, but the pump structure, as described in the fourth embodiment, wherein the lift curve of the cam 13 has flat portions over a rotational angle of 5° of the cam 13 eliminates the use of the spring 46. The reason for this will be discussed below.

Figure 25:
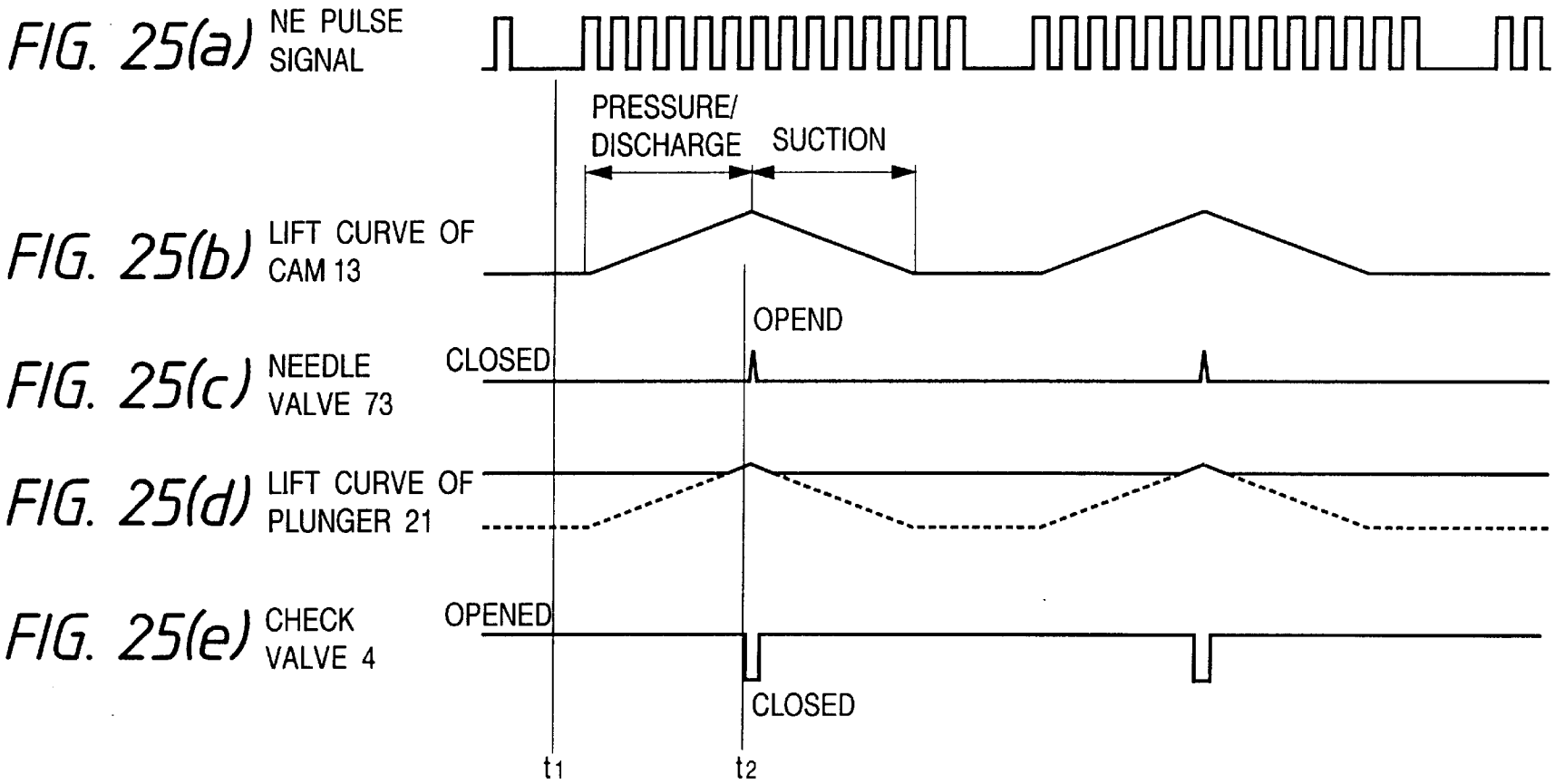
FIG. 25(*a*) is a time chart which shows NE pulse signals indicating the engine speed.

FIGS. 25(*a*) to 25(*e*) are time charts showing NE pulse signals, a lift curve of the cam 13, movement of the needle valve 73 of the solenoid valve 6, a lift of each plunger 21, and an operation of the check valve 4 in the conventional pump structure using no spring 46.

At time t1, the solenoid valve 6 is in an off position, and the check valve 4 is opened because the spring 46 is not used. At time t2, the plungers 21 start to move inward to pressurize the fuel within the pressure chamber 23, thereby closing the check valve 4. The movement of the needle valve 44 of the check valve 4 in the right direction, as viewed in FIG. 24, causes the volume of the fluid path 74*c* to be reduced so that the internal pressure thereof is increased, thereby opening the needle valve 73 temporarily, as shown in FIG. 25(*c*). Thus, the fuel within the fluid path 74*c* flows into the fuel sump 52. When the plungers 21 enter the fuel suction stroke immediately following the fuel pressure/discharge operation before the needle valve 73 is closed completely, the fuel within the fuel sump 52 flows into the pressure chamber 23, which, in turn, leaks out of the delivery valve 3 undesirably if the solenoid valve 6 is turned off to stop the pump after the fuel pressure/discharge operation.

Figure 26:
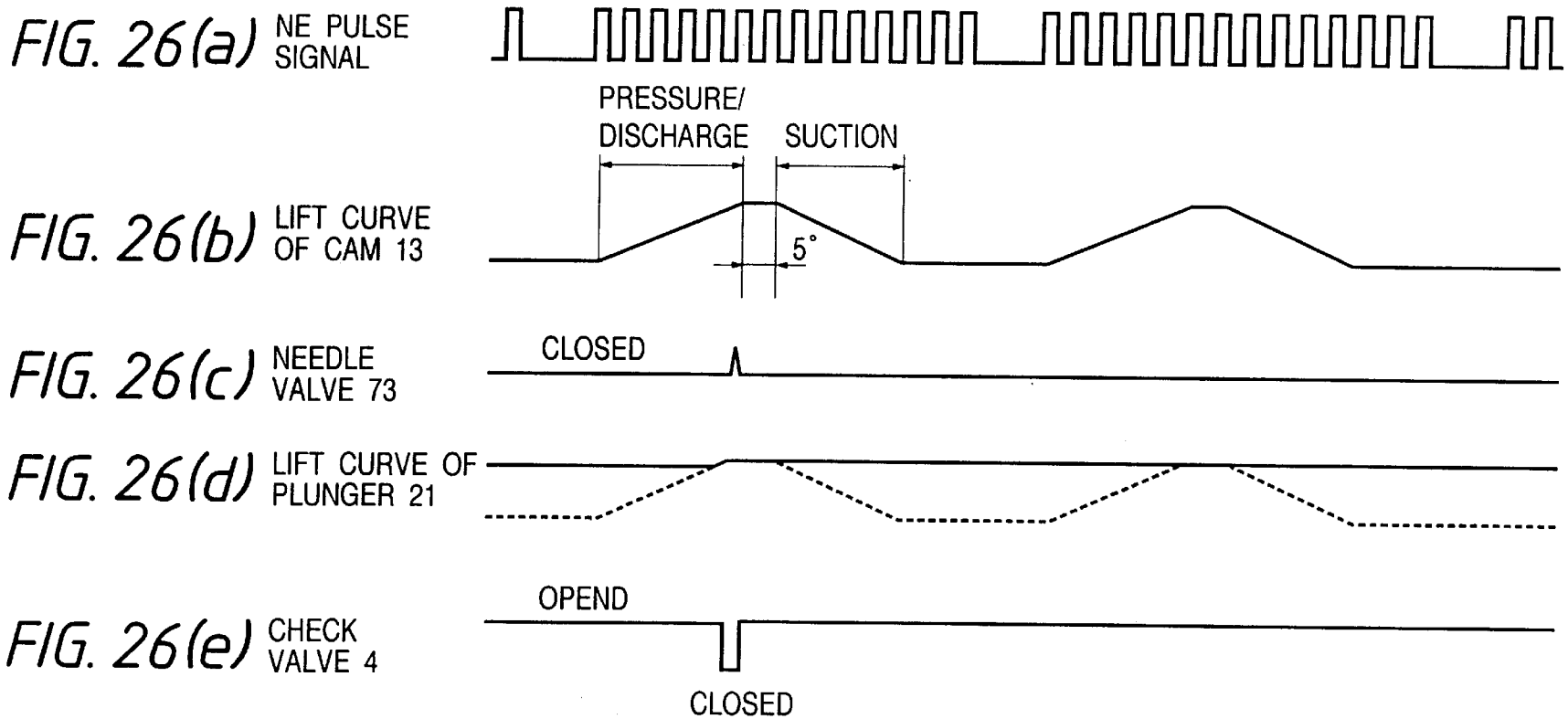
FIG. 26(*a*) is a time chart which shows NE pulse signals indicating the engine speed.

FIGS. 26(*a*) to 25(*e*) are time charts showing NE pulse signals, a lift curve of the cam 13, movement of the needle valve 73 of the solenoid valve 6, a lift of the plungers 21, and an operation of the check valve 4 in the fifth embodiment as shown in FIG. 24.

As apparent from the drawings, the fuel suction operation starts after the needle valve 73 of the solenoid valve 6 is closed completely. The above problem is, thus, not encountered.

Figure 27:
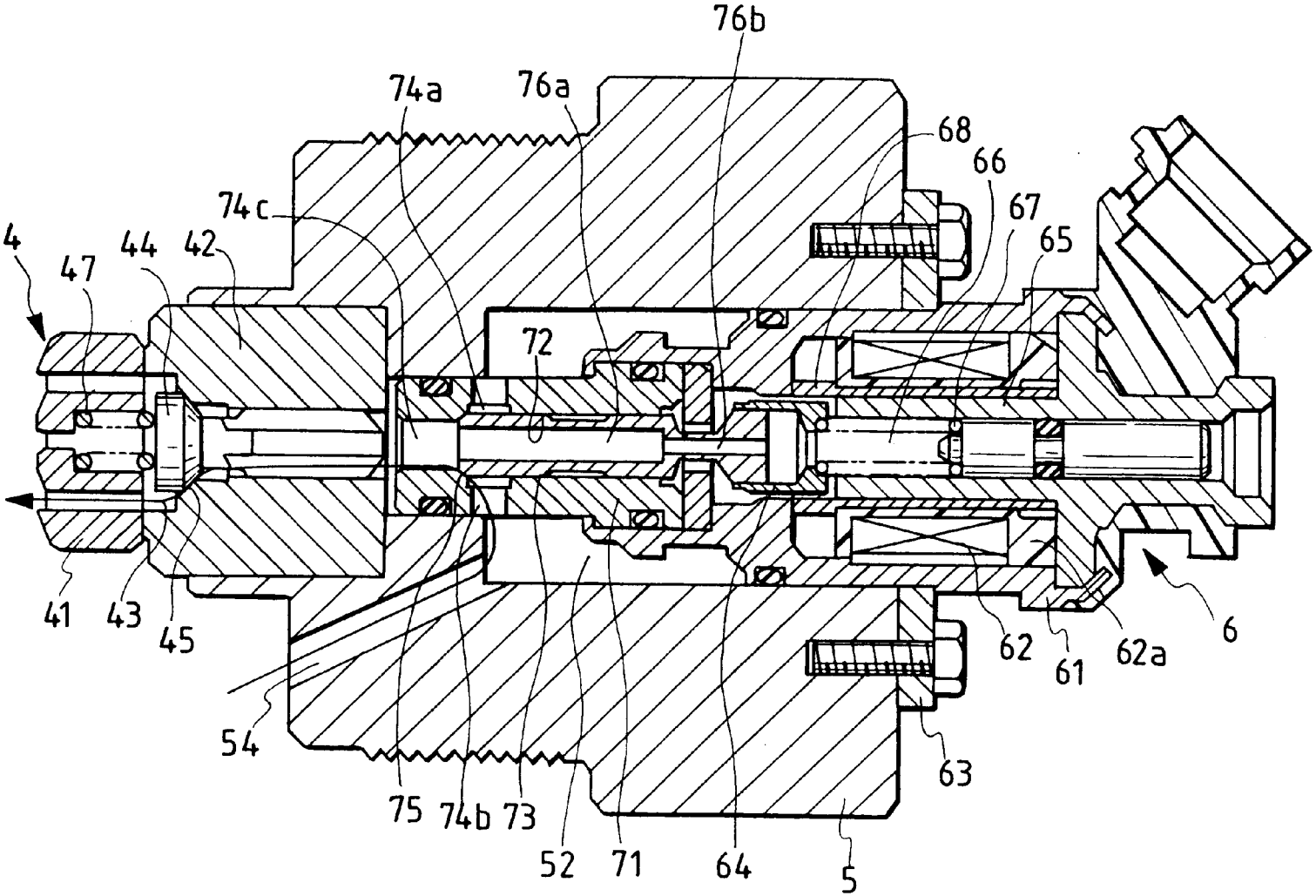
FIG. 27 is a partially cross sectional view which shows a high-pressure pump according to the sixth embodiment of the invention.

FIG. 27 shows the high-pressure pump P according to the sixth embodiment of the invention which is different from the fourth embodiment as shown in FIG. 18 only in internal structure of the solenoid valve 6. Other arrangements are identical, and explanation thereof in detail will be omitted here.

The needle valve 73 of the solenoid valve 6 has formed therein a large-diameter fluid path 76*a* and a small-diameter fluid path 76*b*. The large-diameter fluid path 76*a* communicates with the fluid path 74*c*. The small-diameter fluid path 76*b* communicates with the inside of the housing 61 such as the spring chamber 66. This balances the fuel pressure urging the needle valve 73 in a valve-opening direction with the fuel pressure urging the needle valve 73 in a valve-closing direction.

When the solenoid valve 6 is turned on, and the armature 64 is moved right, as viewed in the drawing, against the spring force of the spring 67, the fuel within the spring chamber 66 flows into the fluid paths 76*a* and 76*b* and the fluid path 74*c*. If component parts in the solenoid valve 6 are made of an elastic material such as resin or rubber, they will be deformed outward by the fuel pressure transmitted from the fluid path 74*c* to the inside of the solenoid valve 6 when turned on so that, within the space (will be referred to as a downstream valve chamber, hereinafter) extending from the needle valve 44 of the check valve 4 to the inside of the solenoid valve 6 through the needle valve 73, the fuel greater in volume than the space is stored therein during turning on of the solenoid valve 6. Specifically, the downstream valve chamber serves as an accumulator. When the solenoid valve 6 is turned off, and the fuel pressure/discharge operation starts, the fuel within the downstream valve chamber flows into the pressure chamber 23, thus resulting in a variation in pressure of fuel discharged from the pump P.

For avoiding the above problem, a cylindrical member 68 made of a non-magnetic metallic material such as aluminum withstanding the fuel pressure acting thereon, covers the stator 65 with both ends firmly engaging an inner wall of the housing 61. Specifically, the cylindrical member 68 serves as a partition dividing the inner space of the housing 61 into an outer chamber within which the coil bobbin 62*a* and the coil 62 are disposed and an inner chamber leading to the fluid paths 76*a* and 76*b* to prevent the fuel pressure from being transmitted to the resin-made bobbin 62*a*. The cylindrical member 68 also serves as a sealing member establishing the liquid-tight seal between the housing 61 and the stator 65. This eliminates the use of O-rings such as ones installed between the stator 65 and the housing 61 in the fourth embodiment as shown in FIGS. 18 and 19.

Figure 28:
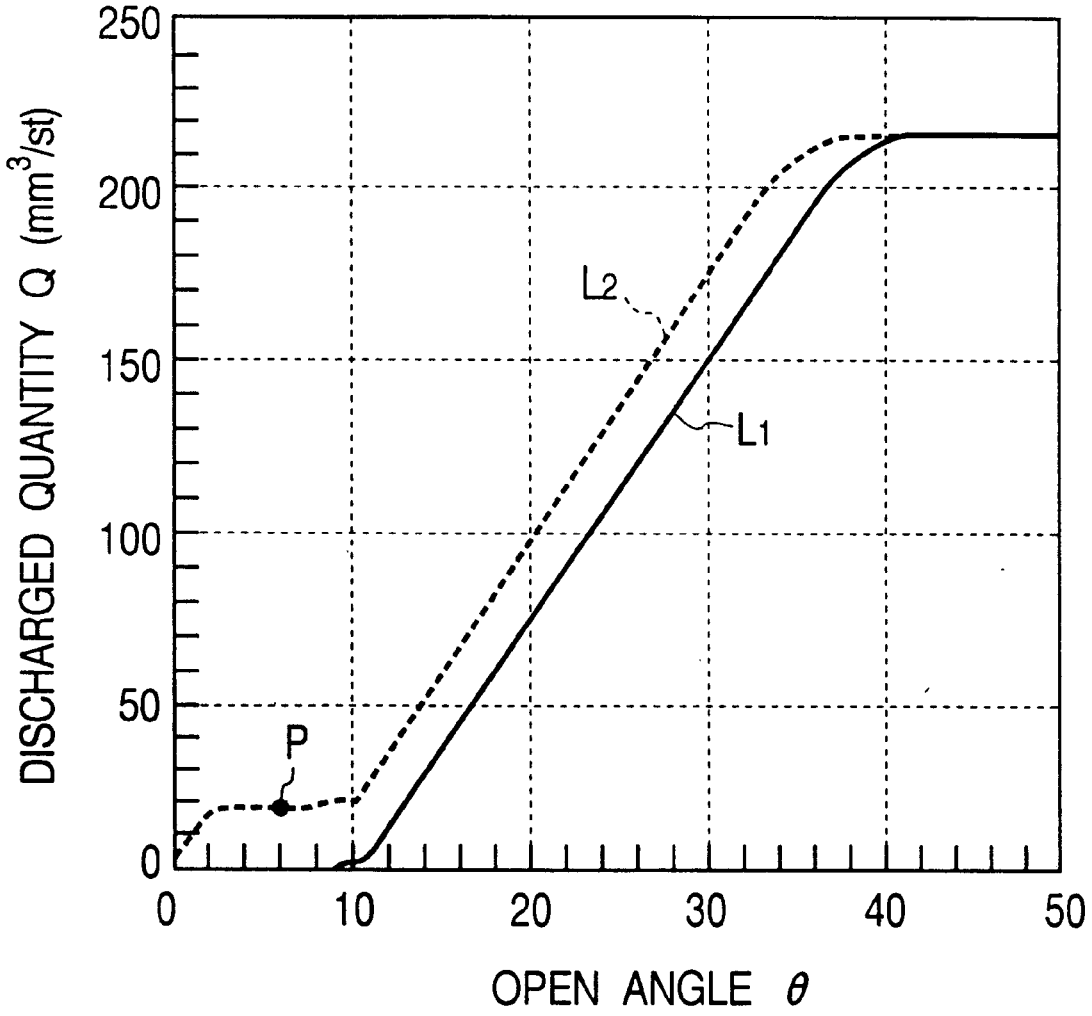
FIG. 28 is a graph which shows the relation between the quantity of fuel to be fed to a common rail R and the open of a solenoid valve.

FIG. 28 shows the relation between the quantity of fuel to be discharged from the high-pressure pump P and a valve-opening angle θ that is a rotational angle of the cam 13 over the interval between time t3 and time t5, as shown in FIG.

22(*b*), that is, the period of time between completion of the fuel pressure/discharge operation and a time when the needle valve 73 of the solenoid valve 6 is closed fully. In FIG. 22(*c*), the interval between the end of the fuel pressure/discharge operation and the start of the fuel suction operation is 5°, but it is set to 10° in this embodiment. L1 indicates this embodiment, while L2 indicates a high-pressure pump P in which the cylindrical member 68 is not installed.

As can be seen from the graph, in the high-pressure pump P of this embodiment, even when the solenoid valve 6 is turned on to open the needle valve 73 below a valve-opening angle of 10°, the fuel is not accumulated within the downstream valve chamber because the downstream valve chamber does not works as an accumulator. The quantity of fuel discharged from the high-pressure pump P, thus, shows zero. Above a valve-opening angle of 10°, the discharged quantity of fuel is increased in proportion to the valve-opening angle θ. Specifically, the discharged quantity of fuel is controlled accurately by adjusting the valve-opening angle θ.

In the high-pressure pump P not having the cylindrical member 68, a small quantity of fuel is discharged from the pump P even below a valve-opening angle of 10°. This is due to the fact that, below a valve-opening angle of 10°, the needle valve 73 is opened when the cam rollers 22 engage the recesses 82 of the cam surface 13*a* so that no fuel is sucked into the pressure chamber 23, but the fuel stored in the downstream valve working as the accumulator flows into the pressure chamber 23 when the fuel suction operation starts following turning off of the solenoid valve 6, which is, in turn, discharged undesirably from the pump P during the fuel pressure/discharge operation.

Figures 29A, 29B:
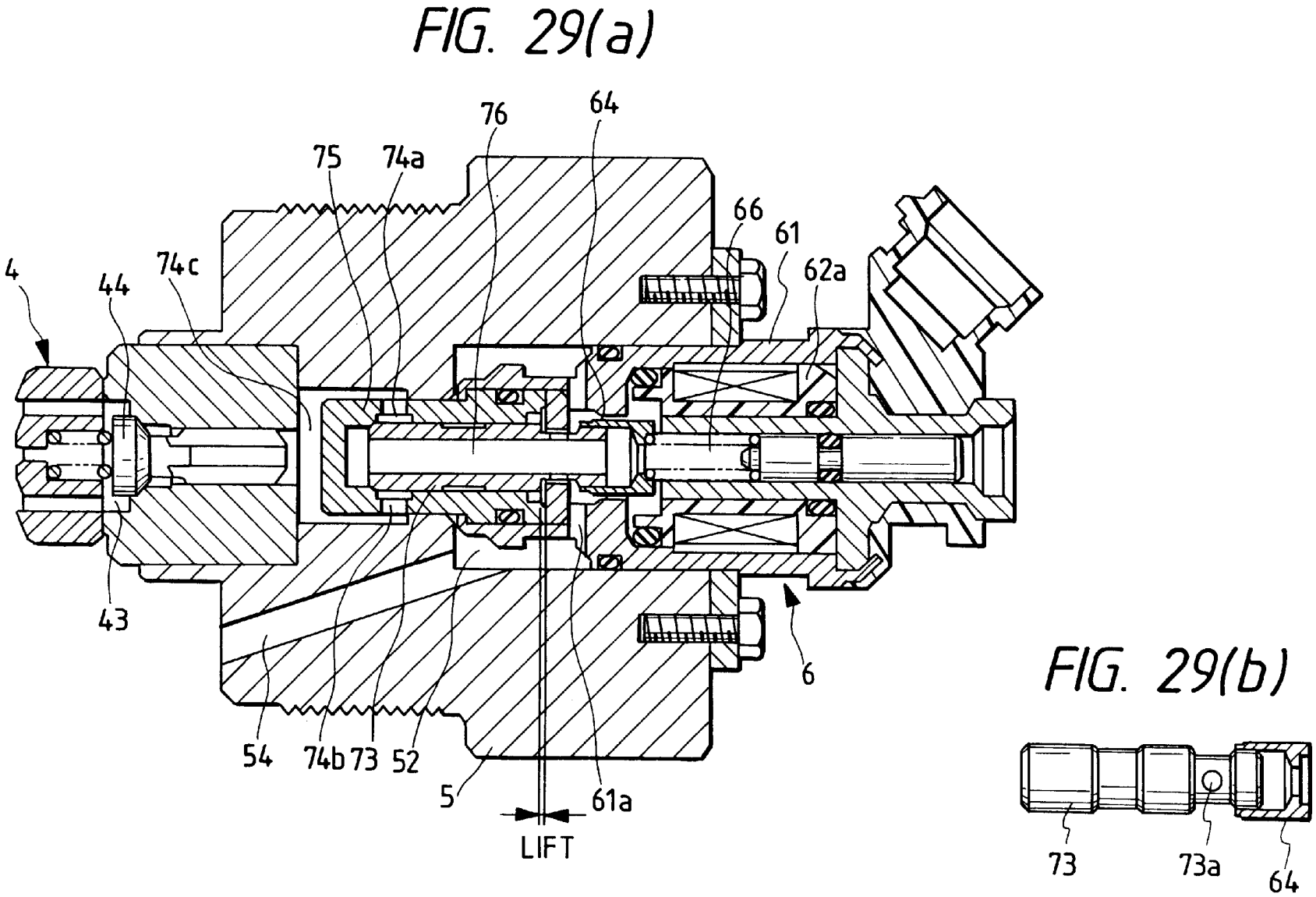
FIG. 29(*a*) is a partial cross sectional view which shows a high-pressure pump according to the seventh embodiment of the invention.

FIGS. 29(*a*) to 30 show the high-pressure pump P according to the seventh embodiment of the invention which is a modification of the above sixth embodiment.

Figure 30:
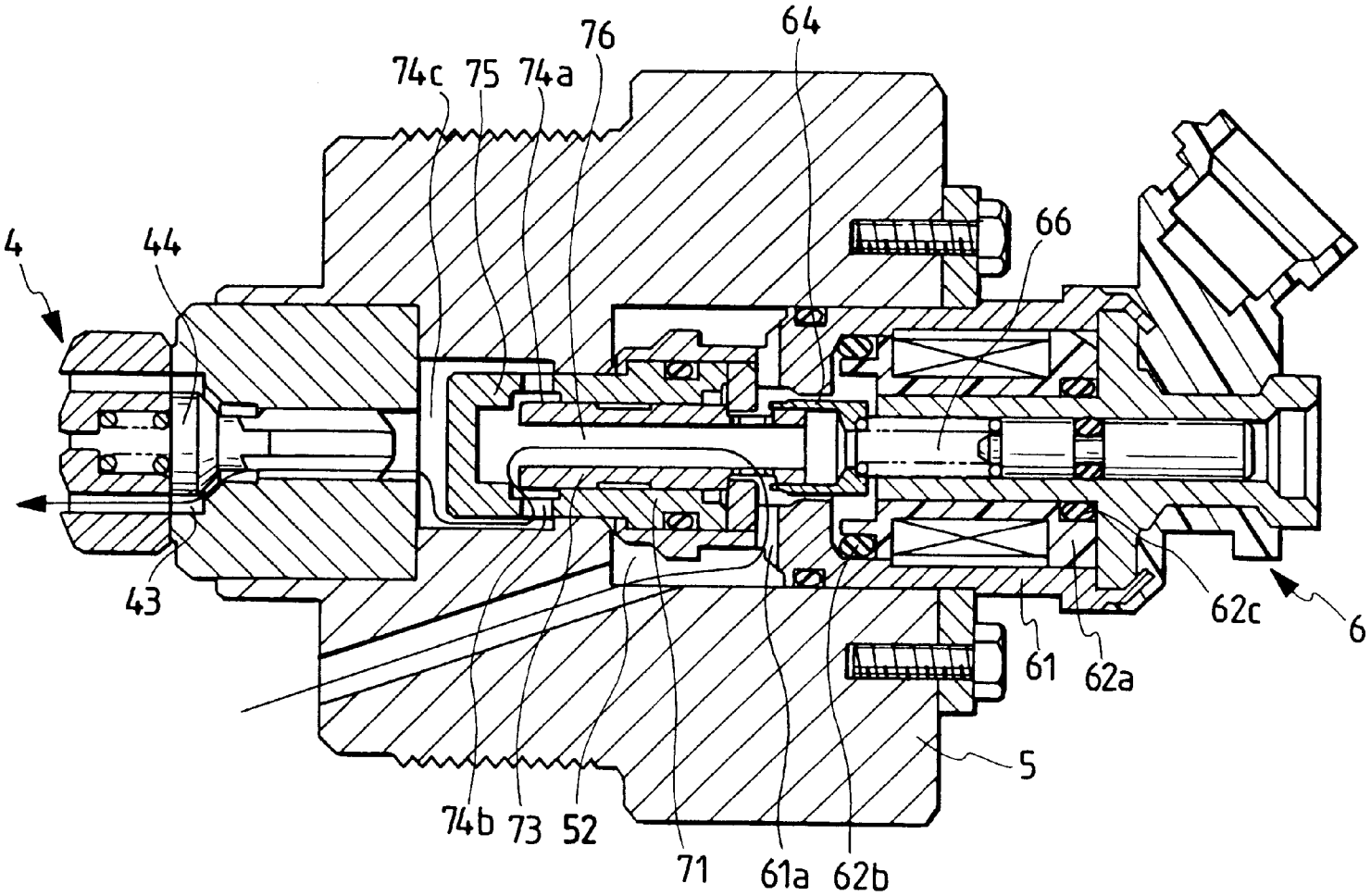

A fluid path 61*a* is formed in the housing 61 which communicates between the fuel sump 52 and the inside of the housing 61. A fluid path 73*a* is, as shown in FIG. 29(*b*), formed in a side wall of the needle valve 73 to allow the fuel within the fuel sump 52 to flow into the fluid path 76 in the needle valve 73. The valve body 71 has a left end closed and has the outside diameter smaller than that of the fluid path 74*c*. When the needle valve 73 is opened, the fuel flows, as indicated by an arrow in FIG. 30, from the fluid path 76 to the fluid path 74*c* downstream of the needle valve 73 through the valve seat 75 and the fluid paths 74*a* and 74*b* and opens the needle valve 44 of the check valve 4.

When the solenoid valve 6 is turned off, the fluid communication between the fluid path 74*c* and the fluid path 76 in the needle valve 73 is blocked as shown in FIG. 29(*a*). Specifically, the fluid path 74*c* and the inner space of the needle valve 73 leading to the inside of the solenoid valve 6 is blocked. This prevents excess fuel from being stored in the fluid path 74*c* due to the deformation of the O-rings 62*b* and 62*c* and the resin-made bobbin 62*a*, as described in the above sixth embodiment, without use of the metallic cylindrical member 68. The constant communication between the inside of the solenoid valve 6 and the fluid path 54 upstream of the solenoid valve 6 through the fluid path 61*a* allows the fuel to flow into and out of the solenoid valve 6 from and into the fluid path 54 when the needle valve 73 is moved, thereby facilitating ease of movement of the needle valve 73 when the solenoid valve 6 is turned on and off.

Figure 31A:
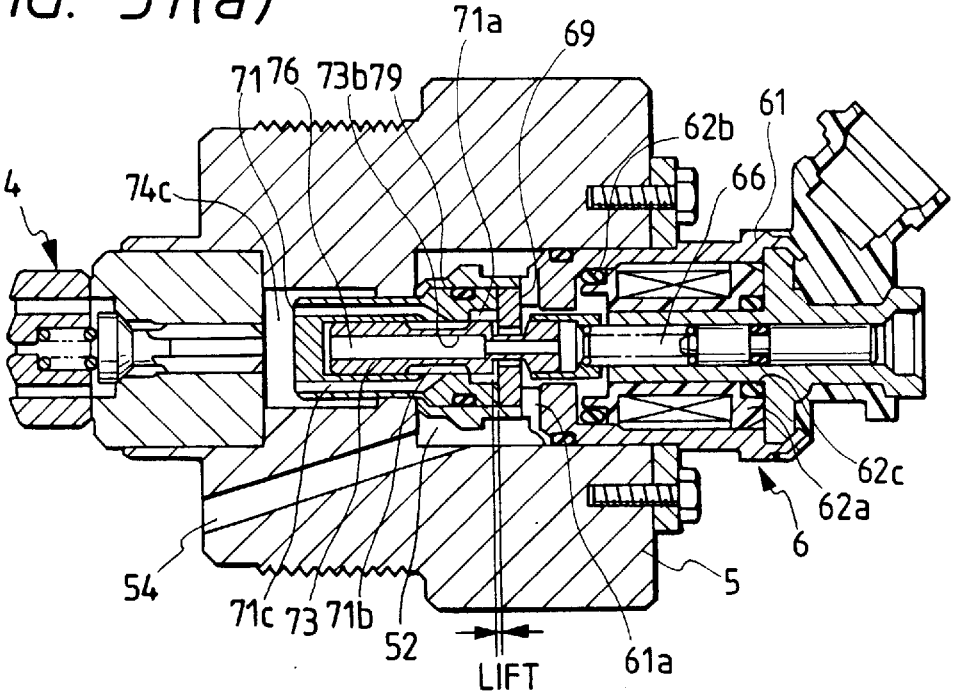
FIG. 31(*a*) is a partially cross sectional view which shows a high-pressure pump according to the eighth embodiment of the invention.
Figure 31B:
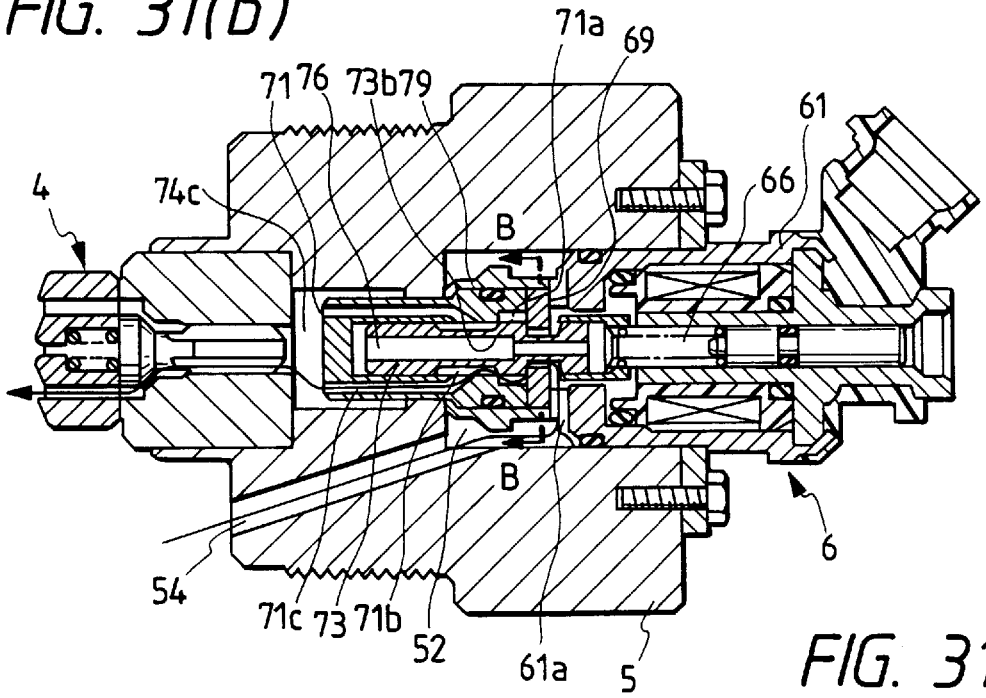
Figure 31C:
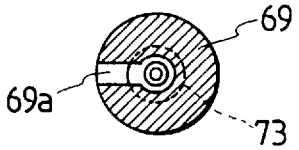

FIGS. 31(*a*) to 31(*c*) show the high-pressure pump P according to the eighth embodiment of the invention which is different from the seventh embodiment in structure of the needle body 71.

The needle body 71 has formed in the right end portion an annular fluid path 71*b*. A valve seat 79 is formed on an inner wall of the valve body 71 between the fluid path 71*a* and the fluid path 71*b* which is defined around the periphery of the needle valve 73. The needle valve 73 is seated at a tapered surface 73*b* on the valve seat 79. A cylindrical fluid path 71*c* is formed in the needle valve 73 which communicates between the fluid path 74*c* and the fluid path 71*b*. The fluid path 71*a* communicates with a fluid path 61*a* formed within the housing 61 and the fuel sump 52 through a central opening 69*a* of a C-shaped shim 69, as shown in FIG. 31(*c*), disposed between the valve body 71 and the housing 61. The valve body 71 has a left end closed. When the needle valve 73 is closed, the fluid communication between the inside of the solenoid valve 6 and the fluid path 74*c* is blocked.

When the needle valve 73 is moved in the right direction to establish the fluid communication between the fluid paths 71*a* and 71*b* as shown in FIG. 31(*b*), it will cause the fuel to flow, as indicated by an arrow, from the fluid path 54 to the fluid path 74*c* through the fuel sump 52, the fluid path 61*a*, the central opening 69*a* of the shim 69, and the fluid paths 71*a*, 71*b*, and 71*c*. When the solenoid valve is turned off, the fluid path 74*c* and the inner space of the solenoid valve 6 is blocked, thereby preventing, similar to the above seventh embodiment, excess fuel from being stored in the fluid path 74*c* due to the deformation of the O-rings 62*b* and 62*c* and the resin-made bobbin 62*a* without use of the metallic cylindrical member 68.

Figure 32:
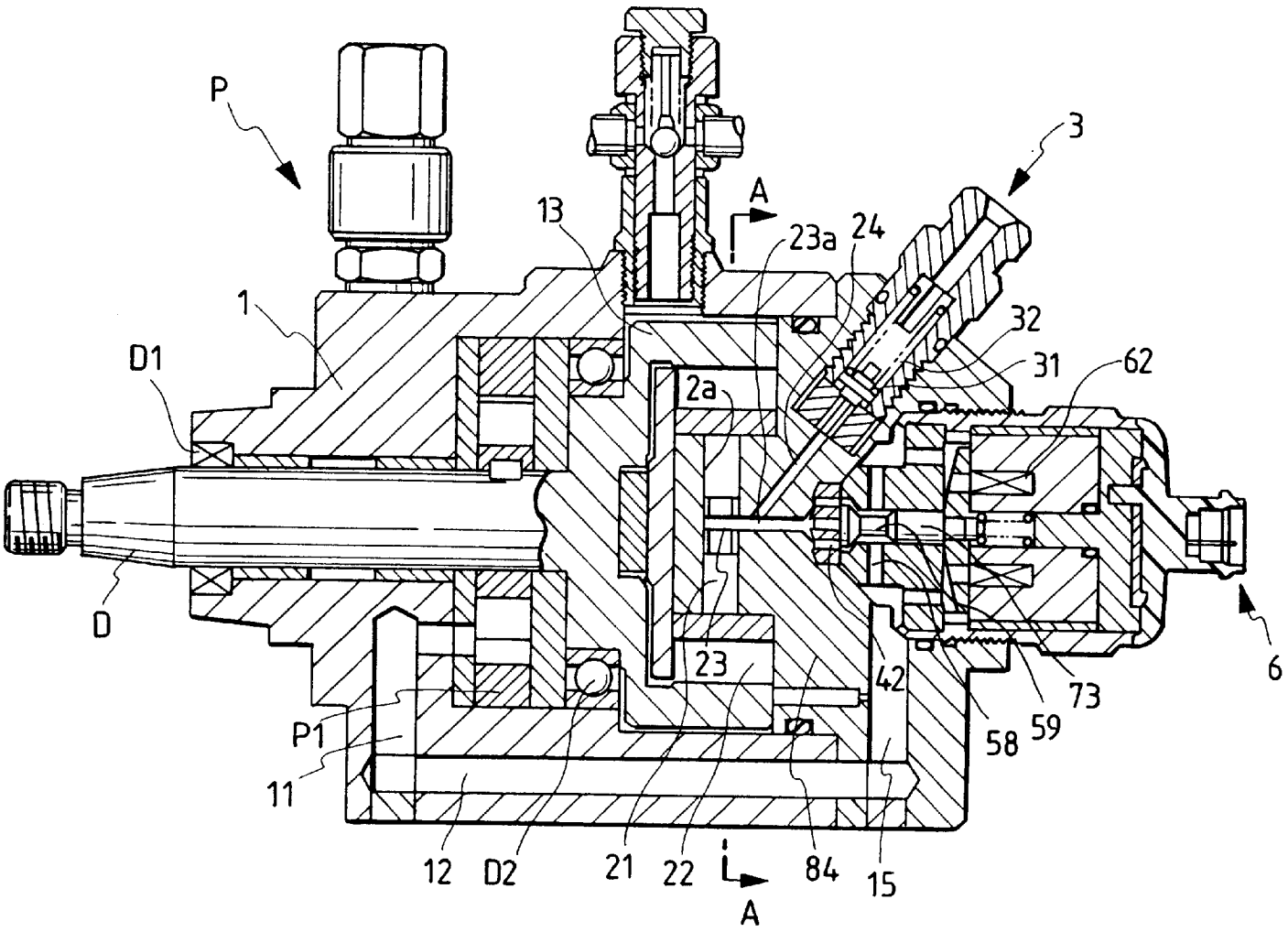
FIG. 32 is a vertical cross sectional view which shows a high-pressure pump according to the ninth embodiment of the invention.
Figure 33:
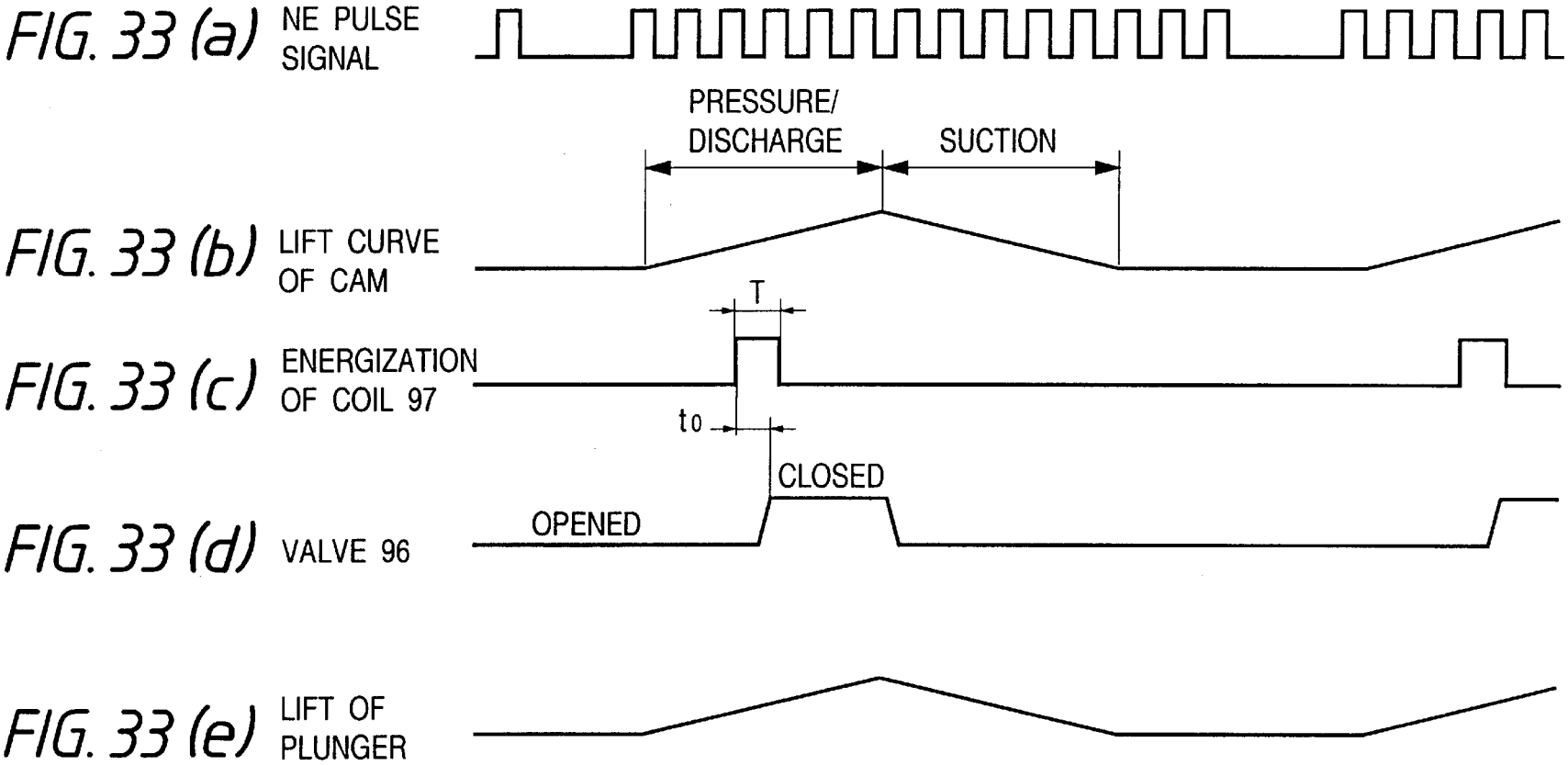
FIG. 33(*a*) is a time chart which shows NE pulse signals indicating the engine speed.
Figure 34:
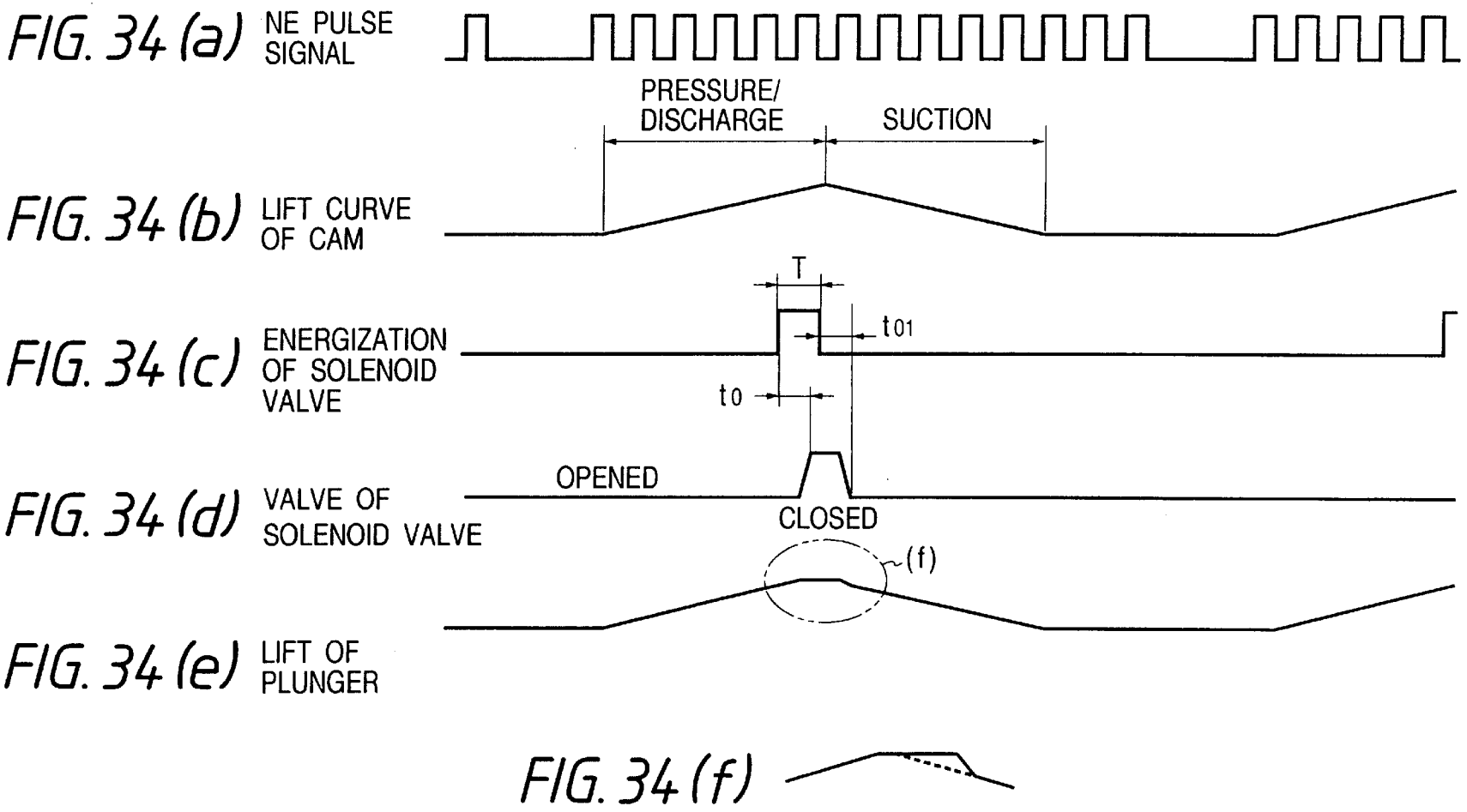
FIG. 34(*a*) is a time chart which shows NE pulse signals indicating the engine speed.

FIG. 32 shows the high-pressure pump P according to the ninth embodiment of the invention which is designed to adjust the amount of fuel to be discharged under the pre-stroke control, as described in the introductory part of this application. For instance, in the conventional high-pressure pump as shown in FIG. 1, the discharge of a desired quantity of fuel is accomplished by holding the valve head 96 opened, as shown in FIG. 33(*d*), during the fuel pressure/discharge operation to discharge part of the fuel sucked into the pressure chamber 93 to the low-pressure path 95 until the amount of fuel within the pressure chamber 93 reaches a desired value, without closing the valve head 96 immediately after the plunger 92 starts to move upward, after which the valve head 96 is closed. Usually, a time lag to, as shown in FIGS. 33(*b*) and 33(*d*), occurs between energization of the coil 97 and a time when the valve head 96 starts to be closed. For compensating for an inevitable unit-to-unit variation in solenoid valves and/or a variation in voltage of a battery installed in an automotive vehicle, the solenoid valve 94 is turned on for a given period of time T (e.g., 0.5 msec.) longer than the time lag to. The problem is, however, encountered when it is required for the pump to discharge a small amount of fuel, for example, in idle modes of engine operation in that the valve head 96 is, as shown in FIG. 34(*d*), opened after the fuel suction operation starts. Specifically, the valve head 96 of the solenoid valve 94 is still closed immediately after the fuel suction operation so that the fuel is not sucked into the pressure chamber 93, thereby causing a cam follower (connected to the plunger 92) to disengage from a cam, as shown in FIG. 34(*f*). Upon completion of energization of the solenoid valve 94, the valve head 96 is opened to suck the fuel into the pressure chamber 93, but at the same time, the cam follower hits on the cam, producing unwanted mechanical noise. The ninth embodiment, as discussed below, aims at solving this problem.

Figure 35:
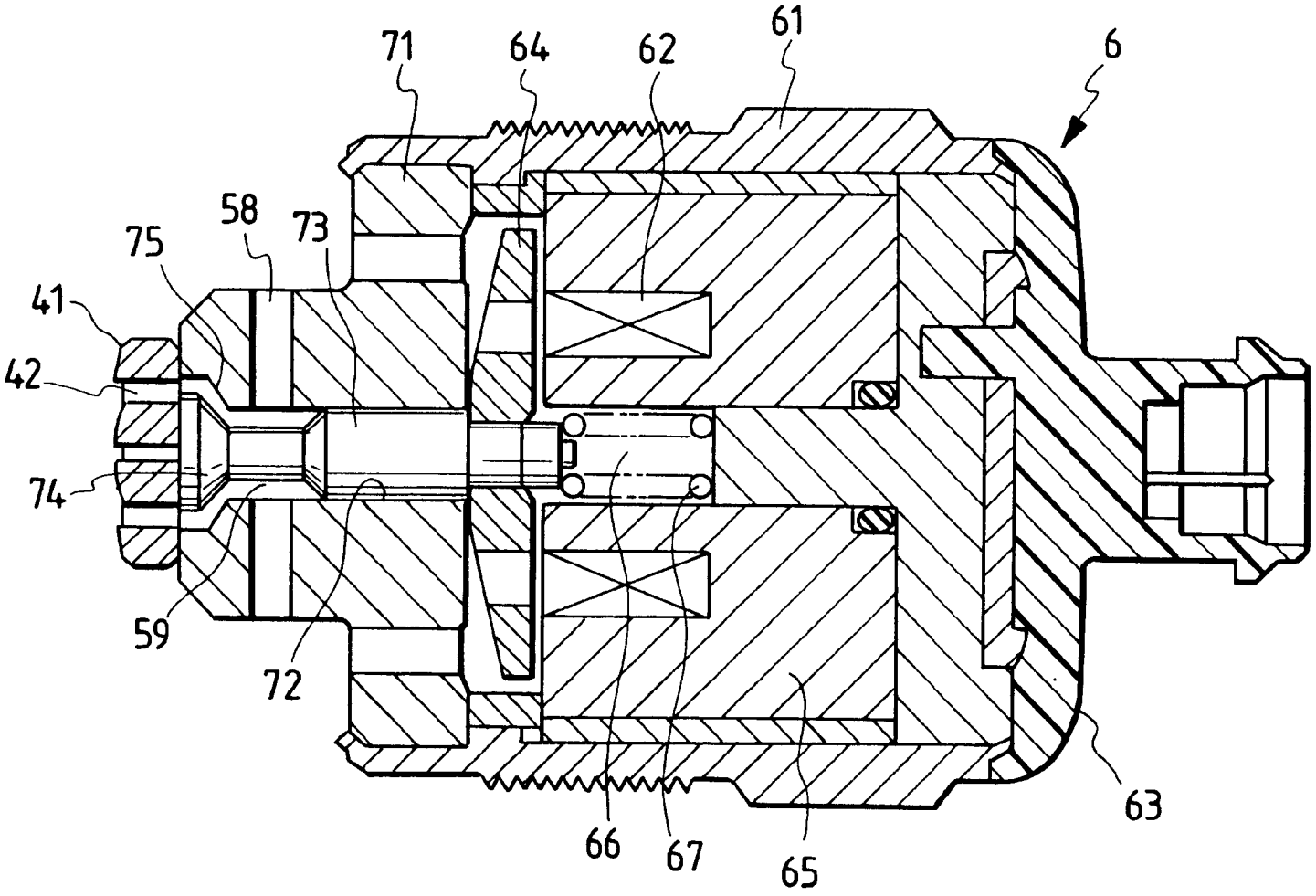
FIG. 35 is a partially cross sectional view of FIG. 32.

In FIGS. 32 and 35, the same reference numbers as employed in the above embodiments refer to the same parts, and explanation thereof in detail will be omitted there.

The solenoid valve 6, as shown in FIG. 35, includes a cylindrical housing 61 and a flanged valve body 71. The housing 61 is closed at its end by a cover 63 and has disposed therein a stator 65. The valve body 71 has formed therein a cylindrical chamber 72 in which a needle valve 73 is slidably disposed. The needle valve 73 has a small-diameter portion and a valve head 74 connected to an end of the small-diameter portion. The small-diameter portion of the needle valve 73 defines a fuel chamber 59 between itself and an inner wall of the cylindrical chamber 72. A fluid path 58 traverses the valve body 71 and communicates between the fuel chamber 59 and the low-pressure pump P1 through the fluid paths 11, 12, and 15, as shown in FIG. 32.

An armature 64 made of a disc member is installed on the needle valve 73 with press fit between the valve body 71 and the stator 65. The stator 65 has disposed therein a coil 62 and a spring 67 which urges the needle valve 73 into constant engagement with a spacer 41 secured on an end of the valve body 71. The spacer 41 has formed therein a plurality of holes or orifices 42 leading to the pressure chamber 23 through the fluid path 23*a* formed in the pump head 84. The valve body 71 has a conical valve seat 75 exposed to an opening of the cylindrical chamber 72. When the solenoid valve 6 is turned on, it will cause the needle valve 73 to be attracted to the stator 65 to bring the valve head 74 into engagement with the valve seat 75, thereby blocking the fluid communication between the orifices 42 (i.e., the pressure chamber 23) and the fluid path 58 (i.e., the low-pressure pump P1).

The cam 13 has the same structure as the one shown in FIGS. 20(*a*) to 21. Specifically, the cam 13 includes the cam surface 13*a*. The cam surface 13*a* has the lift curve, as shown in FIG. 22(*a*), with flat portions (corresponding to the recesses 82 formed on central portions between corners) which holds the cam rollers 22 from moving in the radial direction of the cam 13 for a given period of time (corresponding to a rotational angle θ of the cam 13 which may be selected from 5° to 20° based on a maximum speed of the engine E) so that the plungers 21 stop at the inner limit between the fuel pressure/discharge operation and the fuel suction operation.

The operation of the fuel injection system using the high-pressure pump P of this embodiment will be described with reference to FIGS. 2, and 36(*a*) to 36(*e*).

Figure 36:
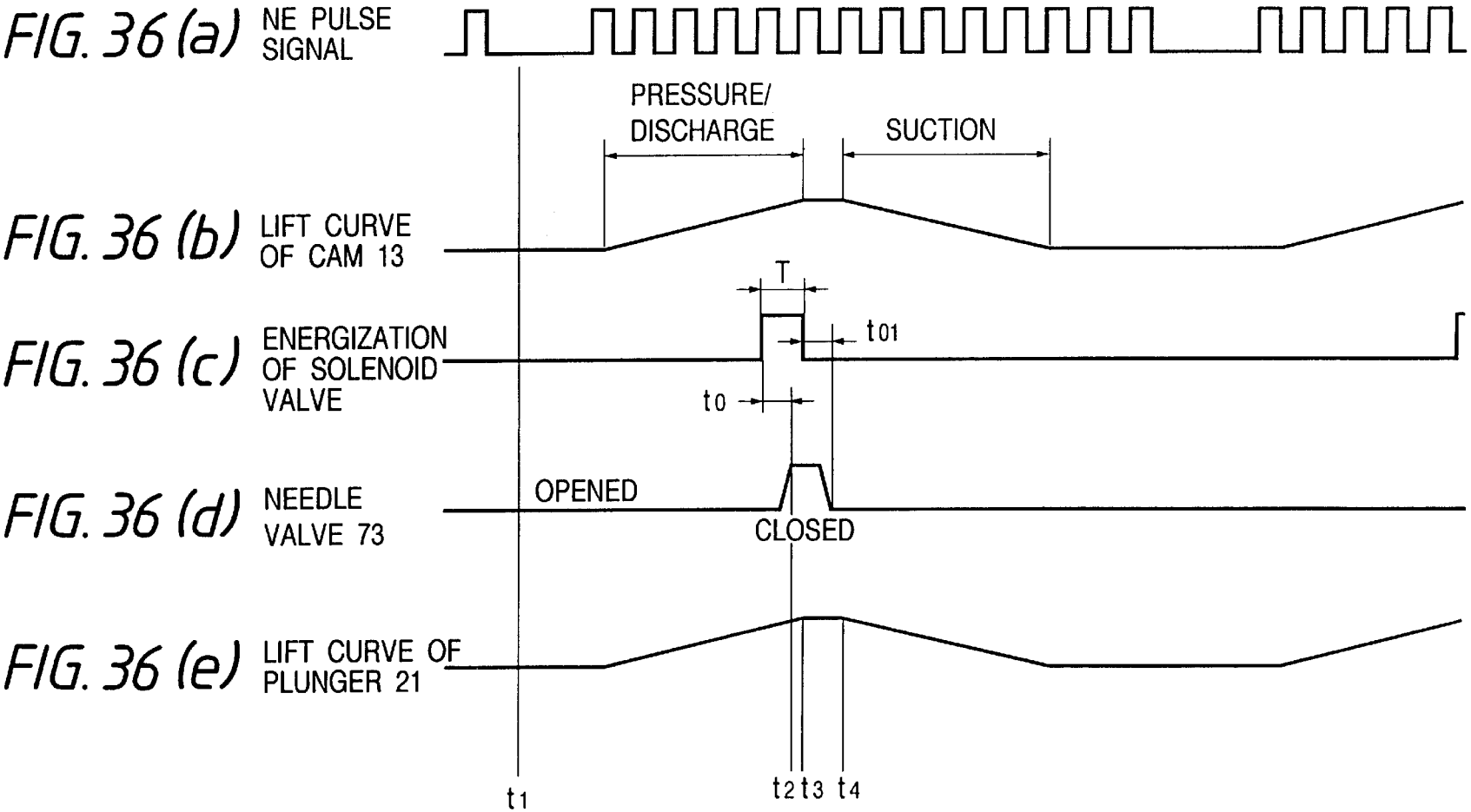
FIG. 36(*a*) is a time chart which shows NE pulse signals indicating the engine speed.

The ECU 100 controls the energization of the solenoid valve 6 based on NE pulse signals, as shown in FIG. 36(*a*), from the engine speed sensor S2 and sensor signals from the load sensor S3, the pressure sensor S1, a coolant temperature sensor, and an atmospheric pressure sensor (not shown).

At time t1, the solenoid valve 6 is turned off. The needle valve 73 is urged by the spring 67 to establish the fluid communication between the fluid path 58 (i.e., the low-pressure pump P1) and the pressure chamber 23. Upon entering the fuel feeding stroke, the plungers 21 start to move inward to pressurize the fuel with the pressure chamber 23, but the fuel flows out of the pressure chamber 23 and returns to the fluid path 15 through the fuel chamber 52. When the ECU 100 turns on the solenoid valve 6, the needle valve 73 is closed fully the time to late to block the fluid communication between the fluid path 58 and the pressure chamber 23 at time t2.

When the needle valve 73 is closed fully, the fuel within the pressure chamber 23 is pressurized so that the pressure thereof rises. Upon exceeding a given level in pressure, the fuel within the pressure chamber 23 is discharged from the delivery valve 3 through the fluid path 24. When the plungers 21 reach the inner limit at time t3, the fuel pressure/discharge operation terminates.

After completion of the fuel pressure/discharge operation, the plungers 21 are, as discussed above, held at the inner limit until the cam 13 rotates an angle of 5° (i.e., until time t4) without entering the fuel suction stroke immediately.

The ECU 100 turns off the solenoid valve 6 the time T after energization. The time T is about 0.5 msec. longer than the time lag to between the energization of the solenoid valve 6 and the time when the needle valve 73 is opened fully for compensating for an inevitable unit-to-unit variation in solenoid valves and/or a variation in voltage of a battery installed in an automotive vehicle. A time lag t01 also occurs between the deenergization of the coil 62 of the solenoid valve 6 and the time when the needle valve 73 is opened fully. Specifically, if the fuel pressure/discharge operation is completed, the needle valve 73 remains closed so that the fuel is not sucked into the pressure chamber 23, thereby causing the cam rollers 22 to disengage from the cam surface 13*a*. This causes, as discussed above, mechanical noise to be produced when the fuel is sucked in the conventional high-pressure pump, but the high-pressure pump P of this embodiment delays, as can be seen from FIGS. 36(*b*) to 36(*d*), the fuel suction operation until the needle valve 73 is opened completely, thereby preventing the cam rollers 22 from disengaging from the cam surface 13*a* immediately after the fuel suction operation starts, thereby avoiding the above problem encountered in the conventional high-pressure pump P.

While the present invention has been disclosed in terms of the preferred embodiment in order to facilitate a better understanding thereof, it should be appreciated that the invention can be embodied in various ways without departing from the principle of the invention. Therefore, the invention should be understood to include all possible embodiments and modification to the shown embodiments which can be embodied without departing from the principle of the invention as set forth in the appended claims.

For example, the check valve 4 may be replaced with any other valve mechanism which is designed to be opened when the low-pressure fuel is sucked into the pressure chamber 23 and kept closed after pressurization of fuel sucked into the pressure chamber 23 until completion of the fuel pressure/discharge operation. Specifically, a solenoid valve may be used which is designed to be closed during pressurization of fuel sucked into the pressure chamber 23 based on a pressurizing duration determined by a pressurization estimating sensor such as a pressure sensor measuring the pressure within the pressure chamber 23, a crank angle sensor, or a plunger sensor detecting movement of the plunger 21 in a pressure increasing direction which is capable of detecting the time when the fuel sucked into the pressure chamber 23 starts to be pressurized.

The second to ninth embodiments use the inner cam pump in the fuel injection system, but a face cam pump may also be used.

What is claimed is:

1. A high-pressure pump comprising:

a pump body;

an inlet port provided in said pump body into which fluid is sucked;

an outlet port provided in said pump body from which the fuel is discharged;

a chamber formed within said pump body;

a plunger slidably disposed within said chamber to define a pressure chamber whose volume is changed according to sliding movement of said plunger, the pressure chamber communicating with said inlet and outlet ports, pressurizing the fluid sucked from said inlet port, and discharging the pressurized fluid out of said outlet port;

a fluid inlet line extending from said inlet port to said pressure chamber;

a first valve disposed within said fluid inlet line, establishing fluid communication between said inlet port and said pressure chamber during a fluid suction operation wherein the fluid is sucked into said pressure chamber, while blocking the fluid communication between said inlet port and said pressure chamber during a fluid feeding operation wherein the fluid sucked into said pressure chamber is pressurized and discharged from said outlet port;

a solenoid valve disposed within said fluid inlet line upstream of said first valve, electrically establishing and blocking fluid communication between said inlet port and said pressure chamber to control a flow rate of the fluid sucked into the pressure chamber through said first valve; and a control unit which controls a time when said solenoid valve is energized so that said solenoid valve starts to open a part of said fluid inlet line upstream of said first valve for establishing the fluid communication between said inlet port and said pressure chamber when said plunger reaches a position where the volume of said pressure chamber is minimized.

2. A high pressure pump as set forth in claim 1, wherein said first valve is a check valve designed to allow the fluid to flow from said inlet port to said pressure chamber, while preventing the fluid from flowing from said pressure chamber to said inlet port.

3. A high-pressure pump as set forth in claim 1, wherein said solenoid valve has a valve head portion which is exposed inside said fluid inlet and which is seated on a valve seat formed in said fluid inlet line to block the fluid communication between said inlet port and said pressure chamber, and wherein the valve head portion is so geometrically shaped that pressure of the fluid urging the valve head portion into engagement with the valve seat is balanced with pressure of the fluid urging the valve head portion out of engagement with the valve seat.

4. A high-pressure pump as set forth in claim 3, wherein a direction in which the valve head portion is moved out of the engagement with the valve seat is different from a direction to which the fluid flows from said inlet port to said pressure chamber.

5. A high-pressure pump as set forth in claim 1, wherein a fluid path is provided which communicates between a portion of said fluid inlet line downstream of said second valve and the inside of said second valve, and a partition is provided within said second valve to isolate, from fluid pressure, component parts of said second valve which would be deformed when subjected to the fluid pressure.

6. A high-pressure pump as set forth in claim 5, wherein said second valve is a solenoid valve including a valve member, a coil, and a resinous bobbin around which the coil is wound, the valve member opening and closing a portion of said fluid inlet line to establish and block fluid communication between said inlet port and said first valve, the coil, when energized, moving said valve member, and wherein said partition is made of a non-magnetic material withstanding the fluid pressure without being deformed and divides the inside of said solenoid valve into a first chamber within which said coil and said bobbin are disposed and a second chamber leading to said fluid path.

7. A high-pressure pump as set forth in claim 6, wherein said fluid path is formed within said solenoid valve.

8. A high-pressure pump comprising:

a pump body;

an inlet port provided in said pump body into which fluid is sucked;

an outlet port provided in said pump body from which the fuel is discharged;

a chamber formed within said pump body;

a plunger slidably disposed within said chamber to define a pressure chamber whose volume is changed according to sliding movement of said plunger, the pressure chamber communicating with said inlet and outlet ports, pressurizing the fluid sucked from said inlet port, and discharging the pressurized fluid out of said outlet port;

a fluid inlet line extending from said inlet port to said pressure chamber;

a first valve disposed within said fluid inlet line, establishing fluid communication between said inlet port and said pressure chamber during a fluid suction operation wherein the fluid is sucked into said pressure chamber, while blocking the fluid communication between said inlet port and said pressure chamber during a fluid feeding operation wherein the fluid sucked into said pressure chamber is pressurized and discharged from said outlet port;

a second valve disposed within said fluid inlet line upstream of said first valve, controlling a flow rate of the fluid sucked, into the pressure chamber through said first valve;

a fluid path which communicates between a portion of said fluid inlet line downstream of said second valve and the inside of said second valve when said second valve allows fluid flow into said pressure chamber; and means for blocking fluid communication between the portion of said fluid inlet line downstream of said second valve and the inside of said second valve when said second valve blocks the fluid flow into said pressure chamber.

9. A high-pressure chamber as set forth in claim 8, wherein said second valve is a solenoid valve having a valve member, the valve member having formed therein said fluid path which also communicates between said pressure chamber and said inlet port, and wherein said means blocks the fluid communication between the portion of said fluid inlet line downstream of said solenoid and the inside of said solenoid, while blocking the fluid communication between said pressure chamber and said inlet port.

10. A high-pressure pump comprising:

a pump body;

an inlet port provided in said pump body into which fluid is sucked;

an outlet port provided in said pump body from which the fuel is discharged;

a chamber formed within said pump body;

a plunger disposed within said chamber slidably to define a pressure chamber whose volume is changed according to sliding movement of said plunger, the pressure chamber communicating with said inlet and outlet ports and pressurizing the fluid sucked from said inlet port;

valve means for discharging the fluid pressurized within said pressure chamber up to a given level from said outlet port; and a cam having a lift curve which moves said plunger in a first direction to decrease the volume of said pressure chamber for pressurizing the fluid within said pressure chamber and in a second direction to increase the volume of said pressure chamber for sucking the fluid from said inlet port during complete rotation of said cam, the lift curve including a portion where said plunger is held from moving for a given period of time until said plunger starts to move in the second direction following the movement in the first direction so as to keep the volume of said pressure chamber constant.

11. A high-pressure pump as set forth in claim 10, wherein a check valve and a solenoid valve are provided, said check valve being disposed within a fluid inlet line extending from said inlet port to said pressure chamber to allow the fluid to flow from said inlet port to said pressure chamber, while restricting the fluid from flowing out of said pressure chamber to said inlet port, said solenoid valve opening and closing a portion of said fluid inlet line upstream of said first valve to control a flow rate of the fluid sucked into the pressure chamber through said check valve, and wherein the given period of time during which said plunger is held from moving is so determined that said solenoid valve opens the portion of said fluid inlet line fully before said plunger starts to move in the second direction.

12. A high-pressure pump as set forth in claim 10, wherein the given period of time during which said plunger is held from moving corresponds to 5° to 20° as expressed as a rotational angle of said cam.

13. A high-pressure pump as set forth in claim 12, wherein said cam has a curved inner wall said plunger follows to move in the first and second directions, said curved inner wall having a portion curved along part of a circle whose center lies at the rotational center of said cam for holding said plunger from moving from the first direction to the second direction for the given period of time.

14. A fuel injection system for an engine comprising:

injectors for injecting fuel into cylinders of the engine;

a high-pressure fuel accumulator pipe connected to said injectors;

solenoid valves controlling fuel injection of said injectors; and a high-pressure pump supplying the fuel to said high-pressure accumulator pipe, wherein said high-pressure pump includes:

a pump body;

an inlet port provided in said pump body into which fluid is sucked;

an outlet port provided in said pump body from which the fuel is discharged;

a chamber formed within said pump body;

a plunger disposed within said chamber slidably to define a pressure chamber whose volume is changed according to sliding movement of said plunger, the pressure chamber communicating with said inlet and outlet ports and pressurizing the fluid sucked from said inlet port;

valve means for discharging the fluid pressurized within said pressure chamber up to a given level from said outlet port; and a cam having a lift curve which moves said plunger in a first direction to decrease the volume of said pressure chamber for pressurizing the fluid within said pressure chamber and in a second direction to increase the volume of said pressure chamber for sucking the fluid from said inlet port during complete rotation of said cam, the lift curve including a portion where said plunger is held from moving for a given period of time until said plunger starts to move in the second direction following in the first direction so as to keep the volume of said pressure chamber constant.

15. A high pressure pump comprising:

a pump body;

an inlet port provided in said pump body into which fluid is sucked;

an outlet port provided in said pump body from which the fuel is discharged;

a chamber formed within said pump body;

a plunger slidably disposed within said chamber to define a pressure chamber whose volume is changed according to sliding movement of said plunger, the pressure chamber communicating with said inlet and outlet ports, pressurizing the fluid sucked from said inlet port, and discharging the pressurized fluid out of said outlet port;

a fluid inlet line extending from said inlet port to said pressure chamber;

a first valve disposed within said fluid inlet line, establishing fluid communication between said inlet port and said pressure chamber during a fluid suction operation wherein the fluid is sucked into said pressure chamber, while blocking the fluid communication between said inlet portion and said pressure chamber during a fluid feeding operation wherein the fluid sucked into said pressure chamber is pressurized and discharged from said outlet port; and a second valve disposed within said fluid inlet line upstream of said first valve, controlling a flow rate of the fluid sucked into the pressure chamber through said first valve, said second valve having a valve head portion which is seated on a valve seat formed in said fluid inlet line to block the fluid communication between said inlet port and said pressure chamber and being so designed that pressure of the fluid urging the valve head portion into engagement with the valve seat is balance with pressure of the fluid urging the valve head portion out of engagement with the valve seat.

16. A high-pressure pump as set forth in claim 15, wherein said first valve is a check valve designed to allow the fluid to flow from said inlet port to said pressure chamber, while preventing the fluid from flowing from said pressure chamber to said inlet port.

17. A high-pressure pump as set forth in claim 15, wherein said second valve is a solenoid valve designed to electrically establish and block fluid communication between said inlet port and said pressure chamber.

18. A high-pressure pump as set forth in claim 17, wherein a direction in which the valve head portion is moved out of the engagement with the valve seat is different from a direction to which the fluid flows from said inlet port to said pressure chamber.

19. A high-pressure pump as set forth in claim 17, wherein a control unit is provided which controls a time when said solenoid valve is energized so that said solenoid valve starts to open a part of said fluid inlet line upstream of said first valve for establishing the fluid communication between said inlet port and said pressure chamber when said plunger reaches a position where the volume of said pressure chamber is minimized.

20. A high-pressure pump as set forth in claim 15, wherein a fluid path is provided which communicates between a portion of said fluid inlet line downstream of said second valve and the inside of said second valve, and in that a partition is provided within said second valve to isolate, from fluid pressure, component parts of said second valve which would be deformed when subjected to the fluid pressure.

21. A high-pressure pump as set forth in claim 20, wherein said second valve is a solenoid valve including a valve member, a coil, and a resinous bobbin around which the coil is wound, the valve member opening and closing a portion of said fluid inlet line to establish and block fluid communication between said inlet port and said first valve, the coil, when energized, moving said valve member, and wherein said partition is made of a non-magnetic material withstanding the fluid pressure without being deformed and divides the inside of said solenoid valve into a first chamber within which said coil and said bobbin are disposed and a second chamber leading to said fluid path.

22. A high-pressure pump as set forth in claim 17, wherein said fluid path is formed within said solenoid valve.

23. A high-pressure pump as set forth in claim 17, wherein the valve head portion is exposed inside the fluid inlet and is so geometrically shaped that the pressure of the fluid urging the valve head portion into constant engagement with the valve seat is balanced with the pressure of the fluid urging the valve head portion out of engagement with the valve seat when the valve head portion is seated on the valve seat.

24. A high-pressure pump as set forth in claim 17, wherein the solenoid valve has an armature, a valve body connecting the valve head and the armature, and a housing defining therein a chamber to which a portion of the valve body connecting with the armature is exposed and whose volume is changed with movement of the valve body by the armature, the chamber being filled with the fluid and communicating with a portion of said fluid inlet line exposed to the valve head portion so as to balance pressure within the chamber with pressure in said fluid inlet line acting on the valve head portion when the valve head portion is moved by the armature out of engagement with the valve seat.

25. A fuel injection system for an internal combustion engine comprising: an injector injecting fuel into the internal combustion engine; and a high-pressure pump supplying the fuel to said injector, said high pressure pump including:

a pump body;

an inlet port provided in said pump body into which fluid is sucked;

an outlet port provided in said pump body from which the fuel is discharged;

a chamber formed within said pump body;

a plunger slidably disposed within said chamber to define a pressure chamber whose volume is changed according to sliding movement of said plunger, the pressure chamber communicating with said inlet and outlet ports, pressurizing the fluid sucked from said inlet port, and discharging the pressurized fluid out of said outlet port;

a fluid inlet line extending from said inlet port to said pressure chamber;

a first valve disposed within said fluid inlet line, establishing fluid communication between said inlet port and said pressure chamber during a fluid suction operation wherein the fluid is sucked into said pressure chamber, while blocking the fluid communication between said inlet port and said pressure chamber during a fluid feeding operation wherein the fluid sucked into said pressure chamber is pressurized and discharged from said outlet port; and a second valve disposed within said fluid inlet line upstream of said first valve, controlling a flow rate of the fluid sucked into the pressure chamber through said first valve, said second valve having a valve head portion which is seated on a valve seat formed in said fluid inlet line to block the fluid communication between said inlet port and said pressure chamber and being so designed that pressure of the fluid urging the valve head portion into engagement while the valve seat is balanced with pressure of the fluid urging the valve head portion out of engagement with the valve seat.

26. A high-pressure pump comprising:

a pump body;

an inlet port provided in said pump body into which fluid is sucked;

an outlet port provided in said pump body from which the fuel is discharged;

a chamber formed within said pump body;

a plunger slidably disposed within said chamber to define a pressure chamber whose volume is changed according to sliding movement of said plunger, the pressure chamber communicating with said inlet and outlet ports, pressurizing the fluid sucked from said inlet port, and discharging the pressurized fluid out of said outlet port;

a fluid inlet line extending from said inlet port to said pressure chamber;

a first valve disposed within said fluid inlet line, establishing fluid communication between said inlet port and said pressure chamber during a fluid suction operation wherein the fluid is sucked into said pressure chamber, while blocking the fluid communication between said inlet port and said pressure chamber during a fluid feeding operation wherein the fluid sucked into said pressure chamber is pressurized and discharged from said outlet port;

a second valve disposed within said fluid inlet line upstream of said first valve, controlling a flow rate of the fluid sucked into the pressure chamber through said first valve;

a fluid path communicating between a portion of said fluid inlet line downstream of said second valve and the inside of said second valve; and a partition disposed within said second valve to isolate, from fluid pressure, component parts of said second valve which are deformed when subjected to the fluid pressure.

27. A high-pressure pump as set forth in claim 26, wherein said second valve is a solenoid valve including a valve member, a coil, and a resinous bobbin around which the coil is wound, the valve member opening and closing a portion of said fluid inlet line to establish and block fluid communication between said inlet port and said first valve, the coil, when energized, moving said valve member, and wherein said partition is made of a non-magnetic material withstanding the fluid pressure without being deformed and divides the inside of said solenoid valve into a first chamber within which said coil and said bobbin are disposed and a second chamber leading to said fluid path.

28. A high-pressure pump as set forth in claim 27, wherein said fluid path is formed within said solenoid valve.

* * * * *